US009090834B2

(12) United States Patent
Hong et al.

(10) Patent No.: US 9,090,834 B2
(45) Date of Patent: Jul. 28, 2015

(54) OZONATION CONVERSION OF HEAVY HYDROCARBONS FOR RESOURCE RECOVERY

(71) Applicant: University of Utah Research Foundation, Salt Lake City, UT (US)

(72) Inventors: P. K. Andy Hong, Salt Lake City, UT (US); Zhixiong Cha, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 138 days.

(21) Appl. No.: 13/664,292

(22) Filed: Oct. 30, 2012

(65) Prior Publication Data

US 2013/0292297 A1 Nov. 7, 2013

Related U.S. Application Data

(63) Continuation-in-part of application No. PCT/US2011/034629, filed on Apr. 29, 2011.

(60) Provisional application No. 61/329,823, filed on Apr. 30, 2010.

(51) Int. Cl.

| | |
|---|---|
| ***C10G 27/14*** | (2006.01) |
| ***C10G 15/12*** | (2006.01) |
| ***C10G 1/04*** | (2006.01) |

(52) U.S. Cl.

CPC ..... *C10G 15/12* (2013.01); *C10G 1/045* (2013.01); *C10G 27/14* (2013.01); *C10G 2300/1077* (2013.01); *C10G 2300/206* (2013.01); *C10G 2300/44* (2013.01)

(58) Field of Classification Search

CPC ..... C10G 15/12; C10G 1/045; C10G 2300/1077; C10G 2300/206; C10G 2300/44; C10G 27/14

USPC ..... 208/3, 46

See application file for complete search history.

(56) References Cited

U.S. PATENT DOCUMENTS

| | | | | |
|---|---|---|---|---|
| 4,046,668 | A | 9/1977 | Farcasiu et al. | |
| 4,405,448 | A * | 9/1983 | Googin et al. | 208/262.5 |

(Continued)

FOREIGN PATENT DOCUMENTS

| | | |
|---|---|---|
| JP | S60231794 | 11/1985 |
| WO | WO 2007/120735 | 10/2007 |
| WO | WO 2009/059124 | 5/2009 |

OTHER PUBLICATIONS

Water Industry News; "Ozone microbubbles boost contaminant removal"; accessed Nov. 25, 2009.

(Continued)

*Primary Examiner* — Walter D Griffin
*Assistant Examiner* — Derek Mueller
(74) *Attorney, Agent, or Firm* — Thorpe North & Western, LLP

(57) ABSTRACT

A method for upgrading heavy hydrocarbons into more usable hydrocarbon products is provided. The method provides for the steps of adding heavy hydrocarbons to a solvent system to form a reaction medium, and ozonating the reaction medium with an ozone containing gas to provide ozonation products. The solvent system can include a first solvent that solubilizes at least a portion of the heavy hydrocarbons and a reactive solvent which reacts with ozonation intermediates. Reactive solvent is maintained at concentrations sufficient to decompose ozonation intermediates.

17 Claims, 30 Drawing Sheets

(56) References Cited

U.S. PATENT DOCUMENTS

| | | | |
|---|---|---|---|
| 4,596,651 | A | 6/1986 | Wolff et al. |
| 2002/0030022 | A1 | 3/2002 | Bradley |
| 2005/0247599 | A1 | 11/2005 | Browne et al. |
| 2006/0163117 | A1 | 7/2006 | Hong |
| 2007/0284283 | A1 | 12/2007 | Duyvesteyn et al. |
| 2007/0284285 | A1 | 12/2007 | Stepanik et al. |
| 2008/0242875 | A1* | 10/2008 | Hong et al. ..... 549/42 |
| 2009/0159536 | A1 | 6/2009 | Hong |

OTHER PUBLICATIONS

"Ozonation of Canadian Athabasca Asphaltene"; dissertation by Zhixiong Cha; University of Utah, May 2009.

* cited by examiner

Figure 3.9. Total ion current mass chromatogram of 0.5 h ozonation products.

OZONATION CONVERSION OF HEAVY HYDROCARBONS FOR RESOURCE RECOVERY

RELATED APPLICATIONS

This application is a continuation-in-part of PCT International Application No. PCT/US11/34629, filed Apr. 29, 2011 which claims the benefit of U.S. Provisional Patent Application Ser. No. 61/329,823 filed on Apr. 30, 2010, which are each incorporated by reference.

FIELD OF THE INVENTION

This invention relates generally to ozonation of heavy hydrocarbons. Therefore, the present invention relates generally to the fields of chemistry, fuel recovery and refinery, and materials science.

SUMMARY

A method for upgrading heavy hydrocarbons into more usable hydrocarbon products is provided. The method provides for the steps of adding heavy hydrocarbons to a solvent system to form a reaction medium, and ozonating the reaction medium with an ozone containing gas to provide ozonation products. The solvent system can include a first solvent that solubilizes at least a portion of the heavy hydrocarbons and a reactive solvent. In one aspect of the invention, the ozonation products remain substantially solubilized in the solvent system throughout the upgrading process.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
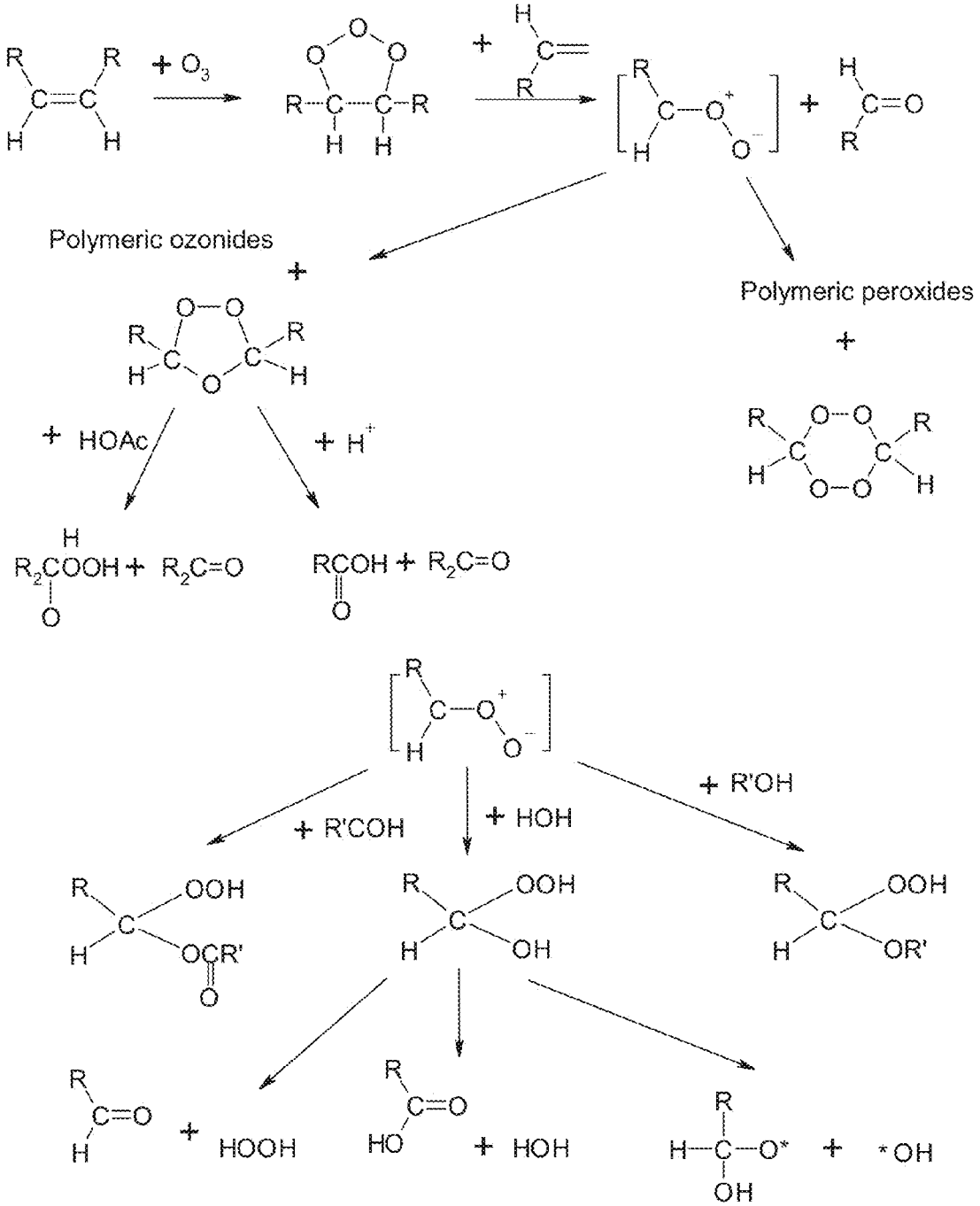
FIG. 1 is a schematic of ozonation of an alkene in accordance with an embodiment of the present invention.

These figures are not necessarily to scale and actual dimensions may, and likely will, deviate from those represented. Thus, the drawings should be considered illustrative of various aspects of the invention while not being limiting. Reference will now be made to the exemplary embodiments illustrated, and specific language will be used herein to describe the same. It will nevertheless be understood that no limitation of the scope of the invention is thereby intended.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Accordingly, the scope of the present invention is to be defined solely by the appended claims.

Definitions

The singular forms "a," "an," and "the" include plural referents unless the context clearly dictates otherwise. Thus, for example, reference to "a solvent" includes reference to one or more such materials and reference to "injecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, the term "reactive solvent" and "participating solvent" are used interchangeably and refer to solvents that can effectively inhibit the precipitation of intermediate ozonation products from the solvents systems described herein. Typically, suitable reactive solvents are proton donors which react with ozonation intermediates to form hydroperoxides. Non-limiting examples of such reactive solvents include acetic acid, methanol, acetone, and water.

As used herein, the term "ozonation products" refers to molecules and compounds generated from the reaction of ozone with the heavy hydrocarbons and/or reactive solvent. Ozonation products can include both final products as well as intermediate compounds which can be generated during the process.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. Accordingly, the scope of the invention should be determined solely by the appended claims and their legal equivalents.

Upgrading Heavy Hydrocarbons Using a Reactive Solvent System

A method for upgrading heavy hydrocarbons into more usable hydrocarbon products is provided herein. The method provides for the steps of adding heavy hydrocarbons to a solvent system to form a reaction medium, and ozonating the reaction medium with an ozone containing gas to provide ozonation products. The solvent system can include a first solvent that solubilizes at least a portion of the heavy hydrocarbons and a reactive solvent. In one aspect of the invention, the ozonation products remain substantially solubilized in the solvent system throughout the upgrading process In one aspect, the heavy hydrocarbons can be, but are not limited to, asphaltene, bitumen, vacuum residue, asphalt, heavy oil, any other heavy hydrocarbons, and combinations or mixtures of these materials.

The first solvent of the solvent system can be capable of solubilizing at least a portion of the heavy hydrocarbons prior to their ozonating. The first solvent of the solvent system can be selected from dichloromethane, trichloromethane, acetone, ozonated biodiesel, cyclohexane, hexane, heptane, pentane, cyclopentane, butane, carbon tetrachloride, tetrachlorodifluoroethane, octafluoronaphthalene, tetrachloroethane, hexachloroethane, and mixtures thereof. In one aspect, the first solvent can be a non-halogenated solvent. In another aspect, the first solvent can be ozonated biodiesel. Ozonated biodiesel refers to biodiesel that has had substantially all of the double bonds removed through ozonation. The biodiesel can be derived from any source known in the art such as olive oil or other known sources.

The reactive solvent or participating solvent of the solvent system generally acts to inhibit precipitation of the ozonation products and intermediates from the reaction medium. The reactive solvents can be proton donating and can ultimately be consumed or incorporated into the ozonation products. Non-limiting examples of reactive solvents include methanol, acetic acid, water, ethanol, hydrogen peroxide, and mixtures thereof. Depending on the amount a number of factors, including the particular solvents in the solvent system and the amount of heavy hydrocarbons being upgraded, the solvent system can have a reactive solvent to first solvent ratio of about 0.01:1 (V/V) to about 10:1 (V/V). In one aspect, the ratio can be 0.1:1 (V/V) to about 1:1 (V/V), and in some cases to 0.5:1 (V/V). These are typically initial ratios. More specifically, in some cases the reactive solvent can be less than about 5 vol % to less than about 10 vol % initially. As a general guideline, the heavy hydrocarbon can be added from 0.5 to 20 volume % of the solvent system. As heavy hydrocarbons are reduced to lower molecular weight compounds the reactive solvent concentration can be increased. This is allowed since most low molecular weight products are miscible with the reactive solvent. Thus, the first solvent concentration can be accordingly reduced and in some cases removed as long as the reactive solvent can be kept in solution (i.e. via dissolution in reaction products). In this manner, the ratio of reactive and first solvent can be varied as the process progresses.

Furthermore, the reactive solvent in the reaction medium to promptly decompose or react with ozonation intermediates e.g. ozonides and hydroperoxides which are generated through reactions of ozone with heavy hydrocarbons in the first solvent. As a consequence, the reactive solvent can keep the reaction medium homogenous, to prevent precipitation of the reaction intermediates and reaction products in the first solvent. Since the reactive solvent is consumable in the reaction medium, supplementary reactive solvent can be continuously added into the reaction medium during the process. Supplemental reactive solvent can be intermittently added into the reaction medium or can be continuously added. In either case, the reactive solvent can be maintained at concentrations sufficient to decompose ozonation intermediates during and throughout ozonation. Thus, continuously adding supplementary reactive solvent into the reaction medium during the whole reaction process can prevent precipitation of reaction intermediates and keep high ozone efficiency. The concentration of reactive solvent in the reaction medium is controlled to keep the reaction products solubilized in the solvent mixture.

In one embodiment, the solvent system can be a mixture of a first solvent and a reactive solvent, and can include a plurality of additional solvents (e.g. non-reactive). In another embodiment, the solvent system can include one or more of cyclohexane, acetone, and water. In yet a further embodiment, the solvent system can include a mixture of cyclohexane, acetone, and methanol. In still another embodiment, the solvent system can include cyclohexane, acetone, methanol, and water.

Ozonating of the heavy hydrocarbon containing reaction medium facilitates breaking down of the large heavy hydrocarbon molecules into smaller, more usable hydrocarbon molecules, i.e. upgrading of the heavy hydrocarbons. The ozonating can take place at ambient temperature and pressure or the pressure can be altered depending on the solvent system and the amount of heavy hydrocarbons being upgraded. In one embodiment, the ozonating can take place at a temperature greater than 50° C. Generally, ozonation can take place at a temperature from −5° C. to 100° C. Ozonation pressures can typically range from 0.01 psi to 100 psi. In another embodiment, the ozonating can take place at a pressure of at least about 15 psi. In yet a further embodiment, the ozonating can take place at a pressure of about 50 psi to about 100 psi. An additional embodiment provides for ozonating to take place at a pressure of about 60 psi to about 80 psi.

The ozonating of the reaction medium can take place in any apparatus capable of retaining the reaction medium and the ozonation products during the upgrading process. In one embodiment, the ozonating can be accomplished in a bubble column reactor configured to allow for injection or bubbling of an ozone containing gas into the reaction medium present in the reactor. The ozone containing gas can be flowed into the reaction medium at a rate of 0.1 L/min to 10 L/min per liter of reaction medium, with an ozone concentration of 0.01% to 15% by volume. In one embodiment, the ozonating can be accomplished by flowing the ozone containing gas into the reaction medium at a rate of about 1.6 L/min and an ozone concentration of 1.6% by volume. Generally, the mole ratio of the ozone absorbed into the solvent system to the heavy hydrocarbon can be at least 2:1. In one aspect, the mole ratio can be at least 5:1.

As discussed herein, the present ozonating process can substantially reduce the molecular weight of the heavy hydrocarbons. In one embodiment, the molecular weight of the heavy hydrocarbons can be reduced by at least 50% after ozonating. In one aspect, the molecular weight of the heavy hydrocarbons can be reduced by at least 75% after ozonating, and in some cases at least 80%.

Additionally, the present disclosure provides for a hydrocarbon mixture manufactured by the processes discussed herein. As such, in one aspect, the hydrocarbon mixture can have ozonation products that remain substantially solubilized in the solvent systems disclosed herein.

EXAMPLES

Example 1

Ozonation of Athabasca Asphaltene in Dichloromethane/Participating Solvents

Generally, ozone can react with a wide variety of organic compounds via two possible pathways: an electrophilic addition and radical-chain oxidative reactions. The most accepted reaction mechanism of ozone with carbon double bonds is the Criegee mechanism shown in FIG. 1. When ozonation (ozonolysis) is conducted in non-participating solvents, the carbonyl oxides and carbonyl fragments react to form stable secondary ozonides. When participating solvents such as proton donors are added in the reaction phase, carbonyl oxides directly react with proton donors to form hydroperoxides. For example, FIG. 1, ozonation of alkene where R is H and other groups. Alkenes in the presence of methanol and base directly forms esters without generation of the carboxylic acid. The reaction of ozone with unsaturated hydrocarbons can also generate hydroxyl radicals (*OH) from the isomerized carbonyl oxide and subsequent decomposition of -acyloxyalkyl hydroperoxides when participating solvents are in presence, but in the liquid phase, decomposition of hydroperoxides is more responsible for generation of hydroxyl free radicals since the carbonyl oxide molecules are stabilized by collisions with surrounding molecules. Ozonation of aromatic compounds has a similar reaction mechanism, but the intramolecular secondary ozonides are not likely to generate.

The reaction of saturated petroleum hydrocarbons such as alkanes, arenes, and heteroatomic compounds with saturated fragments can undergo radical-chain oxidative transformations and can form carboxylic acids, carbonyl compounds, alcohols, and peroxides. Recent research results have confirmed that ozonation of C—H bonds in saturated hydrocarbons first generate alkyl hydrotrioxides (ROOOH) and hydrogen trioxide (HOOOH) if abstractable-hydrogen atoms are available, and the subsequent decomposition of alkyl hydrotrioxides and hydrogen trioxide initiates chain oxidation.

Ozonation can be used to treat heavy oils since the electrophilic reactions of ozone with some heterofunctional sulfides, disulfides, and amines are more effective for heavy oil upgrading. The addition of ozone is accompanied by formation of oxides with splitting of a molecule of oxygen, such as the oxidation of sulfides by ozone. The reactions also could have involved radical-chain oxidative reactions. Petroleum feedstock contains metals such as Fe, Co, V, Cr, Ni, and Zn, among which the metals in the form of polyligand complexes with S, N, and O atoms in heterorganic compounds can be active catalysts during ozonation.

Homogeneous ozonolysis of asphaltene from semicoking tar of coal in chloroform has been studied with proposed two possible reaction pathways: cleavage of peripheral aromatic rings and heterocycles via ozonides and free-radical oxidation of aliphatic substitutes and naphthenic rings. The indirect oxidation of asphaltenes by ozone through variable-valence metal ions can also generate carboxylic acids. The ozonation products of coal asphaltene could be different from ozonation products of oil asphaltene because coal asphaltenes are smaller in size and have fewer aromatic ring systems and shorter side chains compared with petroleum asphaltene. The ozonation of petroleum feedstock has generated smaller compounds with carboxylic and carbonyl groups, which made the ozonation products more hydrophilic.

The present inventors have discovered that converting heavy hydrocarbons to lighter useful products through ozonation can be accomplished efficiently and effectively through the methods described herein. Because asphaltenes are the heaviest, most refractory, and most complex fractions in petroleum feedstocks and are combinations of various chemical species with high molecular weight, ozonation of asphaltenes has particular interest for the study of heavy hydrocarbons oxidation. The molecular weight of asphaltenes has been debated for decades because determination of the molecular weight is greatly affected by the measuring methods and conditions. For example, asphaltenes are soluble in liquid with high surface tension (>25 dynes/cm$^{-1}$) and molecular aggregation of asphaltenes is even observed in good solvents for asphaltenes, e.g., pyridine, toluene, benzene, etc.

Figure 2A:
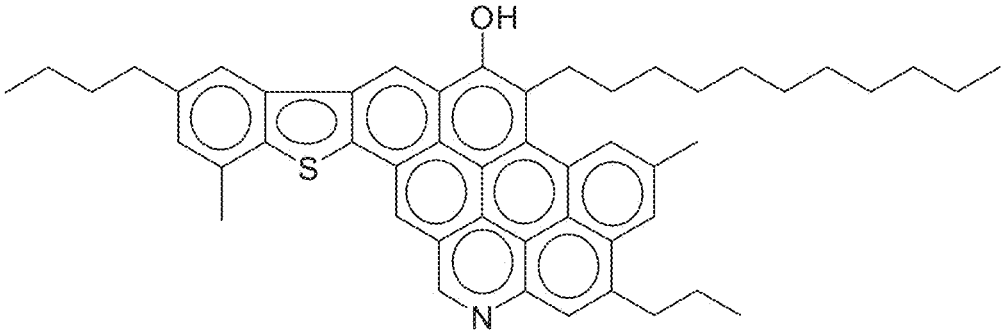
FIG. 2 shows exemplary structures of (A) condensed aromatic cluster type of asphaltene and (B) bridged aromatic type of asphaltene in accordance with embodiments of the present invention.
Figure 2B:
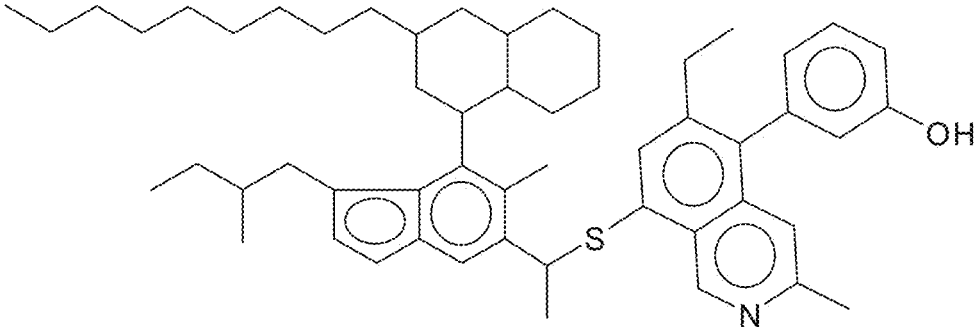

Many mass spectroscopy results and many other studies suggested asphaltenes have a relative low molecular weight of approximately 1000 amu, which is not as high as assumed before. The number of rings and the size of rings in a single asphaltene fused ring system have been another area of uncertainty. Based on early huge molecular weight theory, the fused ring system has from only a few up to 20 rings. However, results from many different techniques, such as scanning tunneling microscopy, x-ray scattering, NMR, optical absorption, and fluorescence emission spectroscopy indicate that asphaltene ring systems have 4 to 10 fused rings with 7 rings on average. In general, the asphaltene molecules consist of at least two polyaromatic systems one part has a single, rigid, and flat core formed by the fusion of polycyclic aromatic and naphthenic units, and this part has a higher C/H ratio and shorter aliphatic side chains; another part has a lower C/H ratio and longer side chains, the molecules consist of several smaller polycyclic aromatic and naphthenic units connected by bridging aliphatic chains. Two typical asphaltene structures are shown in FIG. 2. Heteroatoms are incorporated into the structures as an internal constituent of the aromatic rings or functionalities.

Recently, new methods have been attempted instead of conventional thermal decomposition and hydrogenation for upgrading of asphaltenes. These new methods, such as ozonolysis, oxygen and chemical oxidation, alkylation, sonolysis, and steam cracking, have revealed more details of asphaltene molecules upon analysis of the reaction products. The combinations of IR and NMR spectroscopy and TGA analysis have proved that the most active sites in asphaltene molecules are benzylic hydrogen and benzylic carbon (the side chain carbon atom adjacent to the aromatic ring system) for chemical oxidation. The ruthenium ions catalyzed oxidation (RIOC) reaction of asphaltenes with NMR analysis has shown that a part of asphaltene has a set of smaller aromatic units, hetroaromatic and naphthenic units with aliphatic chains linked by aliphatic bridges, and the majority RIOC products are esters with carbon number between 2-40.

EXPERIMENTAL

Materials and Analytical Methods

The raw asphaltene used in this experiment was asphaltene fraction of oil sands bitumen from Canada Athabasca. This asphaltene was a mixture of asphaltene and other constituents, such as clays, coal, and metal oxidizes that are not soluble in organic solvents. To evaluate the influence of inorganic parts on ozonation, ozonation effects of raw asphaltene and the asphaltene extracted by organic solvents were compared under the same conditions. The separation process of the asphaltene and the insoluble part was performed by Soxhlet extraction or direct separation of asphaltene solution from the insoluble parts by centrifuging.

Toluene, pyridine, tetrahydrofuran (THF), dichloromethane (DCM), trichloromethane, acetone, acetic acid (HAC), ethyl acetate, $CS_2$, methanol, 2-propanol, n-heptane, and n-hexane were analytical reagent grade. Ozone was generated by an ozone generator (Model T-816, Polymetrics Corp.) from dry and filtered air or pure oxygen at an applied voltage of 100 V and gas flow rate of 1.0 L/min to 2.0 L/min. Concentration of $O_3$ in the gas phase was determined by sample absorbance at 600 nm using a 1 cm quartz cell with a spectrophotometer (HP 8452 UV/Vis spectrophotometer, Hewlett Packard) according to modified Indigo Colorimetric Method. Indigo Blue solutions were prepared by dissolving (C16H7N2O11S3K3) (Aldrich Co.) in distilled/deionized water as a solvent. To measure ozone concentration, a 100 ml round flask with 24/40 joint was first filled with 50 ml of 1 mM/L potassium indigo trisulfanate solution and the head space of the flask was filled with ozone containing gas, then the flask was closed with a plug and shacked vigorously for 10 min. The absorbance of the solution was measured to calculate the remaining potassium indigo trisulfanate concentration by a calibration curve. Since consumption of ozone was proportional to consumption of potassium indigo trisulfanate, ozone concentration was calculated.

The amount of solvent insoluble part was determined by Soxhlet-extraction. A raw asphaltene sample was Soxhlet extracted with toluene and pyridine (cleanup procedure of asphaltene). After the raw asphaltene sample was dried in a desiccator for more than 24 h, the asphaltene sample was extracted using either toluene or pyridine as a solvent or with one solvent followed by the other. The solids in the thimble were dried and kept under vacuum at 60° C.-80° C. until its weight changed no further. For comparison, a fast separation method, direct centrifuge separation of a raw asphaltene solution from the insoluble solids, was performed. A dried raw asphaltene sample was added into an excess solvent (toluene, pyridine, TCE, THF, or DCM). The solution was ultrasonically agitated for at least 30 min and then left for 24 h; then the solution was centrifuged for 30 min to separate the solids from liquid; the insoluble solids were dried under vacuum at 60° C.-80° C. and weighed to determine the insoluble contents concentration in the raw asphaltene. A raw asphaltene sample was also Soxhlet-extracted with n-hexane to determine concentration of the resin and other hexane soluble parts (could be maltene). A dried raw asphaltene sample was extracted with n-hexane for 48 hours. After extraction, the remaining solids were dried under vacuum at 60° C.-80° C. until the weights change no further and then were weighed.

Soxhlet extraction results showed that 42.2±0.3% by weight of constituents in the raw asphaltene was not extractable by toluene for 48 hours, whereas 44.3±0.2% was not extractable by pyridine for 48 hours. If the raw asphaltene was subsequently extracted by toluene and pyridine for a total of 96 hours, only 39.4±0.2% was not extractable. About 9.2±0.2% by weight of the raw asphaltene was extracted with n-hexane. Although asphaltenes are precipitated by n-paraffin, the resinous material forming micelle with asphaltenes and other maltene materials are still extractable with n-paraffin, such as carboxylic acids, fluorenones, fluorenols, polycyclic terpenoids, sulfoxides, carbazoles, and quinolines. A part of the low molecular weight asphaltene fragments can also be extracted by hexane. Fluorescence emission spectroscopy study shows that although asphaltenes have large ring systems, small amounts of asphaltenes with one to three small moieties are detected. In this example, mechanical mixing and separation of the asphaltene sample with excessive solvent, such as toluene, DCM, and pyridine, only dissolved 57.0±0.3% by weight of the sample, but 60.0% of it was dissolved if the asphaltene was treated with inorganic acid such as $H_2SO_4$ before extraction. This result indicates that some organics in the raw asphaltene are chemically bonded to the insoluble solids or surrounded by the insoluble solids.

The toluene asphaltene solution obtained from the Soxhlet-extraction procedure was titrated by n-heptane to determine the asphaltene concentration in the extracted organics. The 10 ml toluene solution with a concentration of 100 g/L solute was diluted by 500 ml n-heptane, and the precipitated solids were separated from solution. This process was repeated three times. The precipitated part was dried and weighed after titration. Experimental results showed that about 93.5±0.8% by weight of the solute was precipitated by n-heptane. This part should be the asphaltene fraction in the raw asphaltene sample.

The insoluble part extracted with toluene and followed with pyridine was analyzed by LOI method. The LOI analysis followed the method employed by Heiri et al. and showed that in the insoluble portion of raw asphaltene, about 36±0.3% by weight of the insoluble portion was volatile organic compounds but these compounds were not soluble in toluene and pyridine (ignition at 550° C.). Another 3.3±0.1% by weight of this insoluble part was coal or similar constituents (carbonate at 950° C.). The remaining 59.57±0.3% of the insoluble part was likely of clay or other inorganic solids. This part is almost inert to ozone because long-term ozonation of this part in DCM/methanol got very few acetone soluble products.

For GC/MS analysis, a GC 6890N (Agilent Technologies) installed with a capillary column (HP-5 ms, nonpolar column, 30 m×0.25 mm×0.25 um) was coupled with a MSD 5973 (Agilent Technologies) and controlled by the MSD Productivity ChemStation software (Agilent Technologies). One uL sample was injected into a splitless inlet at 250° C. The sample was carried by helium and the mass range from 50 to 550 m/z was scanned. The oven temperature was programmed from 50° C. (initially held for 1 min) to 100° C. at 25° C./min, followed by 100° C. to 350° C. at 5° C./min and at the end, the temperature was maintained for 5 min. Helium was used as the carrier gas at a velocity of 35 cm/sec. All the compounds were identified by the NIST/EPA/NIH Mass Spectral Library.

Ozonation of Athabasca Asphaltene

Figure 3:
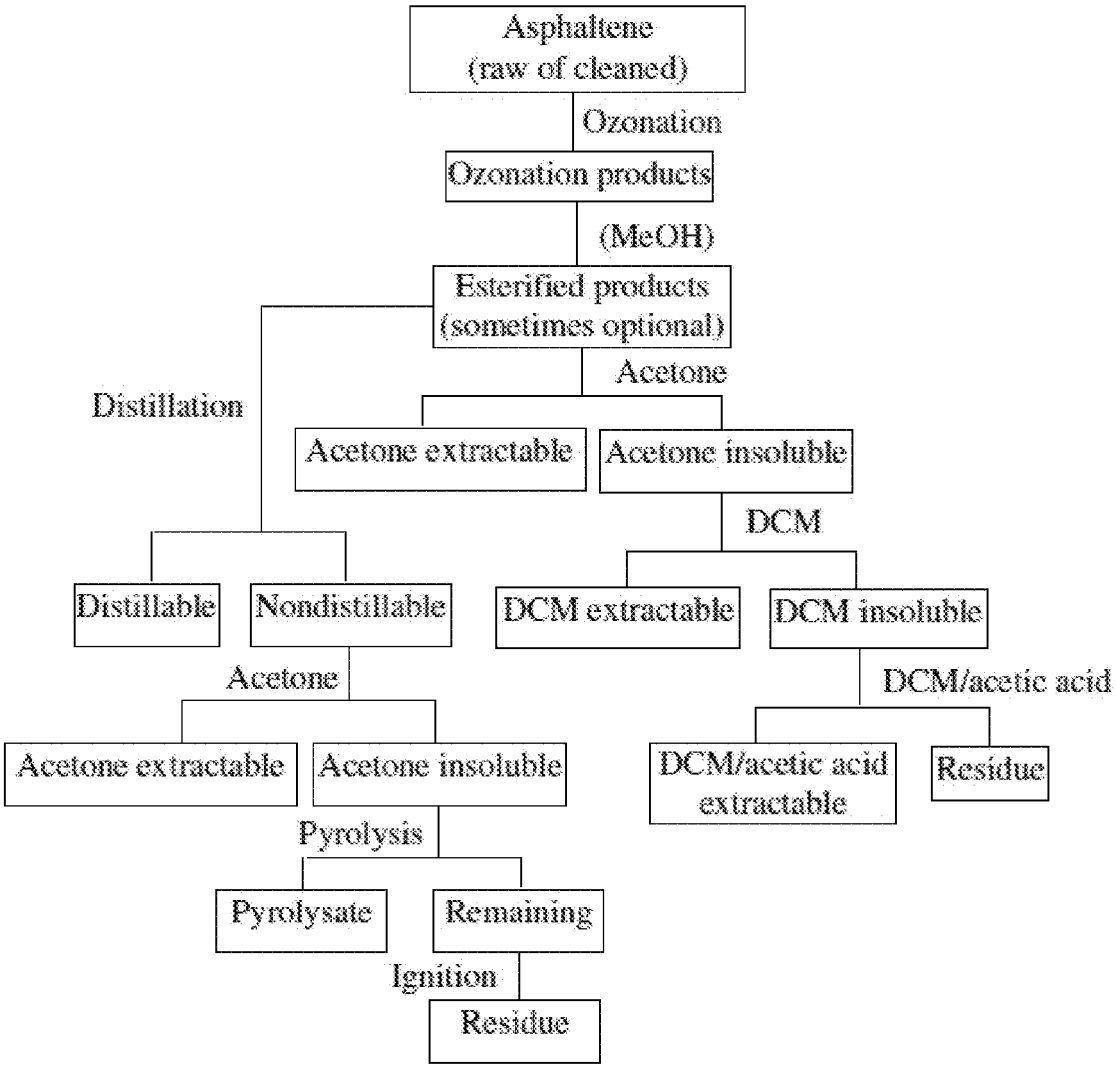
FIG. 3 provides a flow chart for the ozonation of asphaltene and subsequent processing in accordance with an embodiment of the present invention.
Figure 4:
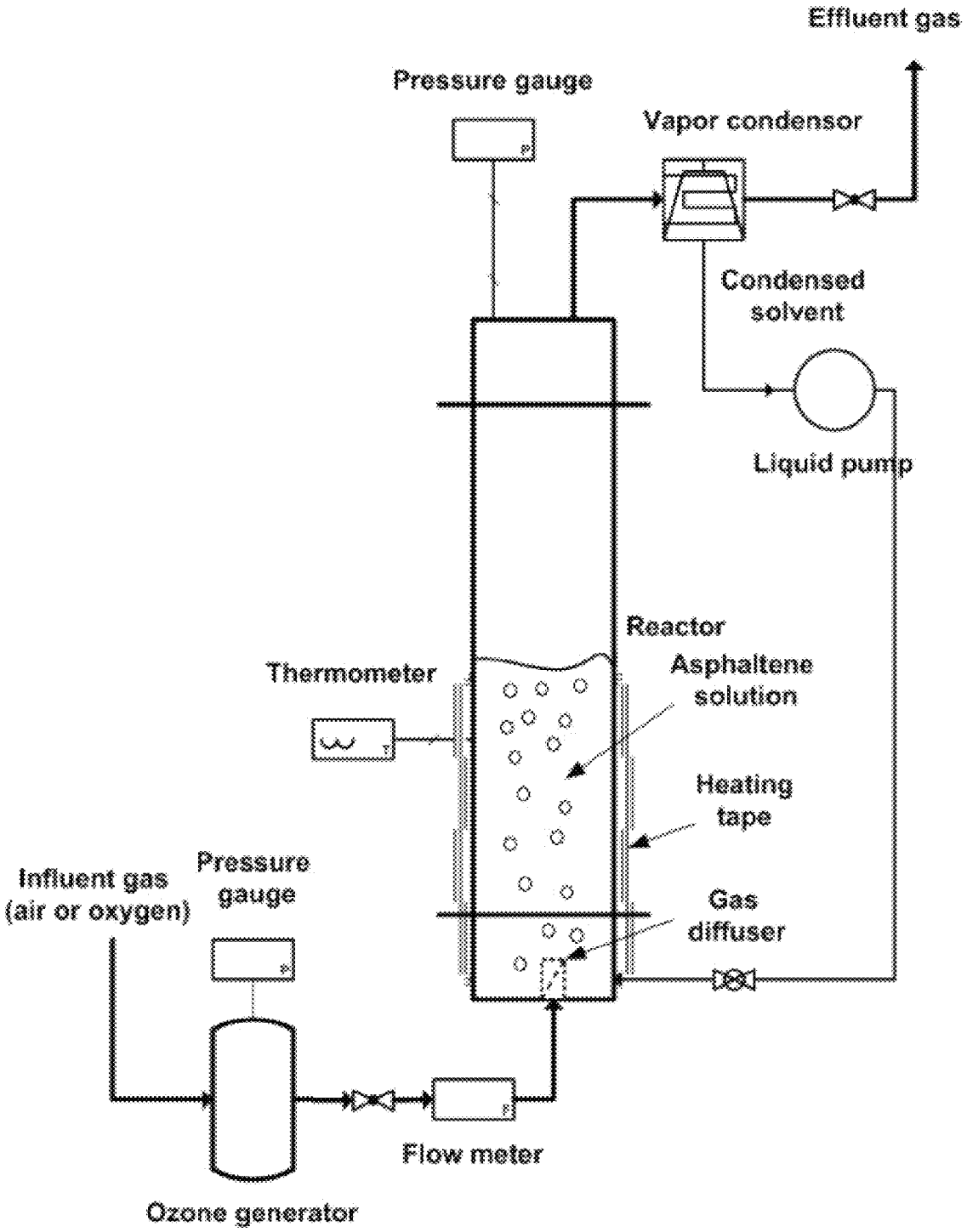
FIG. 4 is a reactor diagram of an ozonation reactor in accordance with an embodiment of the present invention.

The procedure of asphaltene ozonation, separation, and processing of the ozonation products is depicted in FIG. 3. The Canadian Athabasca asphaltene sample was ozonated in selected solvents (DCM or trichloromethane) and the results were evaluated for practice. The effects of asphaltene concentration and ozonation time were evaluated with the aim to optimize the ozonation conditions. Ozonation of asphaltene samples obtained from the two separation methods described before and without any pretreatment were conducted in a three-neck flask or a reactor illustrated in FIG. 4. If the asphaltene sample was extracted by toluene (or pyridine), the solution was dried under vacuum at 60° C.-80° C. until complete solvent evaporation. The dried asphaltene sample was dissolved in DCM or other solvents or solvents mixtures. The reaction was conducted by bubbling ozone-containing air (1-2% of ozone by volume) through a gas diffuser into 200 to 400 ml asphaltene solution. The ordinary asphaltene concentration in solution was in the range of 30 g asphaltene/L solvent to 300 g asphaltene/L solvent (insoluble solids were excluded if not specified). For some experiments, the asphaltene concentration was increased to 500 g asphaltene/L solvent to evaluate the stability of the reaction at high loading. The reaction temperature was controlled at 10° C. to 25° C. by a water bath in the three-neck-flask or at 10° C. to 80° C. by a heating tape surrounding the LC column (a LC column from ACE for pressurized reaction) when necessary. Ozonation of the asphaltene was operated under normal pressure in the three-neck flask and the reaction pressure was kept in the range of 0 psi (1 atm) to 100 psi by pumping the ozone containing air into the LC column through a gas compressor. The reactants were ozonated from 30 min to 720 min. Samples were taken every 30 min or 1 hour for analysis throughout the course of reaction. For comparison, the control experiments in which only air was bubbled through asphaltene solutions were performed and the products were analyzed using the same methods.

Ozonation of the asphaltene was normally conducted in DCM, and DCM/Acetic acid mixture or DCM/Methanol (MeOH) mixture. Ozonation of the asphaltene in another solvent, such as DCM/water, was also performed. The experimental procedures of the asphaltene in other solvents were identical to those in DCM, and DCM/acetic acid mixture or DCM/MeOH mixture. Normally, 10-20% by volume of acetic acid was incorporated into the DCM/asphaltene solution before ozonation. Too high an amount of acetic acid in the solvent mixture would cause deposition of the asphaltene prior to ozonation (1 volume acetic acid to 1 volume DCM being good). In some experiments, methanol was gradually added into the reaction system during ozonation to prevent precipitation as well as achieve esterification of the ozonation products. The reaction temperature and pressure were maintained at the same conditions as those in DCM/acetic acid for comparison. This was not done when acetic acid was used with DCM, because MeOH is very active toward the acetic acid. Esters were readily obtained by addition of MeOH to the acid products even at low temperature. Normally, less than 10% by volume of MeOH was mixed with DCM before ozonation (note that at the beginning, high MeOH concentration could cause precipitation of the asphaltene because MeOH is not a good solvent for asphaltene). Pure oxygen was also used in ozone generation instead of air to evaluate influence of ozone concentration on reaction. The resulting ozone concentration out of the ozone generator was about 5% by volume (affected by the flow rate), over 3 times of the ozone concentration generated from air (1.6% by volume at the flow rate of 1.6 L/min). The ozone-enriched gas was bubbled through asphaltene solutions in the same manner with air. After different ozonation times, the products were dried and weighed. Increases of weight were used to estimate the amount of ozone consumed by the asphaltene. The ozonation intermediates and ozonation products were analyzed by GC-MS method.

In a typical experiment, a 5 to 20 g asphaltene sample (weight of insoluble part excluded if not specified), 200 ml DCM, or 190 ml DCM and 10 ml MeOH, or 160 ml DCM and 40 ml acetic acid were added into a 500 ml three-neck flask or a three-inch LC glass column. The solution was purged for 0.5 to 12 hours by 1.6% of ozone containing air with the flow rate of 1.6 L/min (normal pressure volume). Additional DCM/MeOH or DCM/acetic acid was pumped into the reactor every 1 hour for compensation of solvent evaporation. After reaction, the ozonation products were dried in a beaker under vacuum at room temperature for at least 24 hours (some solvents, such as acetic acid, needed higher temperature for evaporation) and weighed.

Results and Discussions

Evaluation of Ozonation Reaction and Analysis of the Ozonation Products. It was found that the ozonation intermediates in nonparticipating solvent were insoluble in most solvents, including DCM, acetone, ethyl acetate, 2-propanol, and toluene, but the ozonation intermediates were partially soluble in THF and $CS_2$ and almost totally soluble in pyridine. The polarity of treated asphaltene intermediates could have been increased to precipitate when oxygen atoms associate with asphaltene molecules (forming ozonides). Also, the intermolecular ozonides and polymeric ozonides could make asphaltene more aggregated. The reaction rate of any precipitated solids with ozone is understandably low. Possible coprecipitation of asphaltene with the intermediates will lower the ozonation rate too. Therefore, in the experiments, different solvents (or solvent mixtures) were tested to prevent the precipitation of intermediates and ozonation products during treatment. The effects of solvents on ozonation treatment are shown in Table 3.1. The polarity of solvent could strongly affect the ozonation rate and the reaction pathway. It was found that methanol and acetic acid can prevent precipitation of the intermediates. The reason to select acetic acid and methanol as cosolvent was based on the consideration of low reaction rates of ozone with cosolvents and expectation of the ozonation products with participating solvents. Although water could be an effective participating solvent, water is not soluble in DCM and, hence, is finally emulsified in the reaction system due to generation of hydrophilic compounds. The ozonation intermediates in participating solvent were found to be soluble in acetic acid and DCM mixtures (volume ratio of acetic acid to DCM from 0.1-0.5:1). When 10-20% (by volume) of acetic acid was added into the DCM/asphaltene solution, no significant precipitation was observed throughout reaction.

TABLE 3.1

Precipitation of intermediates and deposition of asphaltene on the gas diffuser for asphaltene ozonation in different solvents.

| Solvent | Precipitation (normal pressure, 1.6 L/min flow rate) | Deposition on gas diffuser (normal pressure, 1.6 L/min flow rate, no temperature control) |
|---|---|---|
| DCM | Precipitation was observed after 30 min. | Began if asphaltene concentration > 100-120 g/L solvent |
| DCM/ acetic acid | No precipitation during reaction. Acetic acid:DCM < 1:2 (v:v). | Began if asphaltene concentration > 140-160 g/L solvent |
| DCM/ MeOH | No precipitation during reaction. MeOH:DCM < 1:10 (v:v). | Began if asphaltene concentration > 120-150 g/L solvent |
| DCM/ acetone | Precipitated after 30 min, even asphaltene concentration was very low. | Began if asphaltene concentration > 80-100 g/L solvent |
| DCM/ hexane | Precipitated before reaction. | Not tested |
| DCM/ water | Began to precipitate after 30 min. Water phase and DCM phase was separated. | Began if asphaltene concentration > 100-120 g/L solvent |

Based on the GC/MS identified ozonation products (most were saturated aliphatic acids) and reaction pathways being contemplated, it was decided that methanol (MeOH) should be added continually during ozonation. It was found that if MeOH concentration was controlled at less than 10% by volume, no precipitation was observed at the beginning of the reaction. Methanol participated in the reaction and formed a part of the ozonation products, which could be different from the mechanism of acetic acid although both the reaction intermediates were alkoxy hydroperoxides and aryloxy hydroperoxides, respectively. Another problem of the reaction was that during ozonation, the asphaltene was immediately deposited on the gas diffuser if the asphaltene concentration was relatively high (>120 g/L solvent) and finally clogged the gas diffuser. This situation should be avoided because it made dispersion of gas bubbles in the reaction system unstable and decreased interfacial mass transfer area. Deposition of the asphaltene on the diffuser was different from precipitation of the ozonation intermediates. Originally it was assumed that the deposition of the asphaltene on the gas diffuser was due to crosslinking of the asphaltene molecules during ozonation. However, bubbling air through the reaction system also caused deposition of the asphaltene on the gas diffuser. This indicated that the deposition was a physical process. This phenomenon could be caused by lower temperature near the gas diffuser when DCM was selected as a solvent. Deposition was forming a high viscose asphaltene film on the gas diffuser but precipitation was caused by higher polarity of the ozonation intermediates or generation of the intermolecular ozonides and polymeric ozonides. Increasing ozonation temperature or adding acetic acid and methanol could increase the onset concentration of asphaltene deposition. Increasing temperature could accelerate the competition rate of participating solvents with carbonyl oxides and decomposition of ozonides to generate more small molecular products and lower the viscosity of asphaltene solution. Adding acetic acid and methanol has prevented precipitation of intermediates during ozonation and relieved the deposition problem (Table 3.1). The onset concentration of asphaltene was a little difficult to determine because the flow rate of gas was not stable near the deposition point. It was found that at the beginning of ozonation, deposition was more serious if the asphaltene concentration was higher than the onset concentration. At the later stage of reaction after all asphaltene molecules were converted to ozonation products, no deposition was observed on the gas diffuser. Even the reaction volume was reduced by evaporation and solid concentration was high. If ozonation was conducted under higher pressure, such as 60-80 psi, the deposition problem was not so serious and the onset concentration was much higher. For example, when the asphaltene was ozonated at 80 psi with 1.6 L/min gas flow rate (normal pressure flow rate), the onset concentration was higher than 200 g/L solvent. Under this pressure, the actual volume of gas passing through the reactor was reduced to 0.25 L/min and the evaporation of DCM was largely reduced for its higher boiling point. The beginning concentration and design of the reactor and procedure should take the precipitation problem and deposition problem into account. Serious deposition will totally cease reaction. Polar solvent with active hydrogen (proton donor) is more suitable to be cosolvent for ozonation, but the cosolvent itself should not compete for ozone consumption.

To evaluate the ozonation effects, the average molecular weight (Mn) of the ozonated asphaltene with different ozonation time was measured by the vapor pressure osmometry (VPO) method using pyridine as the solvent. The kinematic viscosity of the ozonated asphaltene was also measured by ASTM Standard D445 using a calibrated VWR cross arm viscometer at room temperature. Only asphaltene ozonated in DCM/acetic acid system was measured because when ozonation of the asphaltene was conducted in nonparticipating solvent, the intermolecular ozonides or polymeric ozonides made the ozonation intermediates not totally soluble in other solvents. Compared to the asphaltene molecular weight, Mn, the molecular weight of the ozonation intermediates was decreasing during ozonation. In Table 3.2, Mn of sample 2 is lower than Mn of the asphaltene before ozonation. Continued ozonation of sample 2 gets ozonation products with much lower Mn. Sample 4 and sample 5 are the ozonation products of acetone extracted from sample 2. Although the solid concentrations are very different (Solid loading of 4 was 7 times higher than of sample 5.), the Mn of these two samples are almost same. This result indicates that the reactions 4 and 5 have the same degree.

TABLE 3.2

Mn of asphaltene and ozonation products.

| Number | Sample | Mn |
|---|---|---|
| 1 | Asphaltene before ozonation | 861 |
| 2 | Asphaltene concentration: 130 g/solution, Volume: 240 ml solution (200 ml DCM + 40 ml AC), Ozonation time: 3 h. | 607 |
| 3 | Acetone insoluble part of 2 | 452 |
| 4 | Acetone insoluble part of 2: 130 g/solution, Volume: 240 ml solution (200 ml DCM + 40 ml AC), Ozonation time: 2.5 h. | 291 |
| 5 | Acetone insoluble part of 2: 18 g/solution, Volume: 200 ml solution (170 ml DCM + 30 ml AC), Ozonation time: 3 h. | 280 |

Figure 5:
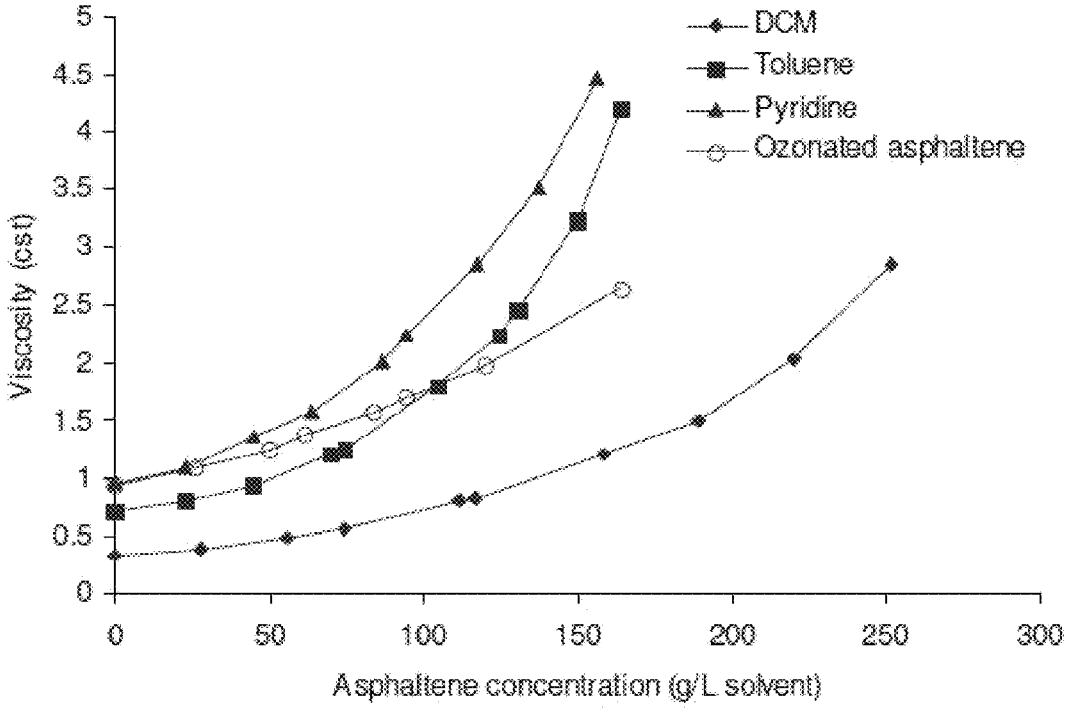
FIG. 5 is a plot of viscosity vs. asphaltene concentration for various solvents in accordance with an embodiment of the present invention.

The viscosity of ozonated asphaltene solution was also lower than asphaltene solution. The viscosities of the asphaltene in toluene, pyridine, and DCM at different concentrations are shown in FIG. 5. The viscosity of the asphaltene in pyridine is much lower than in toluene and DCM. It was found that the ozonated asphaltene in DCM/HAC was totally dissolved in pyridine but partially soluble in DCM and toluene. Measurement of viscosity changes before and after ozonation was only feasible in pyridine. The changes in viscosity of the asphaltene in pyridine before and after ozonation are shown in FIG. 5—viscosity is decreasing during ozonation. The viscosity of the asphaltene in solvent and VPO measurement are affected by the aggregation property of asphaltene molecules. It is known that the hydrogen bond is responsible for asphaltene aggregation and increasing density of the hydrogen bond in asphaltene molecule increases aggregation. If ozonation is only added into asphaltene molecules but has not broken the asphaltene molecules, the aggregation ability of molecules will increase and the VPO, Mn, and viscosity will increase. Nevertheless, VPO measurements and FIG. 5 suggest that a breakdown of the asphaltene molecules occurs.

In order to separate and analyze the ozonation products (asphaltene in DCM/AC or in DCM/MeOH), the ozonation products were added into different solvents after the ozonation products were dried under vacuum at 60° C. for 24 hours. It was found that pyridine, THF, and DCM/HAC mixture were good solvents for the ozonated asphaltene products (all ozonation products in DCM/HAC or DCM/MeOH under different conditions). GC/MS analysis showed the ozonation products contained a lot of aliphatic acids. Although toluene and benzene were good solvents for the asphaltene, they were not good solvents for the ozonation products because the products contain abundant aliphatic acids or esters after the ozonation products were esterified by methanol. Other solvents, such as acetone, water, DCM, hexane, $CS_2$, methanol, 2-propanol, and acetic acid, partially dissolved the ozonation products. Practically, acetone or methanol was more suitable to extract the ozonation products for their low cost and appropriate dissolving capacity. Although the ozonation products were largely insoluble in water, alkaline solution (e.g., NaOH solution) could, however, dramatically increase their solubility in the aqueous phase. The ozonation products (e.g., carboxylic groups of the organic acids) could dissociate the protons readily in alkaline water to exist as organic anions.

Figure 6:
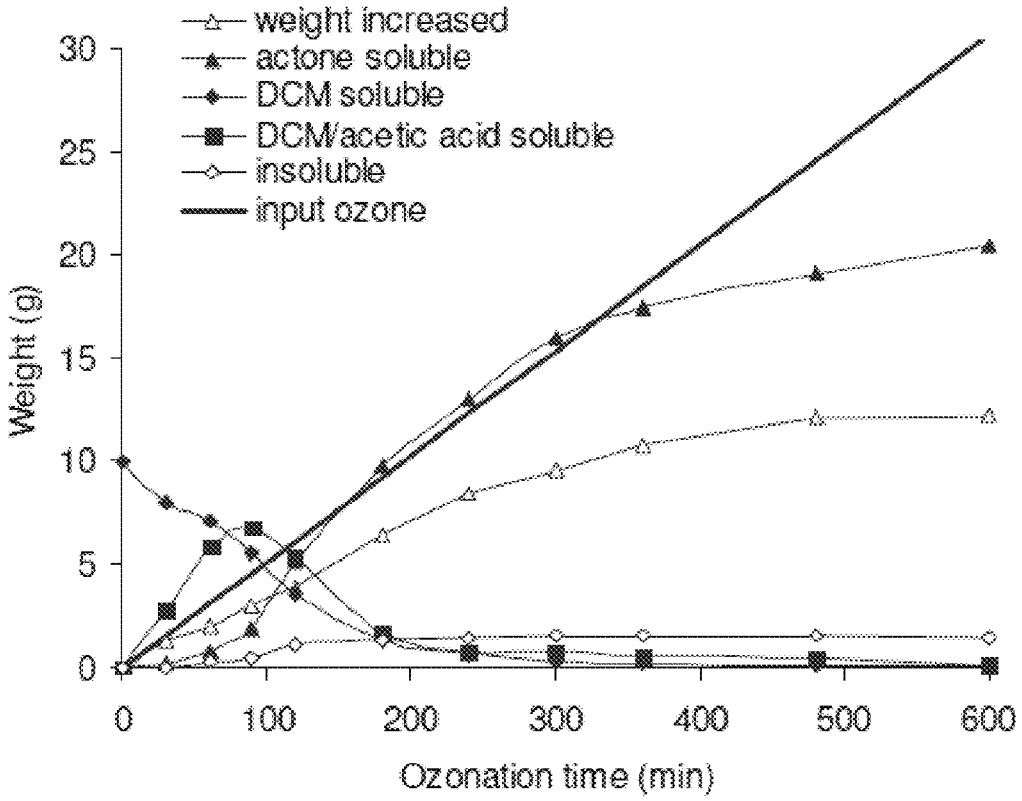
FIG. 6 is a plot of weight of various fractions of a reaction system vs. time of ozonation in accordance with an embodiment of the present invention.

They could also form salts with the sodium ion. When the ozonated asphaltene/DCM mixture was mixed with water, the organic solution would totally be emulsified in water. This indicates the ozonation products are surfactant-like compounds. The ozonation products have different solubility depending on the molecular weight and polarity of the products. The separation procedure of ozonation products is shown in the flowchart (FIG. 3, asphaltene ozonated in DCM/acetic acid or in DCM/MeOH). The ozonation products of the asphaltene were classified into three categories by exploiting their solubility in acetone, DCM, and DCM/acetic acid. Acetone was first used to extract the ozonation products. Then, the solid was dried and DCM was used for further extraction of the solid. Finally, DCM/acetic acid mixture (100 ml/20 ml) was used to dissolve the remaining insoluble part. A small fraction of the ozonation products was not soluble in these three solvents. The ozonation samples taken during reaction were also separated using this method. The weights of these four parts change with ozonation time (FIG. 6). The figure shows that the total weight of the asphaltene increases with ozonation time under typical experiment conditions. The increase is almost linear and proportional to the cumulative amount of ozone that has passed through the solution in 6 hours. After 6 hours, the increasing rate is gradually slowed. The DCM soluble fraction decreases while the acetone soluble fraction increases. Finally, more than 90% of the ozonation products can be extracted by acetone. The DCM/acetic acid soluble fraction first increases with time. Then, the DCM/acetic acid soluble fraction disappears. The DCM soluble part could be regarded as the unreacted asphaltene or the asphaltene-like intermediates and the DCM/acetic acid soluble part could be much closer to the ozonation intermediates with more oxygen atoms added into the structures. The final insoluble part could be the inactive part of the asphaltene or the residue cores of the asphaltene molecules. Compared to the results of RIOC reaction, the structure of the final insoluble part could also contain naphthenic structure and aromatic structure. The probability of naphthenic structure to be broken into small pieces by ozone via free radical mechanism is low. For large aromatic cores, the center of the aromatic core is almost inert to ozone because of the shortage of hydrogen. Changing asphaltene loading (between 5 g and 50 g), ozonation pressure (between 0 psi to 100 psi), reaction temperature (between 0° C. to 80° C.), and different solvents did not change the reaction pattern; reaction degree was mainly determined by total amount of ozone. The control experiments only by bubbling air through various asphaltene solutions did not obtain significant acetone soluble products. Also, the weights of the asphaltene samples were not increased. This result showed that direct reaction of methanol or acetic acid with the asphaltene was negligible without ozone. Ozone was responsible for generation of the acetone extractable products and weight increased after reaction.

Given VPO measurement of asphaltene's Mn, the mole ratio of ozone to the asphaltene was most important in determining the outcome. The reaction rate was mainly controlled by the rate of ozone delivery into the reaction system. When the mole ratio of ozone (absorbed into solution) to asphaltene was less than 2, almost all ozonation products were insoluble in acetone. When the ratio was larger than 2 (e.g., >5), significant acetone soluble products were formed. The mole ratio of ozone to asphaltene was subject to reaction time. If oxygen was used to generate ozone, the time to gain the same weight was much shorter than using air. For 10 g of asphaltene, 2.5 hours of ozonation obtained 20 g of products. Temperature had no significant effects in the narrow range studied (the highest reaction temperature was limited by the boiling point of DCM) because the reaction degree was mainly determined by the amount of ozone added into reactor. This conclusion was confirmed by other ozonation results with various asphaltene loadings, asphaltene concentrations, ozone concentrations, and ozone amounts. Under normal pressure, the ozonation temperature was below 4° C. if the reactor was not heated. It was caused by fast evaporating of DCM. Using oxygen had higher temperature than using air. It was observed that the temperature of the reaction system was increased to 7.7° C. during reaction for pure oxygen vs. 4.0° C. for air when 12 g of asphaltene was ozonated in 200 ml of solvent (190 ml DCM+10 ml MeOH). However, the temperature of this asphaltene solution was 3° C. when pure oxygen or air was purging through it. If the reaction pressure was high, up to 80 psi, the temperature was automatically increased above 40° C., because at this pressure, the evaporation of solvent was greatly suppressed. This observation indicates that the ozonation of the asphaltene is an exothermic reaction and higher ozone concentration (more ozone for the same flow rate) increased the reaction rate and oxidation generated heat. Separation of the ozonation products and GC/MS analysis showed there was no difference between using air and oxygen except for the accelerated reaction rate. It was found that the temperature of bath water greatly affected the ozonation effects if the reaction temperature was controlled by submerging the three-neck-flask in a water bath. If the temperature of water was higher than the boiling point of DCM (40° C.) under normal pressure, the ozonation effects deteriorated dramatically. This was caused by the rapid evaporation of DCM. Boiling of DCM was trigged by the air bubbles from the gas diffuser and further prevented ozone diffusing into the liquid phase, so lower temperature was preferred for ozonation under any pressure. The reaction should be conducted at the temperature with low evaporation rate of solvents. Increased pressure allowed the reaction temperature to vary in a wider range without deteriorating the reaction.

Distillation was employed to separate the ozonation products more effectively and purposively. Before ozonation, the ozonation products were esterified with methanol to make the products more volatile. The methanol-esterified products were a mixture of esters and other organic compounds. This mixture was a high viscous liquid at room temperature. The separation procedure is described in the flowchart (FIG. 3). After distillation, the nondistillable part was extracted by acetone and the remaining part was pyrolyzed. Weights of the distillable parts and pyrolysates were calculated from the weights of solid before and after distillation and pyrolysis, respectively, because the evaporated parts were not totally recovered in this experiment. Since before esterification, the ozonation products were dried and some evaporative parts were lost, the actual weight of the distillable part should be larger than the values listed in Table 3.3.

TABLE 3.3

Distillation, separation, and ignition of the ozonation products. 20 g asphaltene was ozonated for 10 h under 15 psi, the flow rate was 1.6 L/min, and temperature was 20° C.

| | Weight (g) | | | | | |
|---|---|---|---|---|---|---|
| Solvent | Ozonation products | After esterification | Distillable fraction | Acetone soluble | Pyrolysates | Remaining |
| DCM | 40.1 | 50.9 | 19.3 | 20.1 | 5.9 | 4.1 |
| DCM/HAC | 42.6 | 52.6 | 21.2 | 20.6 | 5.5 | 3.4 |
| DCM/MeOH | 42.3 | 51.7 | 20.3 | 20.8 | 6.0 | 3.2 |

Table 3.3 shows that the weight of the ozonated asphaltene is increased after this esterification, even for asphaltene ozonated in MeOH (in some reactions, asphaltene has not been cleaned, and the weight of the insoluble part is not counted in). This means methanol has not totally esterified the acids generated during ozonation. This is because ozonation of the asphaltene involves free radical reactions and direct ozonation. Although direct electrophilic ozonation of double bonds in MeOH generates esters, reaction of methanol with the oxidized aldehydes generated from hydroperoxides decomposition and reaction of methanol with acids generated from other reaction such as from free radical reactions still can form esters. Higher reaction temperature could generate more esters for this reaction system under higher pressure. Ozonation of the asphaltene can obtain the same amount of distillable products and the same amount of acetone extractable products (Table 3.3). Ignition of the remaining part removed the carbon remaining inside. For the cleaned asphaltene, the final ash was less than 0.5 g. This inorganic solid could be metals in the asphaltene or fine clays have not been removed by the mechanical separation method. For some experiments, with the raw asphaltene samples directly ozonated, the final inorganic material could contain the clay and metals from asphaltene molecules.

The compounds in the acetone-soluble fraction and the distillable part of the ozonation products were identified by GC/MS method. In some analyses, ethyl acetate was used instead of acetone to extract the ozonation products. Most ozonation products obtained in asphaltene ozonation were almost the same as the products obtained from RIOC reaction. The chemical structures of ozonation products obtained under different ozonation conditions (e.g., reaction time) can shed light on the reaction pathway and lead to more effective treatment conditions. In order to detect heavier acids by GC/MS analysis, ozonation products of some samples were esterified by methanol although the ozonation products were not totally esters in GC/MS analysis. GC/MS analyses showed that the esterified ozonation products of the asphaltene in DCM/MeOH were almost the same as the esterified ozonation products of the asphaltene in DCM/acetic acid. The ozonation products of the asphaltene samples obtained after the Soxhlet cleanup procedure and mechanical separation procedure were identical. Moreover, the products with cleanup and without cleanup were identical too. After esterification, in acetone-soluble compounds, methyl esters or dimethyl esters were most abundant in GC/MS chromatogram. The reaction rate and ozonation products were almost the same (weight increasing rate). This could be determined by the reaction mechanism of ozone reaction with aromatic compounds. The difference between asphaltene samples with and without pretreatment at higher temperature or with chemicals (such as $H_2O_2$) could be more significant if the metal constituents, such as vanadium, nickel, iron, and titanium (Alberta asphaltene contains high concentration of Ti), can catalyze free radical reaction to a considerable rate. The typical esterified ozonation products of the asphaltene in DCM/MeOH are shown in FIG. 7 and Table 3.4. Other important products, such as 2-pentanone, 4-hydroxy-4-methyl-; ethanedioic acid, dimethyl ester; and phthalic anhydride; were identified by GC/MS in the acetone solution. Also, some products contained carbonyl group, hydroxyl, and other heteroatomic structures. The ozonation products contained some N and a small amount of S. Almost all N-containing compounds had short retention time in the GC/MS chromatograms. The structures of some N-containing products suggested oxidation of metalloporphyrin, but some N could have been introduced into the reaction system by the ozone/air mixture because the ozone generator produced $NO_x$. The evidence was that the identified ozonation products using oxygen as gas had fewer N-containing compounds. Most sulfur detected by GC/MS was in the form of dimethyl sulfuric ester in the final ozonation products. The carbon numbers of monocarboxylic acids detected was in the range of 2 to 25. Most monocarboxylic acids were n-alkanoic acids. Products with a carbon number more than 30 were not detected in this study.

TABLE 3.4

Figure 7A:
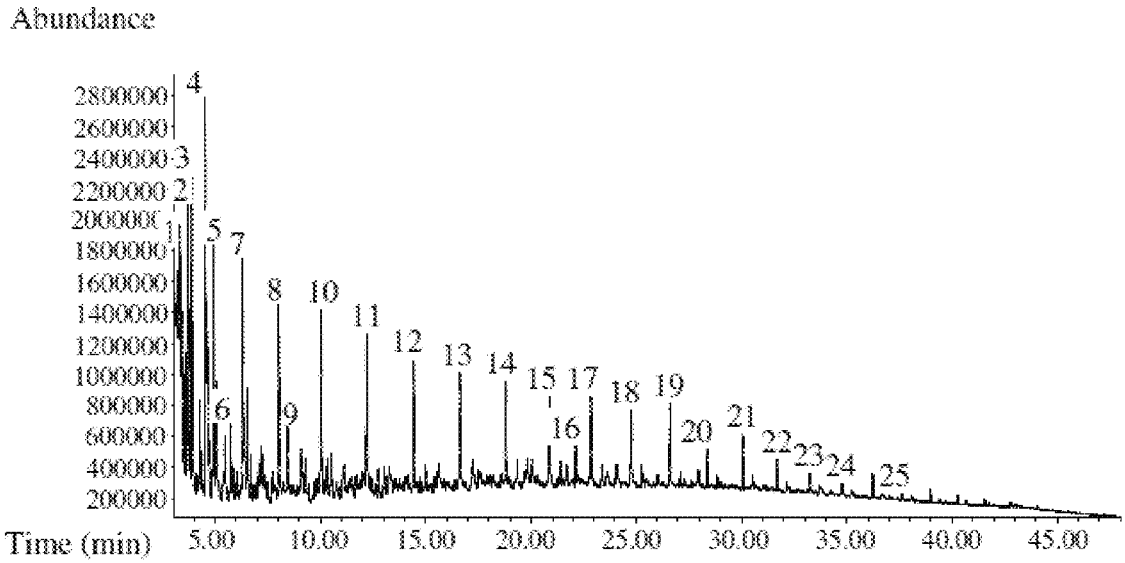
FIG. 7A is a GC/MS chromatograms of esterified ozonation products extracted by acetone in accordance with an embodiment of the present invention.
Figure 7B:
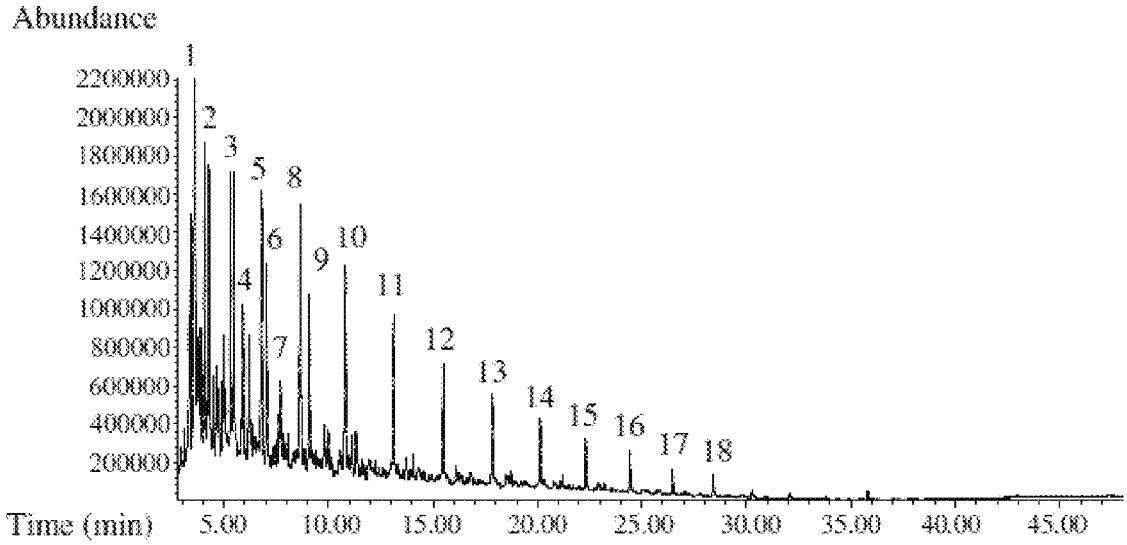
FIG. 7B is a GC/MS chromatograms of the distillate in accordance with an embodiment of the present invention.
Figure 7C:
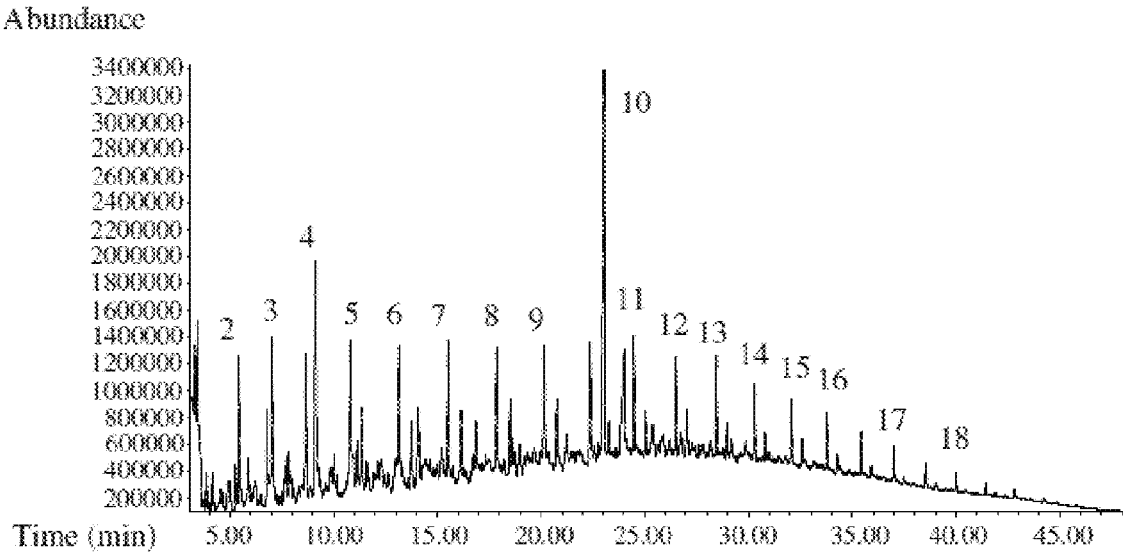
FIG. 7C is a GC/MS chromatograms of nondistillable products extracted by acetone in accordance with an embodiment of the present invention.

| No. | FIG. 7A | FIG. 7B | FIG. 7C |
|---|---|---|---|
| 1 | Pentanoic acid, methyl ester | Ethanedioic acid, dimethyl ester | |
| 2 | Acetic acid, dimethoxy-, methyl ester | Acetic acid, dimethoxy-, methyl ester | Butanedioic acid, dimethyl ester |
| 3 | Hexanoic acid, methyl ester | Heptanoic acid, methyl ester | Pentanedioic acid, dimethyl ester |
| 4 | Butanoic acid, 3-hydroxy-, methyl ester | Butanedioic acid, methyl-, dimethyl ester | Hexanedioic acid, dimethyl ester |
| 5 | Propanedioic acid, dimethyl ester | Octanoic acid, methyl ester | Decanoic acid, methyl ester |
| 6 | Heptanoic acid, methyl ester | Pentanedioic acid, dimethyl ester | Undecanoic acid, methyl ester |
| 7 | Butanedioic acid, dimethyl ester | Nonanoic acid, methyl ester | Dimethyl phthalate |
| 8 | Octanoic acid, methyl ester | Hexanedioic acid, dimethyl ester | Undecanoic acid, 10-methyl-, methyl ester |
| 9 | Pentanedioic acid, dimethyl ester | Octanoic acid, 4,6-dimethyl-, methyl ester, (4S,6S)-(+)- | Tridecanoic acid, methyl ester |
| 10 | Nonanoic acid, methyl ester | Decanoic acid, methyl ester | Dodecanedioic acid, dimethyl ester |
| 11 | Decanoic acid, methyl ester | Undecanoic acid, methyl ester | 2-Oxecanone, 10-methyl-, (.+/−.)- |
| 12 | Undecanoic acid, methyl ester | Dodecanoic acid, methyl ester | Heptadecanoic acid, methyl ester |
| 13 | Dodecanoic acid, methyl ester | Tridecanoic acid, methyl ester | Octadecanoic acid, methyl ester |
| 14 | Tridecanoic acid, methyl ester | Methyl tetradecanoate | Nonadecanoic acid, methyl ester |
| 15 | Tridecanoic acid, 12-methyl-, methyl ester | Pentadecanoic acid, methyl ester | Eicosanoic acid, methyl ester |

TABLE 3.4-continued

| No. | FIG. 7A | FIG. 7B | FIG. 7C |
|---|---|---|---|
| 16 | Pentadecanoic acid, methyl ester | Hexadecanoic acid, methyl ester | Heneicosanoic acid, methyl ester |
| 17 | Hexadecanoic acid, methyl ester | Heptadecanoic acid, methyl ester | Tricosanoic acid, methyl ester |
| 18 | Heptadecanoic acid, methyl ester | Octadecanoic acid, methyl ester | Pentacosanoic acid, methyl ester |
| 19 | Octadecanoic acid, methyl ester | | |
| 20 | Nonadecanoic acid, methyl ester | | |
| 21 | Eicosanoic acid, methyl ester | | |
| 22 | Docosanoic acid, methyl ester | | |
| 23 | Tricosanoic acid, methyl ester | | |
| 24 | Tetracosanoic acid, methyl ester | | |
| 25 | Pentacosanoic acid, methyl ester | | |

This could be due to free radical degradation of the long chains or low sensitivity of the GC/MS (GC detected some small peaks but MS could not identified them). The esters between C25 and C40 were detected by Strausz in Canadian asphaltene. Some more volatile acids and other ozonation products were not detected because of the influence of acetone and evaporation of these products during desiccation. Therefore, the distribution of the ozonation products shown by gas chromatogram was not the exact distribution. A lot of bicarboxylic acids were detected by the GC/MS method. The existence of bicarboxylic acids indicated the aliphatic bridges inside asphaltene molecules. This indicated that some ozonation products with aromatic structures were originated from the small aromatic cores. The products indicated that asphaltenes should have two different structures, as discussed before. If the ozonation products were extracted by ethyl acetate, because the solubility of aliphatic acids and other compounds in acetone and ethyl acetate were a little different, relatively more shorter-chain aliphatic esters ($C_5$-$C_{12}$) were detected in the ethyl acetate extractable products. The distillate of esterified ozonation products contains more light compounds (FIG. 7 and Table 3.4). Esters shorter than $C_{12}$ are almost nondistillable in this study. The GC/MS analysis of the acetone-extracted compounds in the nondistillable part still identified a lot of esters (FIG. 7 and Table 3.4) from $C_2$ to $C_{25}$, but all esters were almost evenly distributed. Higher temperature and vacuum can distill more products.

Pyrolysis of the remaining insoluble fraction obtained various products. Some of the most abundant products in pyrolysate are shown in Table 3.5. These products mainly have benzene or naphthalene structures with short substituents. This detection confirmed the assumption for the structures of the insoluble fraction. Some paraffins and organic sulfur compounds (e.g. substituted thiophenes and the like) were also detected.

TABLE 3.5

Some pyrolysis products in pyrolysate.

| RT (min) | Name |
|---|---|
| 3.6565 | Benzene, 1,3-dimethyl- |
| 3.8908 | p-Xylene |
| 4.6224 | Benzene, 1-ethyl-3-methyl- |
| 4.811 | Dimethyl trisulfide |
| 4.8567 | Benzene, 1,2,3-trimethyl- |
| 6.3141 | 1,4-Cyclohexadiene, 3-ethenyl-1,2-dimethyl- |
| 7.5201 | 2-Propen-1-ol, 3-phenyl- |

TABLE 3.5-continued

Some pyrolysis products in pyrolysate.

| RT (min) | Name |
|---|---|
| 8.2459 | Benzene, 1-methyl-3-(methylthio)- |
| 8.9375 | Tetrasulfide, dimethyl |
| 10.1663 | 2-Tetradecene, (E)- |
| 10.3606 | Tridecane |
| 10.572 | Naphthalene, 2-methyl- |
| 10.9264 | Decanoic acid, methyl ester |
| 12.4409 | Biphenyl |
| 13.0868 | Benzo[b]thiophene, 3,6-dimethyl- |
| 13.4411 | Naphthalene, 2,7-dimethyl- |
| 15.0185 | Pentadecane |
| 15.6758 | Dodecanoic acid, methyl ester |
| 17.3904 | Hexadecane |
| 23.22 | 1,12-Dodecanedioyl dihydrazide |
| 24.4202 | Benzene, 1-fluoro-3-(2-phenylethenyl)-, (E)- |
| 26.0776 | Eicosane |
| 26.6263 | Hexadecanoic acid, 14-methyl-, methyl ester |
| 27.9923 | Heneicosane |
| 29.8498 | Docosane |

This detection indicated that the oxidation of some organic sulfur in the insoluble fraction could be blocked by the substituents. The final ozonation products of coal asphaltene have aromatic structures and alicyclic structures substituted with phenolic, quinoid, carboxy, and ester groups, and oxygen-containing heterocycles, and six-membered lactones. It has been proposed that the aromatic structure is formed by the secondary formation of the aromatic ring by oxidative dehydrogenation of naphthenes. This assumption could be problematic. If the core size of coal asphaltene is smaller than that of petroleum asphaltene and is a fused ring containing aromatic rings and naphthene rings, the final ozonation products detectable by the MS method will include multisubstituted alicyclic structures because of its relatively smaller size. This result indicated that the insoluble part of the ozonated asphaltene could also have substituted larger alicyclic structure, although it was not detectable by GC/MS.

Analyses of the Ozonation Intermediates

Figure 8:
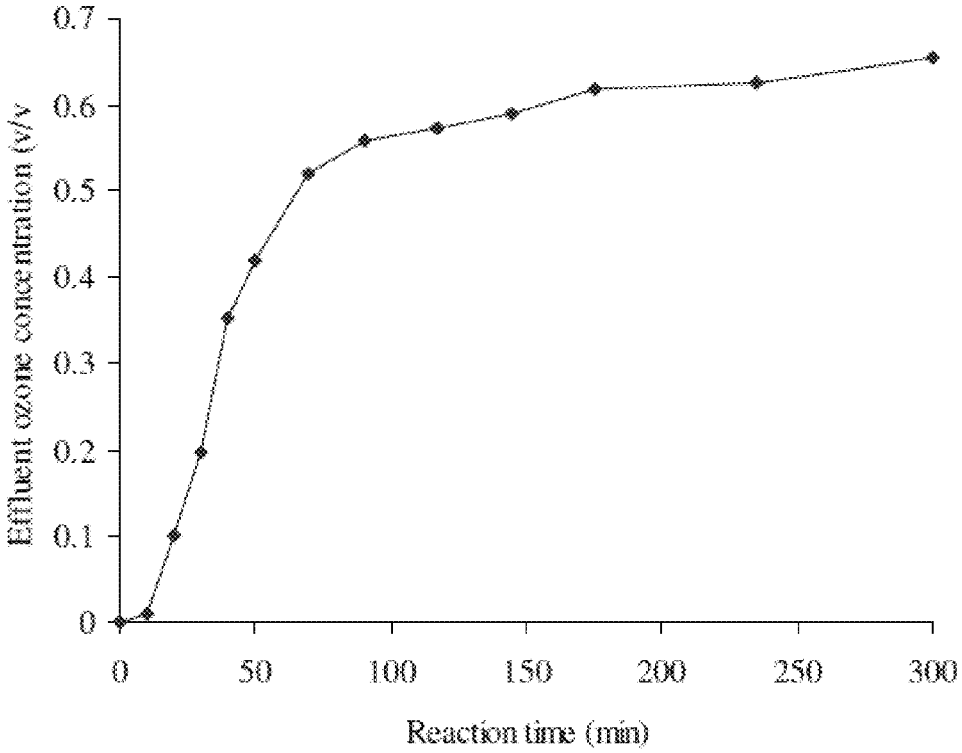
FIG. 8 is a plot of effluent ozone concentration vs. reaction time for ozonated asphaltene in accordance with an embodiment of the present invention.
Figure 9:
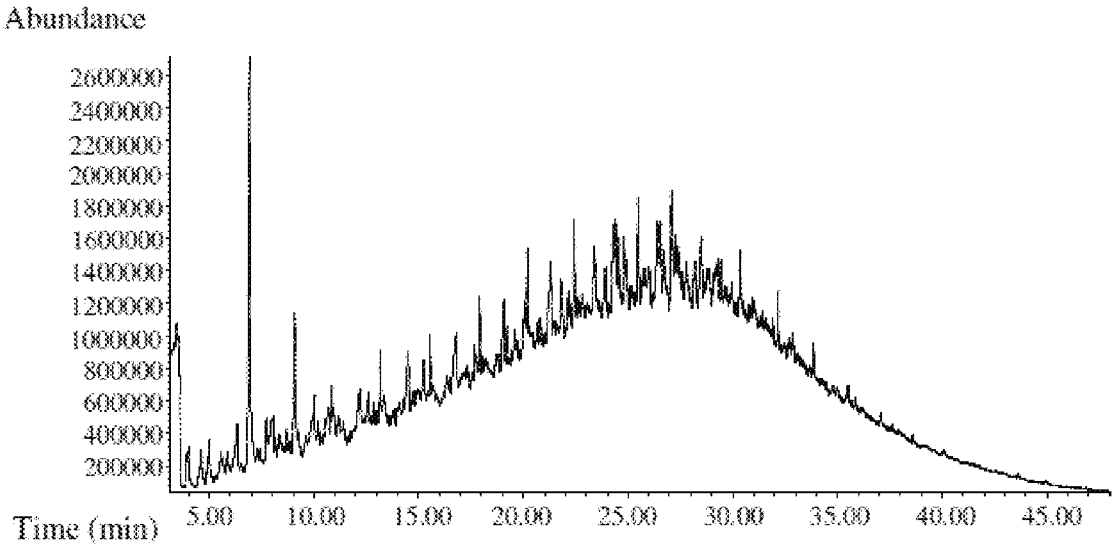
FIG. 9 is a total ion current mass chromatogram of ozonation products after 0.5 hours in accordance with an embodiment of the present invention.
Figure 10:
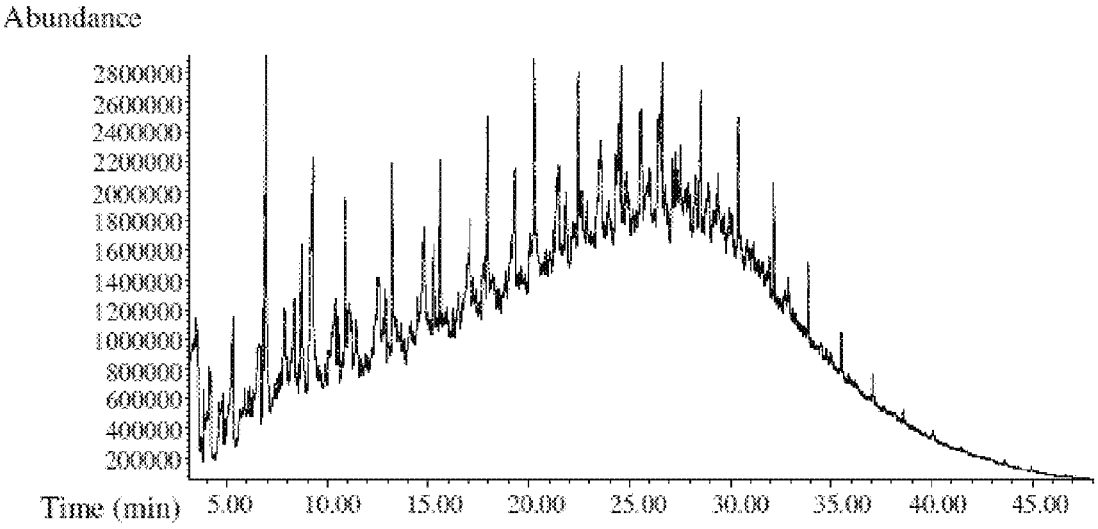
FIG. 10 is a total ion current mass chromatogram of ozonation products after 1 hour in accordance with an embodiment of the present invention.
Figure 11:
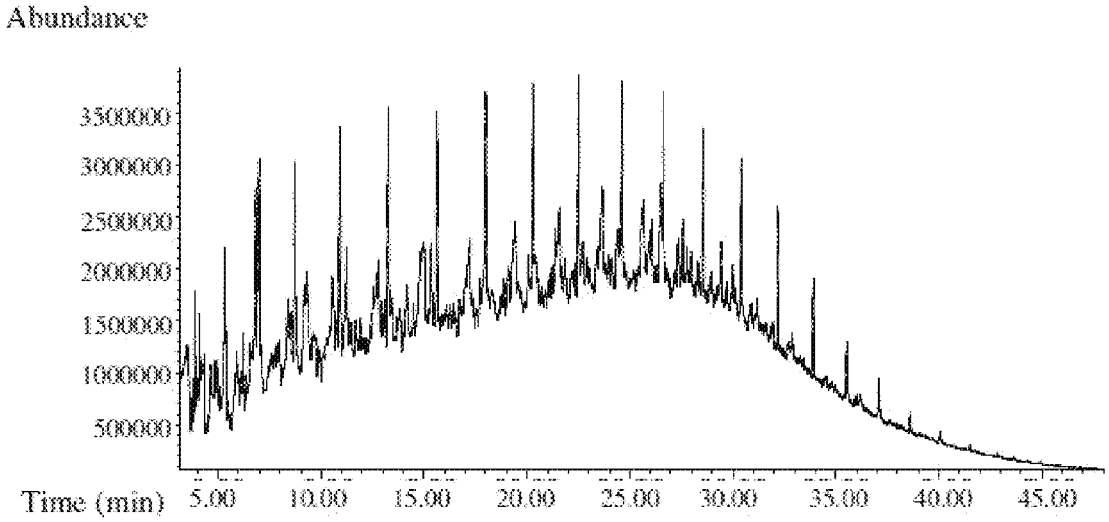
FIG. 11 is a total ion current mass chromatogram of ozonation products after 1.5 hours in accordance with an embodiment of the present invention.
Figure 12:
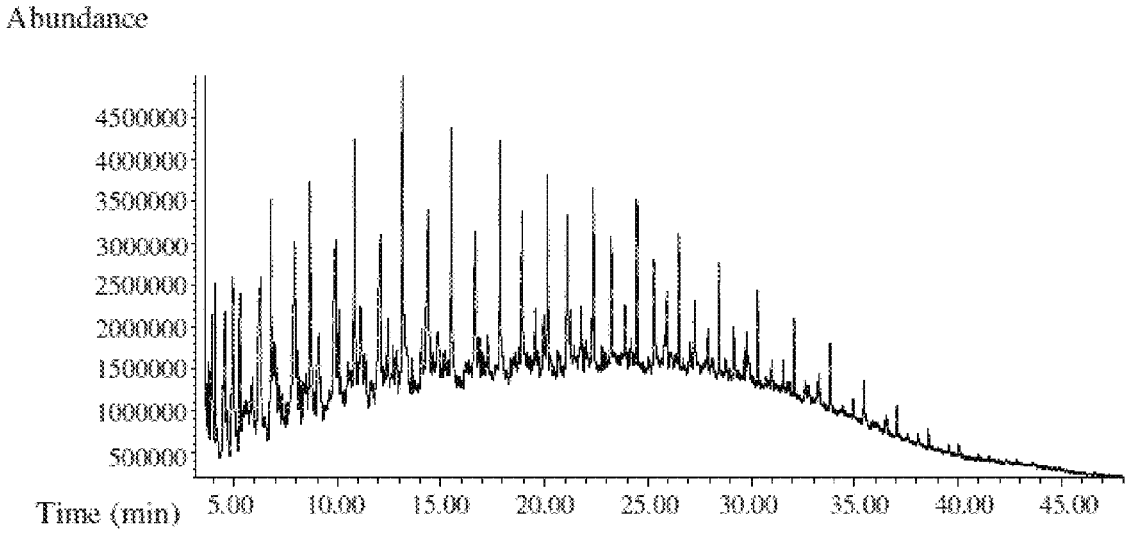
FIG. 12 is a total ion current mass chromatogram of ozonation products after 2 hours in accordance with an embodiment of the present invention.
Figure 13:
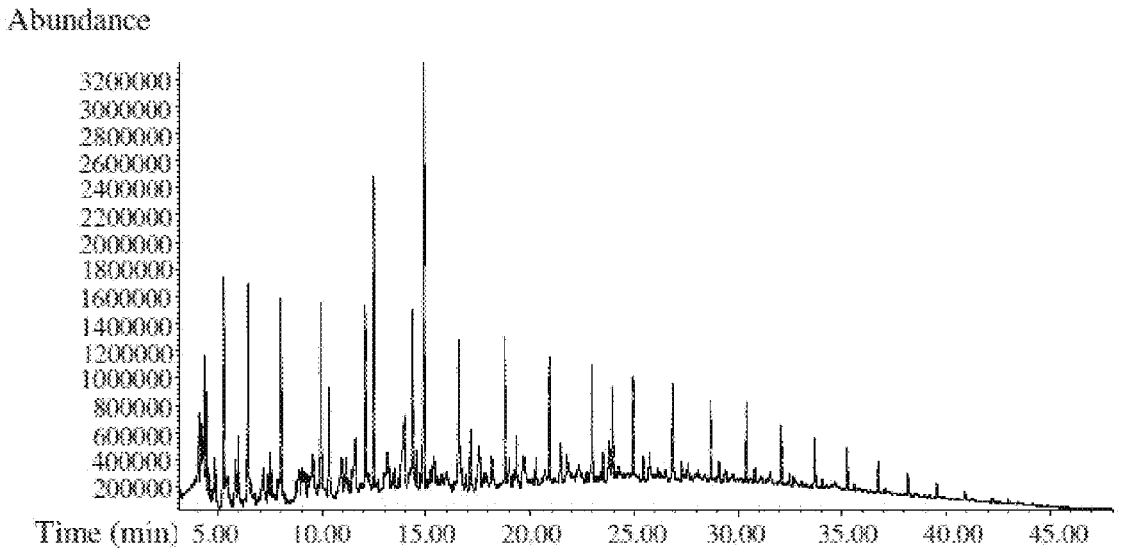
FIG. 13 is a total ion current mass chromatogram of ozonation products after 3 hours in accordance with an embodiment of the present invention.
Figure 14:
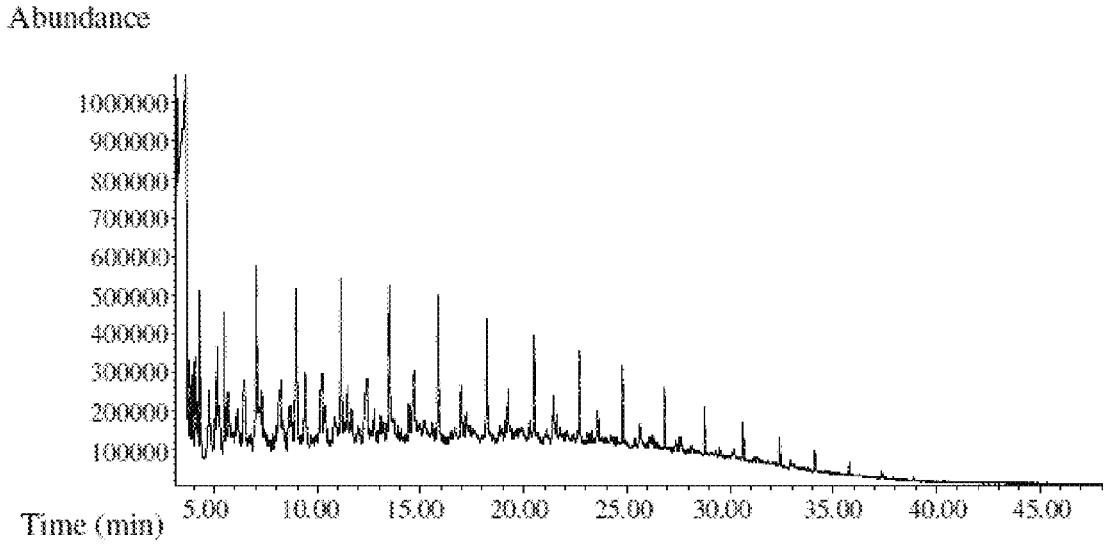
FIG. 14 is a total ion current mass chromatogram of ozonation products after 4 hours in accordance with an embodiment of the present invention.
Figure 15:
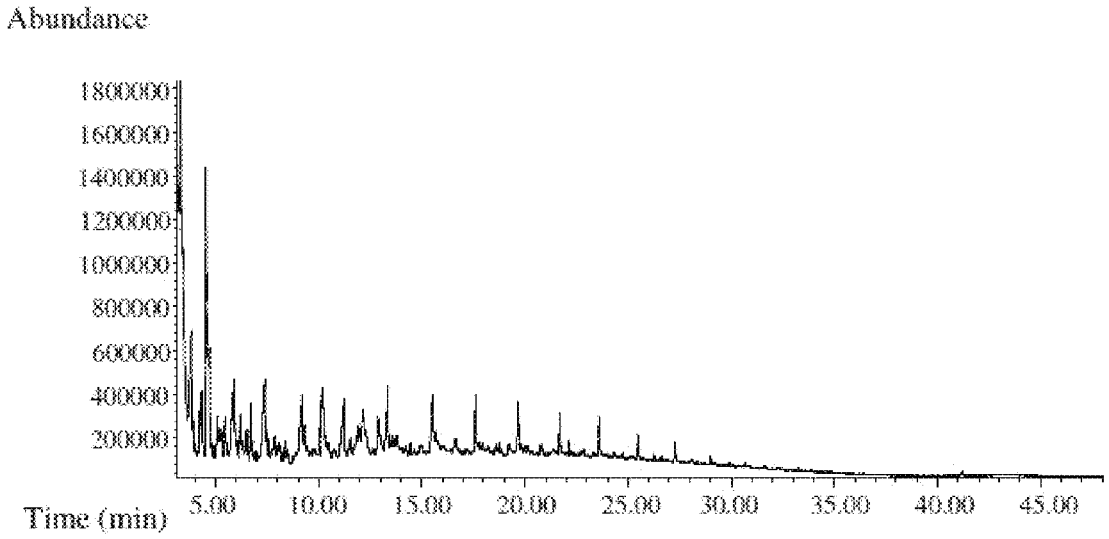
FIG. 15 is a total ion current mass chromatogram of ozonation products after 6 hours in accordance with an embodiment of the present invention.
Figure 16:
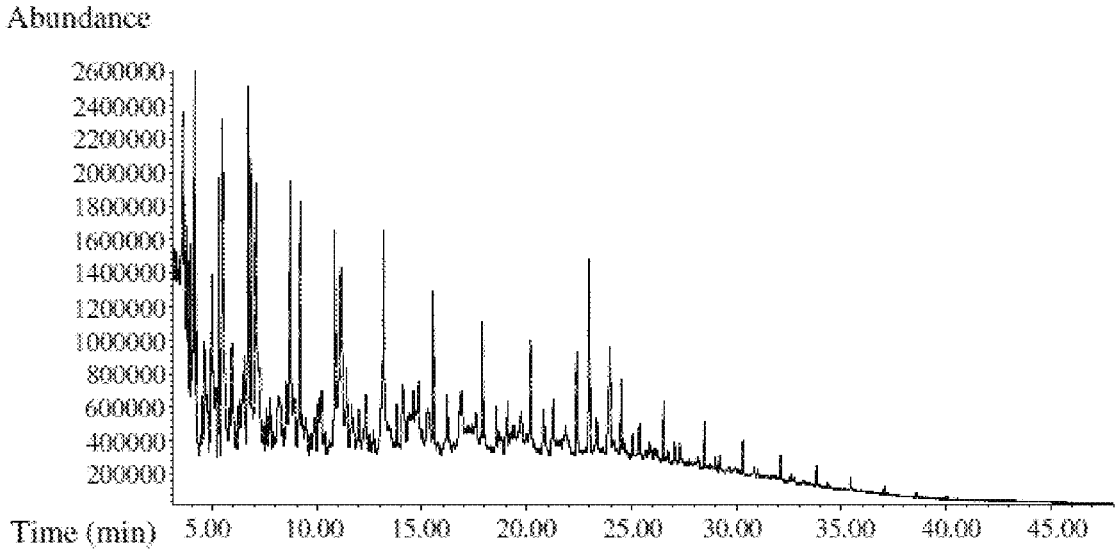
FIG. 16 is a total ion current mass chromatogram of ozonation products after 9 hours in accordance with an embodiment of the present invention.
Figure 17:
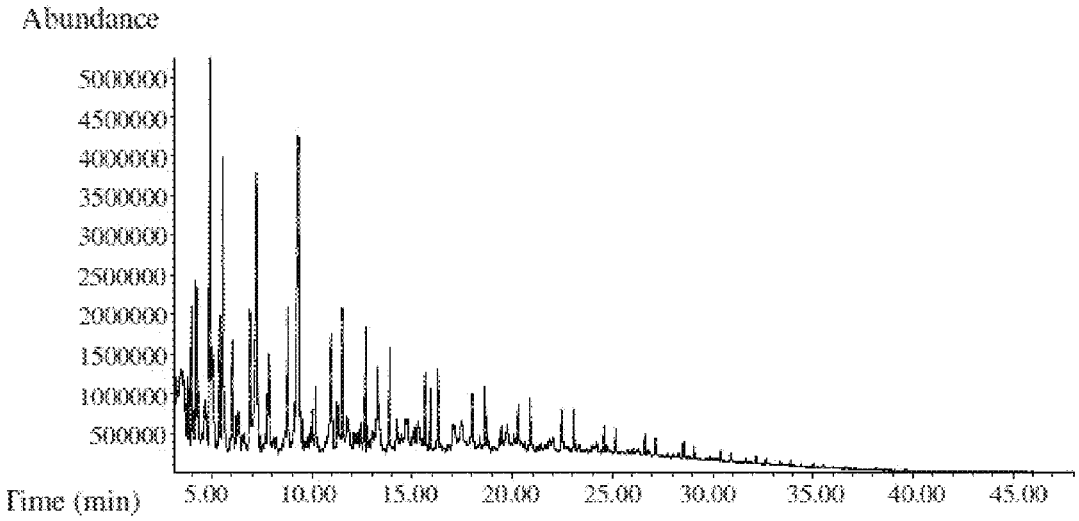
FIG. 17 is a total ion current mass chromatogram of ozonation products after 12 hours in accordance with an embodiment of the present invention.

It was found that at the beginning of the reaction, ozone concentration in the effluent air was very low (FIG. 8, almost no ozone was detected in the effluent). This means ozone concentration in the solution is also very low. This could be caused by the high active sites (aromatic rings) in asphaltene molecules. The reaction mechanism of ozone with aromatic compounds is assumed to be the same as the mechanism of ozonation of olefins. In fact, the reaction mechanism of ozone with olefin is still controversial. The most accepted mechanism is the Criegee mechanism. The reaction of ozonation normally obeys a bimolecular law (second order reaction). The reaction rates of ozone with aromatic structures are high and the reaction rate is controlled by the rate of ozone delivery. At the beginning of the reaction, almost all ozone is consumed by the asphaltene to form ozonides and no ozone is detected in the effluent. This inducing reaction time is proportional to asphaltene loadings. For example, the inducing time was about 40 min for 12 g asphaltene and 20 min for 6 g asphaltene for 1.6 L/min (normal pressure volume) flow rate of 1.6% by volume of ozone under 15 psi. The inducing time was also affected by the diffusion of ozone into solvent. At higher pressure, this time was much longer than at normal pressure because ozone passed through the solution by a shortcut due to big bubbles. Adding acetic acid and methanol also extended the time. Within this inducing time, almost no ozonation products were extracted (FIG. 6). This inducing time could be related with the aggregation of asphaltene molecules in solvent. Aromatic rings in the outside surface of the clusters formed by asphaltene molecules are more reactive to ozone than the aromatic ring inside the clusters. At the later stage of ozonation, free radical reaction could be more important than in the middle of the reaction. The oxidation of asphaltenes derived by oxygen at low temperature showed that the free radical reaction in asphaltenes was retarded. The reaction rate with respect to asphaltene concentration was somewhat greater than first order and the oxidation of hydrocarbon through free radical chain mechanism was inhibited. The free radical reaction inhibitor in asphaltenes was phenolic or aliphatic sulfides from oxidation of sulfoxides and the reaction rate was determined by the slow first-order metal-induced decomposition of hydroperoxides and the second-order reaction involving oxygen-vanadyl and nickel porphyrin complexes. This means that for the ozonation of asphaltenes at the initial stage of reaction, the reaction of carbonyl oxides with participating solvents or generation of secondary ozonides in nonparticipating solvent could be dominant and the free radical reaction rate is inhibited. At the later stage with the disappearing of free radical inhibitor and increasing of ozone concentration in solution, the free radical reaction could be more important for the whole reaction. Evolution of molecular weight distribution of acetone extractable products for 10 g of asphaltene in DCM/MeOH during the reaction is shown in FIG. 9 to FIG. 17.

Within the first 2 hours, more heavier ozonation products and intermediates were generated, among which some aromatic structures and unsaturated bonds were detected. After 2 hours of ozonation, more light products were generated and the distribution center slowly moved to the left side. The 6, 9, and 12 hours mass chromatograms indicated that the free radical reaction could break some aliphatic chains. The ozonation generated some aldehydes but GC/MS did not detect abundant aldehydes. The aldehyde generated during ozonation could be further oxidized to acids by ozone via free radical reaction.

Figure 18:
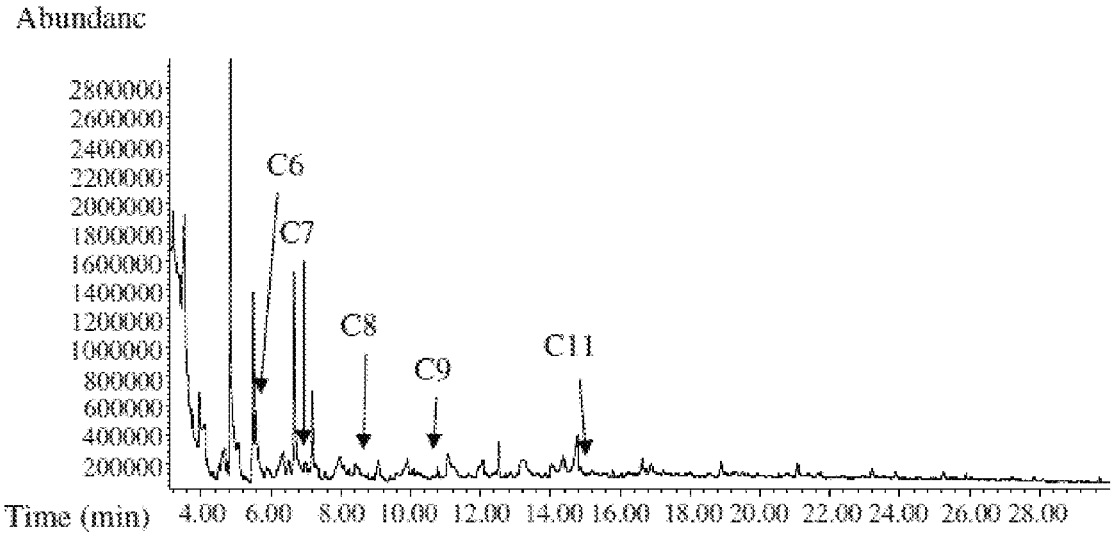
FIG. 18 is a total ion current mass chromatogram of ozonation products of asphaltene after 12 hours with a flow rate of 1.6 L/min and an ozone concentration of 1.6% by volume in accordance with an embodiment of the present invention.
Figure 19:
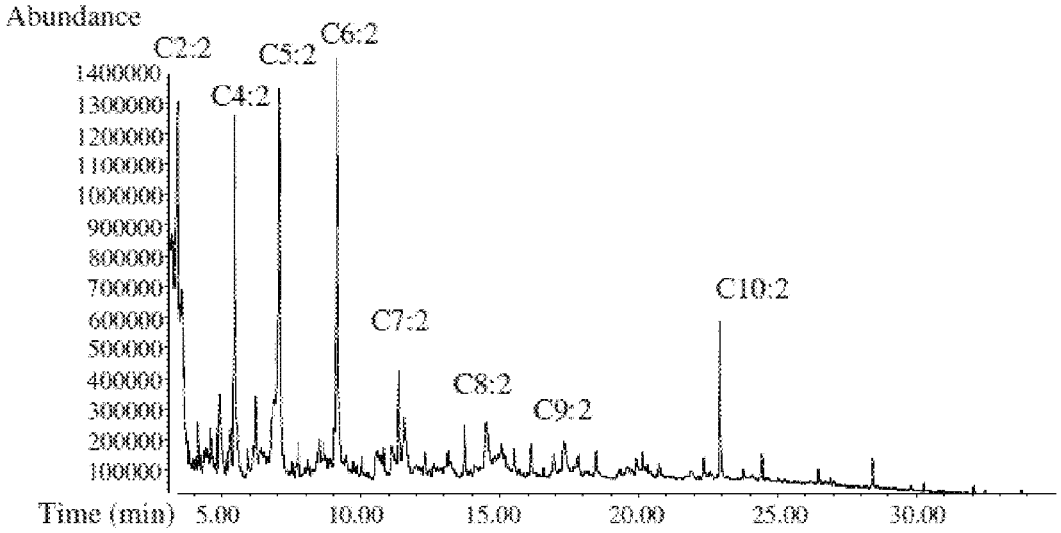
FIG. 19 is a total ion current mass chromatogram of ozonation products of asphaltene after 6 hours with a flow rate of 1.6 L/min and an ozone concentration of 1.6% by volume in accordance with an embodiment of the present invention.

If the asphaltene was only ozonated in DCM for a long time, all ozonation products were precipitated. GC/MS analysis showed that only very small amount of acids were detected after 12 g asphaltene in DCM for 10 hours (FIG. 18, acids were monomethyl esters). These acids could be generated from cleavage of S bond and other free radical reaction, acids already in asphaltene molecules, or caused by the moisture in the air during the drying procedure because for some samples, no acids were detected under the same ozonation conditions. After the ozonation products were soaked in methanol but without heating, some esters were detected (FIG. 19), among which most were dimethyl esters. All the acids indicted in FIG. 19 are dimethyl esters. These dimethyl esters were generated by the decomposition of secondary ozonides or polyozonides. The reason only dimethyl esters are generated is unclear. However, this step can be developed to produce dicarboxylic acids. Refluxing ozonation products with methanol generated the same products as reacted in DCM/MeOH, but the yield was low. Even after long-term ozonation, about 50% of the precipitated products were dissolved in acetone after being refluxed with methanol. The ozonation rate was mainly determined by the rate of ozonides generation and the reaction of the precipitated intermediates with ozone was low. Adding MeOH could decompose the ozonides, but only a very small amount of ozonation products were esters. Most ozonation products were still acids. This indicated that some ozonides were not directly decomposed by MeOH. Also, it was possible that the finial ozonation products could be polymeric peroxides. Most decomposition could be caused by the chain reaction triggered by MeOH. Therefore, zonation of the asphaltene in DCM and DCM/MeOH was a little different. Ozonation with MeOH generated more heat than ozonation in pure DCM. It was observed that if asphaltene was ozonated at higher pressure, which made the reaction system more sensitive to heat accumulation by reducing evaporation of DCM, higher temperature was recorded for the DCM/MeOH system, especially if the reaction was conducted under oxygen/ozone flow.

Comparing the acetone extractable products in DCM and in DCM/methanol and discussion of reaction mechanisms, it was found that the precipitated ozonation intermediates of the asphaltene in DCM are the secondary ozonides or polymeric peroxides. Since for aromatic compounds the carbonyl oxides are not likely to generate secondary ozonides with the adjacent carbonyls in nonparticipating solvents, the ozonides, mostly intermolecular ozonides and polymeric ozonides, can make the asphaltene cluster much tighter. This will cause ozonation intermediates precipitate out. Also, the stiffness and higher polarity after forming ozonides could be responsible for precipitation. In addition, the ozonation mechanism shows polyperoxides are generated in nonparticipating solvents. This part will also precipitate out during ozonation. Adding participating solvents can prevent precipitation since generation of secondary ozonides and peroxides has been avoided. When refluxing with methanol, both the ozonides and hydroperoxides are decomposed to generate acids and esters.

Reaction of the asphaltene in DCM/acetic acid also generates more acids than in DCM. This could have contributed to the catalytic function of acids. Although acetic acid participates into ozonation, such as generation of -acyloxyalkyl hydroperoxides with carbonyl oxides, decomposition of ozonides, and catalyze decomposition of hydroperoxides, most participating acetic acid still returns to acetic acid after reaction. GC/MS analysis did not identify any ozonation products having —OAC groups. In addition to the small amount of acids after the asphaltene ozonated in DCM/acetic acid, other ozonation products, including 3-penten-2-one, 4-methyl-; 4-hydroxy-4-methylpentan-2-one; furan, tetrahydro-2,5-dimethyl-, cis-; phthalic anhydride; 2(3H)-furanone, dihydro-5-methyl-; and 2,5-heptadien-4-one, 2,6-dimethyl- were identified. This result showed that the ozone continuously decomposed the big molecules into several smaller pieces.

Figure 20:
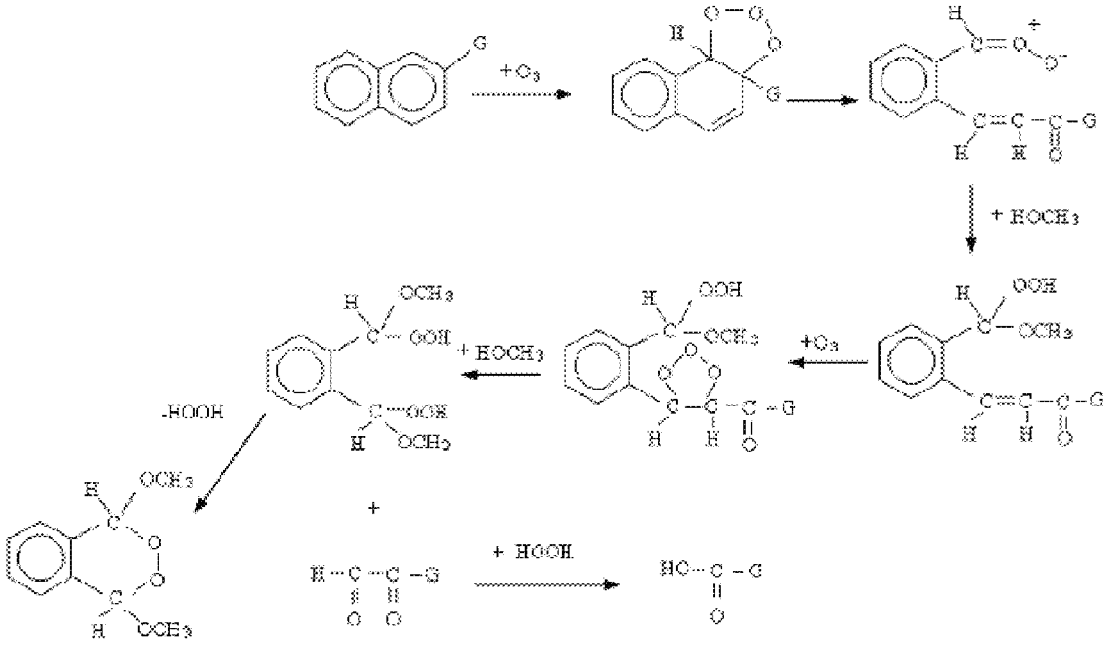
FIG. 20 is a schematic of ozonation of an aromatic compound in accordance with an embodiment of the present invention.

The cleavage of aliphatic branches to form acids with participating solvent is described by FIG. 20. This mechanism is a plausible reaction pathway of cleavage of substituents. This mechanism can also explain why during ozonation, both acids and esters are generated. Cleavage of one substituent needs two ozone molecules and two methanol molecules. The esters generated are due to further reaction of acids with methanol. If acetic acid is added into the reaction system, acetic acid also participates into the reaction. Decomposition of the intermediates generates acids. This mechanism also explains why only after more than two ozone molecules are added into one asphaltene molecule, the acetone soluble products are produced. Another problem is that some aliphatic acids could be generated from substituents branched on naphthenic units due to high activity of the carbons in some positions. Free radical reactions could be more responsible for the cleavage of the substituents.

Generation of dimethyl esters indicates that some of the Athabasca asphaltene molecules could be the same as Strausz proposed. The structure of Alberta asphaltene has lots of loose ring systems. Some polycyclic aromatic hydrocarbons (PAHs) with side groups and acid groups were detected in the acetone extracts of partially ozonated products in participating solvents, even in the first ozonation hour. Statistically it is not likely to cleave the PAHs from the fused ring systems. This result supports the structure discussion of asphaltene molecules; they have several smaller polycyclic aromatic and naphthenic units connected by bridging aliphatic chains. In the first hour, each asphaltene molecule on average meets two ozone molecules at most. One or two ozone molecules can, at most, open one ring or cut off one side chain and cannot cleave PAHs from the fused cores if the asphaltene only has single, rigid, and flat core formed by the fusion of polycyclic aromatic and naphthenic units. Only the structure of several small aromatic rings connected by short chains has the possibility to form PAHs.

S and N have two different positions in asphaltene molecules. It is believed that some S and double bonds are very easy to react with ozone. Some dimethyl ester could come from cleavage of double bonds and S. The GC-MS results showed that some organic S compounds and acids with double bonds were detected in the acetone extracts of partially ozonated products (1 hour ozonation and 2 hour ozonation), such as 4,9-dimethyl-naphtho[2,3-b]thiophene, naphtho[2,3-b]thiophene, and 2,8-dimethyldibenzothiophene, but only sulfuric acid dimethyl ester was detected in the ozonation products after the asphaltene ozonated in DCM/MeOH for a longer time. The contribution of S to the reaction was not very important because the acetone extractable products for high concentration asphaltene were not so much in the first hour and sulfuric acid was not detected. If at the beginning almost all the reactions were mainly contributed by S in the side chains, at least some ozonation products were extractable in the first hour; however, many fewer products were extractable. The reaction of S is mostly through the free radical mechanism and could be limited by the free radical inhibitor. Some organic nitrogen compounds, such as propanenitrile, 3-(dimethylamino)-; trimethylamine; and 3-penten-2-one, 4-(methylamino)-; were detected. Retention time of most these compounds was shorter than 5 min in GC/MS analysis. The structures of these compounds indicate that some products could come from metalloporphyrins. The reaction of ozone with organic N could be free radical reaction. It was pointed out that the main ozonation products of tertiary amines are amine oxides. In this disclosure, no amine oxides were detected by GC/MS. Because ozone generator also produces some $NO_x$, the final products of amine still need extensive investigation. The acids and oxygen containing compounds detected by GC/MS could come from the oxygen comprised in the asphaltene. However, the final ozonation products containing oxygen originated from the asphaltene cannot be distinguished from other ozonation products. The most abundant formation of oxygen was terpenoid sulfoxides and carboxylic acids in the acetone extractable asphaltene. Also, other formations, such as fluorenones, benzofluorenones, and substituted dibenzofuran, were found for oxygen.

Comparison of the Ozonation Products with Biodiesel

Biodiesel is a mixture of long-chain alkyl esters derived from either the transesterification of lipids or the esterification of free fatty acids (FFAs) with low molecular weight alcohols. Europe has dominated the biodiesel industry to-date with 90% global production. Most biodiesel is produced from vegetable oil. The fatty acids from vegetable contain more unsaturated chains than animal lipids. For example, olive oil contains up to 15% of the saturated chains, whereas the saturated chains from canola oil are in the range of 5%-7%, those from soybean oil are in the range of 4.7%-17%, and those from sunflower oil are in the range of 4.8%-12.1%. Compared to petroleum-based diesel, biodiesel has many advantages, such as reduction of most exhaust emissions, biodegradability, a higher flash point, and domestic origin and renewable. It is known for petrodiesel that cetane improvers can reduce these exhaust emissions. Cetane improvers have been identified for fatty compounds that occur in biodiesel. Results showed that longer, straight, or saturated chains could enhance CN (cetane number, the index of diesel engine's ignition delay time) much higher than shorter, branched, or unsaturated chains. Another major technical advantage of biodiesel is that adding biodiesel into (ultra-)low-sulfur petroleum-derived diesel can restore its lubricity. Studies showed that the capacity of enhancing lubricity was mostly contributed by the polarities of oxygenated moieties (COOH>CHO>OH>COOCH3>C═O>C—O—C).

The main drawback of biodiesel is related to the unsaturated bonds in esters, but unsaturated bonds contribute to low melting point and viscosity of the biodiesel compared to saturated esters. Normally, aliphatic acids longer than 8 carbons are solids at room temperature but double bonds (especially cis) can lower their melting point. For example, for $C_{18}$ acids, the melting point of stearic acid (saturated) is 72° C., but for oleic acid (one cis double bond), it is 16° C., and for linoleic acid (two cis double bonds), it is only −5° C. Ozonation of biodiesel can be done with methanol. The ozonation products are more volatile and distribution of molecular weight of esters is closer to distribution of esters from the asphaltene ozonation products. Compared with the components of biodiesel, ozonation of asphaltenes generates more saturated esters with a wider range of molecular weight distribution. The capacity of cetane improvement, soot formation control, and reduction of most exhaust emissions of the processed ozonation products should be higher than that of biodiesel. After the asphaltene ozonation products are reacted with methanol, the mixture is a high viscous liquid. The ozonation products can be purposely separated for special use, such as to be mixed with diesel. Also, the separated ozonation products with bicarboxylic groups can be polyester materials.

The present inventors have utilized the ozonation techniques described herein to provide a method overcoming the problems and shortcomings previously encountered in the ozonation techniques and studies. The present inventors discovered that ozonation of asphaltene generates abundant alkanoic acids following cleavage of the substituents in asphaltene, but ozone efficiency is not high due to precipitation of the ozonation intermediates in reaction medium. The precipitation of intermediates leading to ceasing of conversion is caused by formation of intermolecular ozonides and polymeric ozonides or polymeric peroxides. Reaction of asphaltene with ozone in reaction medium consisting of DCM and proton donors (participating solvents) such as acetic acid and MeOH (methanol) overcomes precipitation of the ozonation intermediates. Although low temperature is preferred for high ozone efficacy, elevated temperature and pressure are desirable for stable reaction. The reaction pathways of asphaltene with ozone in different solvents are different. The reaction rate is mainly determined by the rate of ozone delivered into the reaction system and the product outcomes are determined by the amount of ozone added into the asphaltene molecules. The weight of products is double of that of asphaltene due to addition of oxygen atoms and participating solvents. Ozonation products contain significant carboxylic acid groups, which can be esterified with methanol or other alcohols to generate volatile products. Sulfur in asphaltene molecules is oxidized to form sulfuric acid, whereas the reaction of nitrogen with ozone is more complex. Distillation and extraction readily separate the ozonation products into several valuable fractions.

Example 2

Kinetics of Ozone Reaction with Athabasca Asphaltene in Liquid Phase

Ozonation of organics, such as olefins and PAHs, in organic solvents and water are studied and the reaction kinetics and mechanism in different organics and water at different pH are discussed. In most cases, the reaction is focused on the elimination of the pollutants for environmental concerns. Although ozonation of organics in the aqueous phase and organic solvents both involve the direct ozone eletrophilic addition and free radical reactions, free radical reactions induced by decomposition of ozone in the aqueous phase is more important, especially under basic conditions.

Very few researchers have tried ozonation of heavy hydrocarbons and their studies were focused on analysis of the ozonation products. Ozonolysis of asphaltene derived from semicoking tar of coal has been ozonated in chloroform and the ozonolysis products were analyzed. Also, others did ozonation of heavy oil in $CCl_4$ at very low concentrations with addition of solution to the reaction system. Their final products were distributed in an organic solvent and neutralized water mixture. The heavy hydrocarbon reactivity to ozone influenced by addition of ozone into the heavy hydrocarbon structure and more favorable ozonation conditions still need more investigations.

Most reaction kinetics studies of ozone treatment for organics are conducted in the water phase because the application of ozone is still focused on waste water treatment. The reaction kinetics studies of waste water treatment are related with mass transfer between different phases and reaction rates because the reaction systems are gas-liquid or gas-liquid-solid systems. The reaction kinetics of ozone reaction with compounds in organic solvent, such as ozonolysis of olefin, PAH, or paraffin inorganic solvents, were investigated in lab scale to study the mechanism and reaction rates, but the kinetics models of ozone treatment in a semibatch or bubble-column reactor are not extensively studied.

The reaction constant and kinetics are studied in three ways by measuring the rate relative to that of a standard substance, by the stopped flow method, and by measuring the input and output ozone concentrations. The reactions of aromatic structures with ozone occur in two ways direct ozonation to form ozonides and decomposition of ozonides and generation hydroperoxides, and free radical chain oxidation. The ozonide formation reaction is more important for aromatic structures and is explained by the classic Criegee mechanism. Therefore, ozone reaction with heavy hydrocarbons such as asphaltenes could be a typical bimolecular reaction in a homogenous reaction phase. Since adding MeOH or other similar participating chemicals during ozonation can directly generate esters and other desirable products, the different reaction pathways and different intermediate reactivities may affect ozone efficiency and change the reaction kinetics. Notably, the direct ozonation and free radical reactions were important for the whole reaction. The reaction should be a serial-parallel reaction and the reaction rate of ozone with different reactants could be very different due to the importance of different reaction mechanisms at different stages. Another concern is that asphaltene molecules have two different structures with different polarities and ring sizes, so these two parts could have different reactivities to ozone.

Enhancement of ozone efficiency is a concern for industrial implementation of heavy hydrocarbon ozonation. In this example, the third method was employed because of the complexity of the reaction. The kinetics equations employed to calculate the reaction rate in the aqueous phase was modified to calculate the ozone consumption rate by Athabasca asphaltene in organic solutions. The kinetics of asphaltene ozonation was studied in conjunction with a reaction mechanism discussion to establish a simplified ozonation kinetics model and understand the importance of different reaction pathways to reaction kinetics.

Equations

In a typical homogeneous batch reactor, organic reactant reacts with ozone in two ways: directly with ozone and indirectly with ozone via a free radical mechanism. The reaction rate of ozone with reactant is expressed as the following equations:

$$-r_{as}=k_D C_{as} C_{O3}+k_{ra} C_{as} C_{ra} \quad (1)$$

$$-r_{O3}=zk_D C_{as} C_{O3}+k_{de} C_{O3} C_{de} \quad (2)$$

where $C_{as}$ is the reactant ("as" means asphaltene) concentration, $C_{O3}$ is the ozone concentration in reactant solution, $C_{ra}$ is the free radical concentration, $k_D$ is the reaction constant of directly ozonation, $k_{ra}$ is the reaction constant for free radical reaction, $k_{de}$ is the decomposition constant of ozone, $C_{de}$ is the concentration of compounds that can initiate decomposition of ozone for free radical reactions, and 1/z is the stoichiometric coefficient for direct ozonation. In this study, $C_{de}$ was represented by $C_{as}$ because the free radical reaction could be proportional to the asphaltene concentration. Compared to the eletrophilic addition constant k, the free radical constant k could be very small and not important for the whole reaction. Since these two types of reactions always exist, the stoichiometric coefficient calculated by measuring the consumption rate of ozone will be larger than the actual coefficient if the free radical reaction is important for the whole reaction. The reaction of ozone with most unsaturated compounds is a second order reaction, and normally, the free radical reaction is less important as direct ozonation due to low ozone concentration in the solution.

In order to fully absorb ozone, the bubble-column reactor was selected in this example. Also, the reaction of asphaltene with ozone was conducted in another reactor (in a three-neck flask with magnetic stir, the reactor was a semibatch reactor). The reaction kinetics of ozonation in the flow reactor under different pressure, temperature, and different asphaltene concentrations was investigated by measuring the effluent ozone concentrations in the reaction. It was found that the reaction rate of ozone with reactant progressed from a fast kinetic regime to a low kinetic regime. The liquid phase has been assumed to be homogeneous and the gas phase flow was a plug flow. The concentration of ozone varied along the axial length of the column. The microscopic mass balance equation for ozone is:

$$v_g \frac{dC_{O3g}}{dh} - G_{O3}S\beta = S(1-\beta)\frac{dC_{O3g}}{dt} \tag{3}$$

where $G_{O3}$ is the generation rate of ozone, S is the sectional area of the column, $h_c$ is the height of column, $C_{O3g}$ is the ozone concentration in bulk gas phase, $C_{O3in}$ and $C_{O3eff}$ are concentrations of ozone in the bulk phase at the reactor inlet and outlet, respectively, and vg is the volumetric gas flow of the gas phase. For a fast pseudo first-order kinetic regime, $$G_{O30}=aC^*_{O3}\sqrt{K_D D_{O3} C_{asb}} \tag{4}$$

For a very slow kinetic regime:

$$G_{O3}=k_L a(C^*_{O3}-C_{O3b}) \tag{5}$$

For the fast pseudo first-order kinetic regime, the accumulation of ozone in the liquid phase is neglected. Integration of the differential equation gives:

$$\ln\frac{C_{O3eff}}{C_{O3in}} = -\frac{aRT\beta Sh_c\sqrt{k_D D_{O3}}}{v_8 He}\sqrt{C_{abb}} \tag{6}$$

since the reaction constant $k_D$ could change with time and the kinetic regime will progress to moderate regime with time. For the moderate kinetic regime, the following equation is more suitable to calculate the effluent ozone concentration:

$$\ln\frac{C_{O3eff}}{C_{O3in}} = -\frac{k_L aRT\beta Sh_c}{v_g He}\frac{Ha_1}{\sinh Ha_1}\left[\cosh Ha_1 - \frac{1}{\cosh Ha_1 + \frac{\beta k_L}{aD_{O3}}Ha_1\sinh Ha_1}\right] \tag{7}$$

In the above equation, the Hatta number is assumed to be a fixed number from the bottom to the top. Actually, the Hatta number is changing from the bottom to the top because C* is a changing value from the bottom to the top. When eq 3 is integrated, it is treated as an average value.

When the accumulation of ozone in the liquid phase is neglected, increase of ozone concentration in the liquid phase is due to decrease of reactant concentration. If 1/z is a fixed value within the quick kinetic regime and the moderate kinetic regime, the reactant concentration at time t is:

$$C_{as} = C_{as0} - \int_0^t (C_{O3in} - C_{O3eff})\frac{zv_g}{h_c S\beta}dt \tag{8}$$

For the slow kinetic regime, $C_{O3}=C_{O3g}RT/He$. Integration of the differential eq 3 gets:

$$C_{O3eff} = \frac{C_{O3in}}{\exp\left[\frac{k_L aRTSH_c}{v_g He}\right]} - \left[1 - \frac{1}{\exp\left[\frac{k_L aRTSH_c}{v_g He}\right]}\right]\frac{HeC_{O3b}}{RT} \tag{9}$$

Because $G_{O3}-k_L a(C_{O3}-C_{O3b})=k_d C_{as} C_{O3b}\beta$. Integrating the differential equation also gets:

$$C_{O3in} - C_{O3eff} = \frac{(k_D C_{O3b} C_{as}\beta)S\beta h_c}{v_g} \tag{10}$$

The problem for ozonation of reactant in this very low kinetic regime is that the free radical reaction will compete with the direct ozonation. In this regime, the reactant is not asphaltene again but the ozonation products. Previous ozonation of Athabasca asphaltene was performed in DCM, DCM/methanol, and DCM/acetic acid. By comparing the effluent ozone concentration of reaction in the DCM/MeOH system and in the DCM system, the reaction of ozone with soluble ozonation products was quicker than the reaction rate of ozone with suspended ozonation products because for the three-phase reaction, the reaction rate could be controlled by the diffusion rate of ozone in the solid/liquid interface.

For the fast kinetic regime and a pseudo-first order reaction, the concentration of reactant in the mass transfer film could be lower than in the bulk phase due to reaction of reactant with ozone in the mass transfer film and calculation of Hatta number and reaction factor requires a trial-and-error method. Another problem is that it is not practical to calculate the exact asphaltene concentration in the film and bulk phase because the asphaltene ozonation intermediates are also reacting with ozone. For engineering purposes, a practical alternative is to assume a global or surrogate parameter equivalent to the reactant concentration and reaction constant. In this analysis, the asphaltene concentration is regarded as a constant value. All changes in the actual reaction, such as concentration decrease of asphaltene (asphaltene with high reactivity), or the concentration difference of asphaltene in the liquid mass transfer film and in the bulk phase in the fast reaction regime, or consumption of ozone due to the direct ozonation and free radical reactions, are all attributed to the global reaction constant k, such as for a pseudo first-order reaction in a quick reaction regime. This means the reaction constant k is a black box. This k is an index of the average reactivity of reactant (also the ozonated intermediates) to ozone in the gas/liquid phase and all the changes are represented by k. The total reactant concentration is stable because the reaction volume is constant.

$$Ha_1 = \frac{\sqrt{k_D D_{O3} C_{asR}}}{k_L} = \frac{\sqrt{k_D D_{O3} C_{asb}}}{k_L}\sqrt{1-(E-1)\frac{zC^*_{O3}}{C_{asb}}} = Ha_2\sqrt{1-(E-1)\frac{zC^*_{O3}}{C_{asb}}} \tag{11}$$

The equivalent k equals:

$$\sqrt{k} = \sqrt{k_D}\sqrt{1-(E-1)\frac{zC^*_{O3}}{C_{asb}}} \tag{12}$$

and

-continued $$Ha_1 = \frac{\sqrt{kC_{as}D_{O3}}}{k_L} \tag{13}$$

The drawback of this assumption is that in the moderate and fast regime, the reaction regime is judged by $H_{a2}$. Since $H_{a2}$ is not available, $H_{a1}$ is employed to judge the kinetic regime. When the reaction kinetic is above the moderate regime, normally, E is larger than 1 and using $H_{a1}$ to judge the kinetic regime will cause some errors. All calculation of the effluent ozone concentration will use eq 7 instead of eq 6 and eq 9. Since in the later stage of ozonation, asphaltene molecules could have been decomposed by ozone and the consumption of ozone is due to the free radical mechanism, the lower decomposition rate of ozone at low temperature could make the reaction kinetic in very slow regime. Equations 9 and 10 will be employed to estimate the k and specific area a.

The reaction factor is calculated by the following equation:

$$E = \frac{Ha_1}{\sinh Ha_1}\left[\cosh Ha_1 - \frac{1}{\cosh Ha_1 + Ha_1\left(\frac{\beta}{a\delta_L}\right)Ha_1 \sinh Ha_1}\right] \tag{14}$$

EXPERIMENTAL

Ozone was produced from an ozone generator (Model T-816, Polymetrics Corp.) by passing dry and filtered air through it at an applied voltage of 100 V. The ozone/air flow rate was controlled at 1.6±0.2 L/min and the ozone concentration in the gas flow was 1.6±0.1% by volume under room temperature. The raw asphaltene used in this experiment was asphaltene fraction of oil sands bitumen from Canada Athabasca, which contained about 40% by weight of insoluble part. All the solvents, methanol (from Fisher 104 Scientific), acetone (from VWR), and dichloromethane (DCM, from Sigma-Aldrich) were analytical reagent grade. Indigo Blue solution was prepared by dissolving potassium indigo trisulfanate (C16H7N2O11S3K3) (from Aldrich) in distilled-deionized water. To measure ozone concentration, a 100 ml round flask with 24/40 joint prefilled with 50 ml 1 mM/L indigo blue solution was filled with ozone containing gas in the headspace, then the flask was closed and vigorously shaken for 10 min. The absorbance of the solution was measured to calculate the remaining potassium indigo trisulfanate concentration using a calibration curve. Since consumption of ozone was proportional to consumption of potassium indigo trisulfanate, ozone concentration was calculated.

Figure 21:
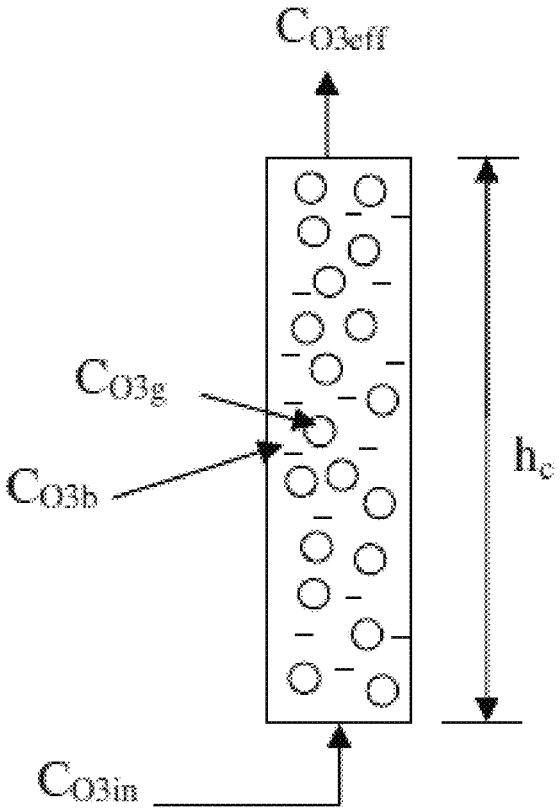
FIG. 21 is a schematic of a bubble column reactor in accordance with an embodiment of the present invention.

Ozonation of the asphaltene was conducted in a bubble column reactor (FIG. 21) or a three-neck flask with magnetic stir. The experimental details were described above. The ozonation pressure of the bubble column reactor was controlled between 1 atm to 15 psi by controlling the inlet valve and outlet valve. The ozonation temperature was determined by the flow rate of gas flow and reaction pressure. For kinetic study, the ozone concentration in the outlet was measured by the indigo blue method during ozonation. At the end of each experiment, the dissolved ozone concentration in the solution was measured. The weights of ozonation products were measured and the ozonation products were separated and analyzed to evaluate the reaction kinetics and mechanism.

Calculation of Fluid Dynamic Parameters

Figure 22:
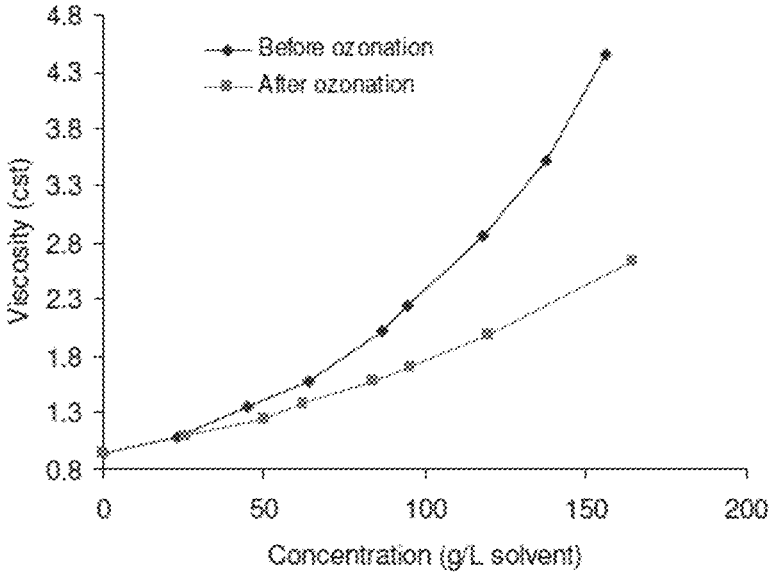
FIG. 22 is a plot of viscosity vs. concentration before and after ozonation of asphaltene in accordance with an embodiment of the present invention.

The diffusivity of ozone in DCM was calculated using the following equation if the reactant concentration was very low:

$$D_{O3} = 7.4 \times 10^{-12} \frac{(\Phi MW)^{\frac{1}{2}} T}{\mu_s V_{O3}^{0.6}} \tag{15}$$

where $\mu_s$ is the viscosity of the solvent in centipoises, Φ is the association parameter for the liquid (1 for DCM), MW=84.9 g/mol for DCM, and $V_{O3}$ is the molar volume of ozone. The ozone molar volume is 35.5 $cm^3$/mol. The viscosity of DCM at 0° C. is 0.44 cst and 0.32 cst at room temperature. Viscosity of the asphaltene ozonation solution (FIG. 22 and FIG. 23) was determined by the reaction time and asphaltene concentration. The kinematic viscosities were measured by ASTM Standard D445 using a calibrated VWR cross arm viscometer at room temperature. The reaction phase at different temperature also had different viscosity profiles. Because the asphaltene concentration was mostly from 10 g/L to 100 g/L, an average viscosity of 0.5 cst for all reactions was assumed for all reactions. $\mu_s$=μ=0.5 cst*1.32 g/cm3=0.0066 poise=0.00066 pa*s. When temperature was decreased, the diffusivity of ozone in DCM would decrease. The diffusivities calculated are $D_{O3}$=3.56*$10^{-9}$ $m^2$/sec at 20° C. and $D_{O3}$=3.31*$10^{-9}$ $m^2$/sec at 0° C.

The liquid hold was obtained from the experimental data of the height of the liquid in the column with and without bubbling:

$$1 - \beta = \frac{h_c - h_{c0}}{h_c} \tag{16}$$

where S=18.86 $cm^2$, $h_{c0}$=16 cm, $h_c$=20 cm under 15 psi, $h_c$=23 cm under 1 atm, β=0.80 and 0.70, respectively, $v_g$=0.0133 L/s and 0.0267 L/s. Empirical equations used to calculate $k_L$ are:

$$k_L = 0.42\sqrt[3]{\frac{\mu_s g}{\rho_s}}\, Sc^{-0.5} \tag{17}$$

$$Sc = \frac{\mu_s}{\rho_s D_{O3}} \tag{18}$$

All units are SI units, $k_L$=6.013*10-4 m/sec at 20° C., and $k_L$=5.81*10-4 m/sec at 0° C.

The film thickness is estimated by the equation:

$$k_L = \frac{D_{O3}}{\delta_L} \tag{19}$$

For DCM, $\delta_L$=5.92*10-5 m.

The Henry's law coefficient of ozone in DCM was measured by bubbling ozone containing air through DCM. By measuring the ozone concentration in the gas phase and liquid phase using the indigo blue method, He=605.26 at 0° C. and He=696.1 at 20° C.

Results and Discussions

At the end of ozonation, the effluent ozone concentration was stabilized to a constant value. The reaction constant was calculated by eq 10. The reaction constants for ozonation of the asphaltene at the later stage of reaction are shown in Table 4.1. The reaction was conducted under two pressures, 1 atm (0 psi) and 15 psi. Although the volume percentages of ozone in the influent gas under different pressure were the same, the ozone partial pressure under 15 psi was higher than under 1 atm.

TABLE 4.1

Reaction constant calculated for low and very slow kinetics regimes.

| Reaction | | $C_{as}$ (kmol * m$^{-3}$) | $C_{O3in}$ (kmol * m$^{-3}$) | $C_{O3eff}$ (kmol * m$^{-3}$) | β | $C_{O3b}$ (kmol * m$^{-3}$) | k (M$^{-1}$ * S$^{-1}$) |
|---|---|---|---|---|---|---|---|
| 15 psi, | MeOH | 1.82 | 0.00133 | 0.000248 | 0.8 | 0.000825 | 0.05 |
| 20° C. | DCM | 15.53 | 0.00133 | 0.001208 | 0.75 | 0.00419 | 0.00012 |
| | 3 g | 0.0116 | 0.00133 | 0.000492 | 0.8 | 0.00156 | 2.56 |
| | 6 g | 0.0232 | 0.00133 | 0.000317 | 0.8 | 0.000924 | 2.62 |
| | 12 g | 0.0465 | 0.00133 | 0.000233 | 0.8 | 0.00051 | 2.56 |
| | 24 g | 0.0929 | 0.00133 | 0.000167 | 0.8 | 0.000278 | 2.5 |
| 1 atm, | MeOH | 1.82 | 0.000667 | 0.000492 | 0.75 | 0.00168 | 0.0084 |
| 0° C.- | 3 g | 0.0116 | 0.000667 | 0.000487 | 0.75 | 0.00166 | 1.09 |
| 4° C. | 6 g | 0.0232 | 0.000667 | 0.000413 | 0.75 | 0.00119 | 1.08 |
| | 12 g | 0.0465 | 0.000667 | 0.00035 | 0.75 | 0.00082 | 0.97 |
| | 24 g | 0.0929 | 0.000667 | 0.000313 | 0.75 | 0.000469 | 0.95 |

Figure 24:
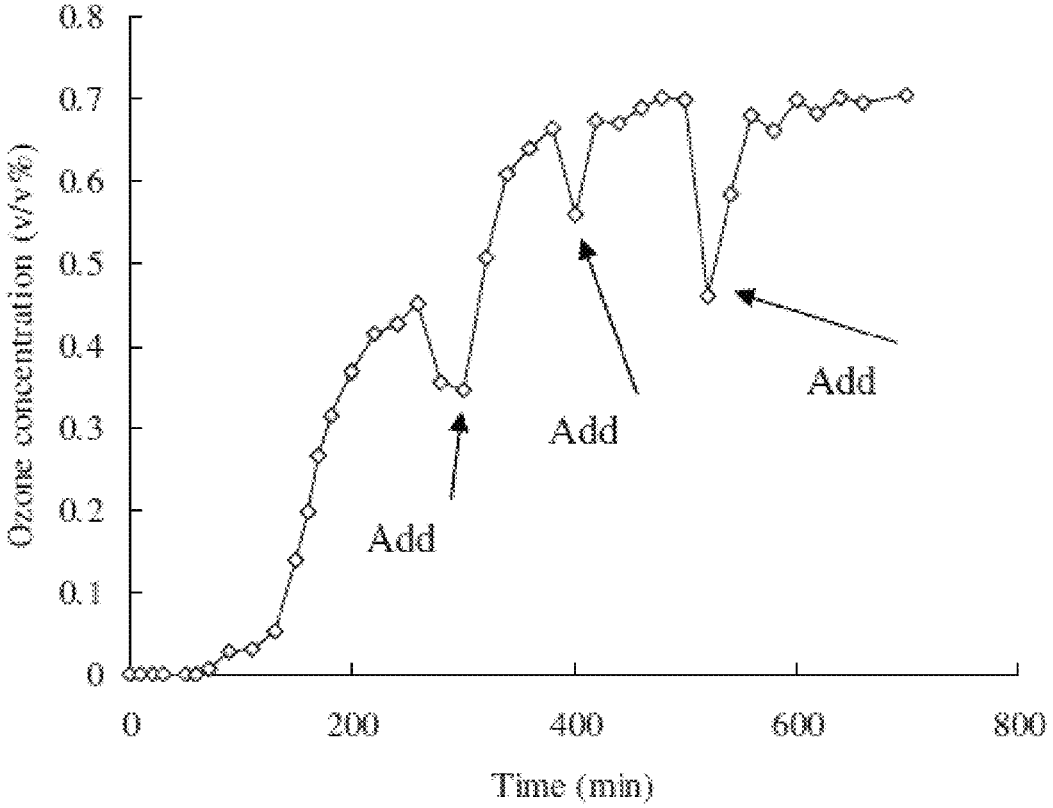
FIG. 24 is a plot of ozone concentration vs. time of ozonation of asphaltene showing the impact of the addition of methanol in accordance with an embodiment of the present invention.

Because the evaporation rate of solvent under normal pressure (1 atm) was much quicker than under 15 psi, the reaction temperature was much lower under 1 atm. The reaction constant was calculated using eq 10. Ozone decomposed when it passed through the DCM/MeOH mixture and the effluent ozone concentration was measured (Table 4.1). Although the reaction constant of methanol with ozone was very low, the decomposition of ozone caused by methanol was considerable for a bubble column reactor when methanol concentration was high. The reaction constants of methanol with ozone calculated at different temperature in this disclosure were almost the same as reported literature. When the asphaltene was ozonated in the DCM/MeOH system, the ozone concentration measured during reaction showed that methanol only could temporary lower the effluent concentration after methanol was injected into the reaction system. The effluent ozone concentration returned to the track in short time (FIG. 24). This indicated that methanol could be quickly consumed by the ozonation intermediates when it was added into the reactor during reaction or the methanol induced intermediates quickly react with ozone. Addition of methanol could generate many low molecular weight compounds that were reactive to ozone through two reaction mechanisms.

The Hatta numbers of the reactions were checked by eq 11 to make sure the reaction was within very slow regime at the end of reaction (Table 4.2). In Table 4.2, the specific area (a in Table 4.2) of ozonation under different pressure was calculated by eq 9. The results showed that the specific area was smaller under normal pressure with the same mass flow rate of gas as 15 psi.

TABLE 4.2

Specific area, Hatta number, and reaction factor for low and very low kinetic regimes.

| Reaction | | $k_L a$ (s$^{-1}$) | a (m$^{-1}$) | $Ha_1$ | E |
|---|---|---|---|---|---|
| 15 psi | MeOH (5%) | 0.031 | 51.5 | 0.0299 | 0.73 |
| | 5 g | 0.0253 | 43.2 | 0.017 | 0.47 |
| | 10 g | 0.0276 | 45.9 | 0.024 | 0.64 |
| | 20 g | 0.0254 | 42.2 | 0.034 | 0.78 |
| | 40 g | 0.0273 | 45.4 | 0.048 | 0.87 |
| 1 atm | MeOH (5%) | 0.0216 | 37.1 | 0.012 | 0.31 |
| | 5 g | 0.0195 | 33.5 | 0.011 | 0.27 |
| | 10 g | 0.0207 | 35.6 | 0.016 | 0.43 |
| | 20 g | 0.0195 | 33.5 | 0.021 | 0.57 |
| | 40 g | 0.0186 | 32.1 | 0.029 | 0.73 |

Figure 23:
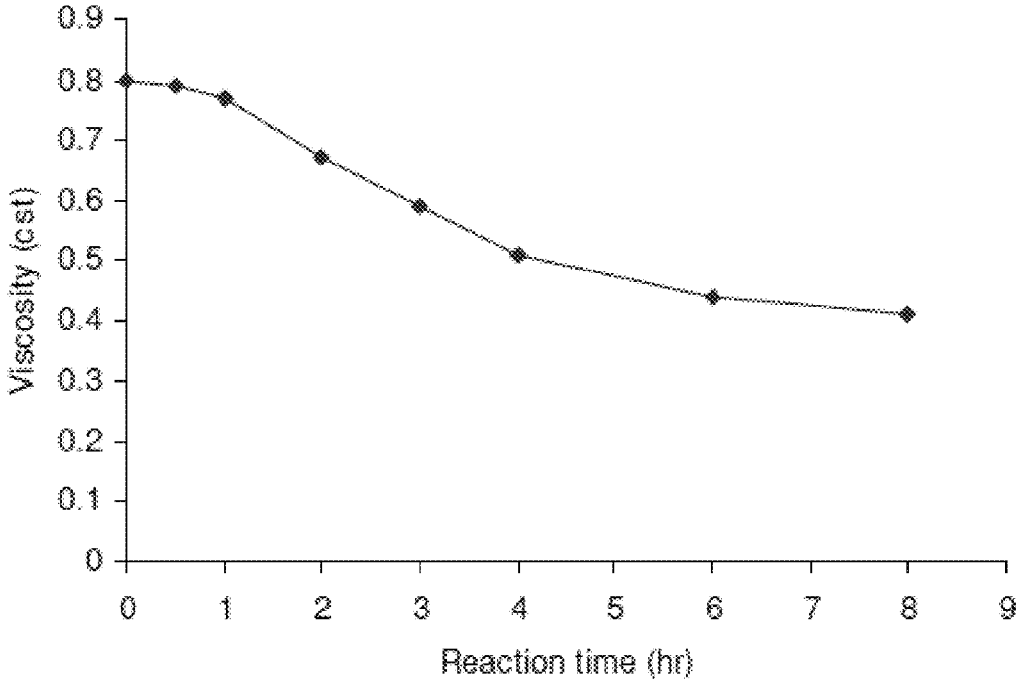
FIG. 23 is a plot of viscosity vs. reaction time of ozonation of asphaltene in accordance with an embodiment of the present invention.

This conclusion was reasonable because the average bubble size under 1 atm was much bigger than the size of bubbles passed through liquid phase under 15 psi. In some reactions with higher asphaltene concentrations, such as ozonation of 20 g and 40 g asphaltene under 15 psi, the Hatta number was a little bigger than 0.03. The reaction was in low regime instead of very low regime, but the $k_{La}$ and a calculated using the very low regime equation were almost the same. The specific area a calculated in very low kinetic regime was used in eq 7 to calculate the effluent ozone concentration in fast and moderate regimes. This treatment could cause some errors because the viscosity at the beginning of ozonation was a little higher than in the later stage (FIG. 23). In Table 4.2, the specific area a of MeOH/DCM only reaction system is higher than that of asphaltene presented reaction. It could be caused by lower diffusivity of ozone in the asphaltene solution or higher viscosity of the solution. Experimental results proved that using mechanical stir could significantly lower the effluent ozone concentration by enlarge the specific area. The specific area a calculated was 44 m$^{-1}$ and 33.5 m$^{-1}$ under 15 psi and 1 atm, respectively.

Figure 26:
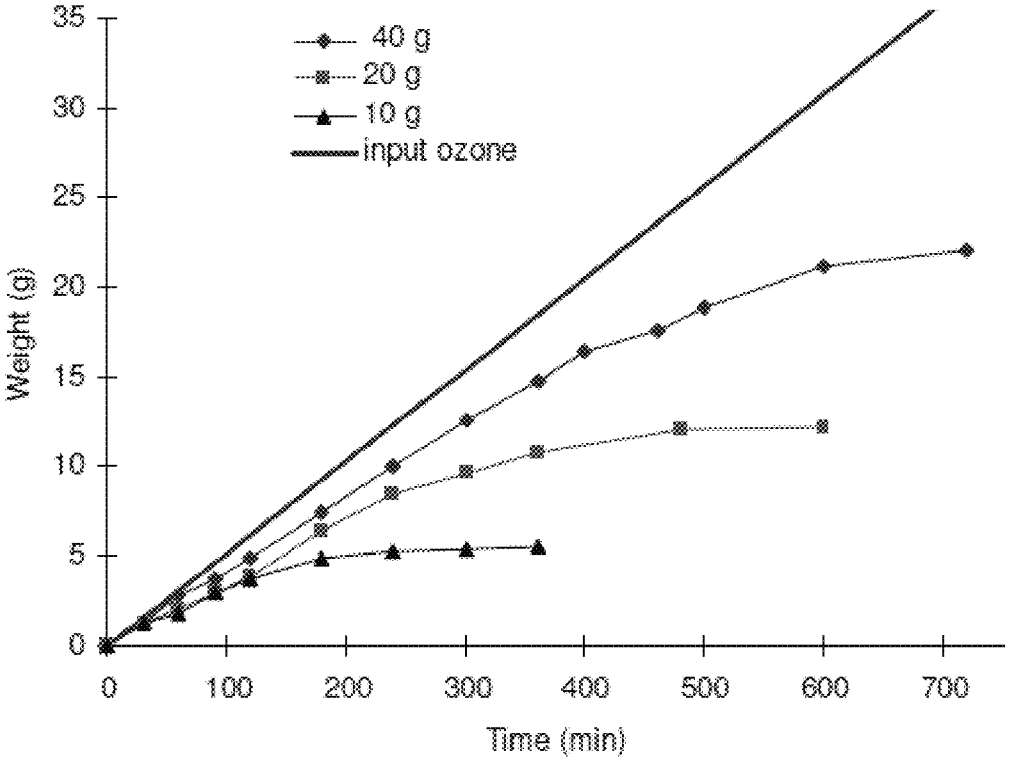
FIG. 26 is a plot of weight vs. ozonation time of various loadings of asphaltene in accordance with an embodiment of the present invention.
Figure 27:
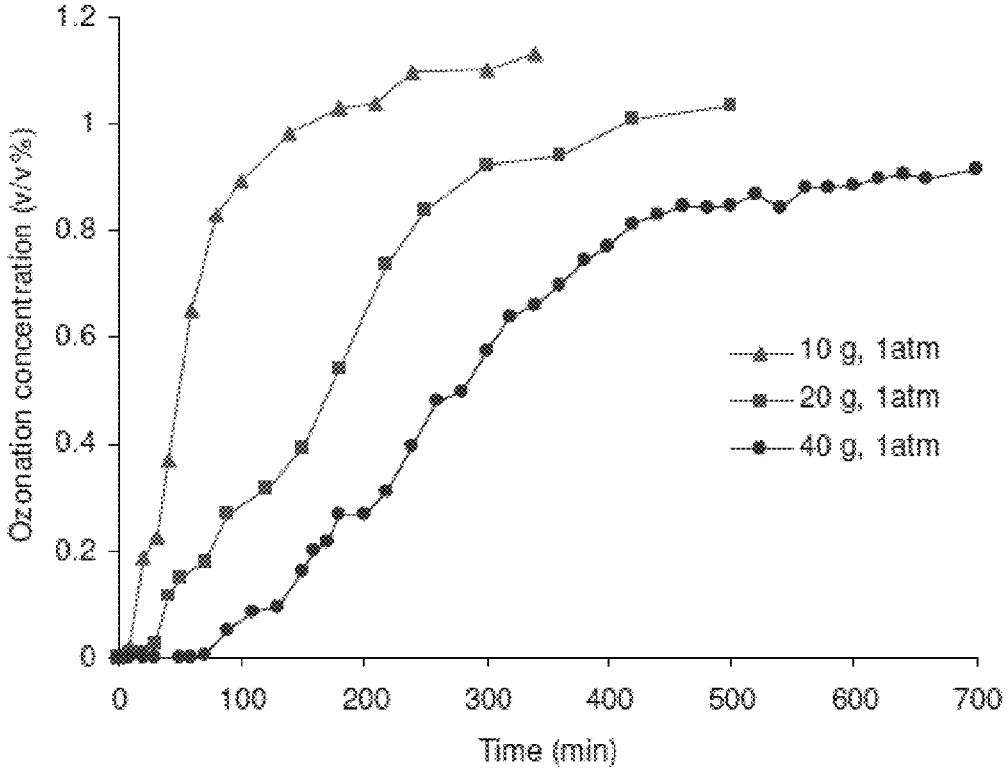
FIG. 27 is a plot of ozonation concentration vs. time of various loadings of asphaltene in accordance with an embodiment of the present invention.

The reaction results, such as dissolving of the ozonation intermediates in different solvents, weight increases of the ozonation products, and effluent ozone concentration profiles, indicated that the reaction could have several stages. The initial reaction rate was much higher than the rate of the later stage. The asphaltene concentration in FIG. 25 decreases with time (the weight of DCM soluble part) and the ozonation products (the weight of acetone soluble part). The intermediates have a peak value during reaction (DCM/acetic acid soluble part). The weight-gaining rate decreases with reaction time in FIG. 26. First, the weight of ozonated asphaltene was almost linearly increased with reaction time. Then, the increasing rate decreased after a turning point. The weight increase could mostly be due to free radical reaction after this turning point. The stoichiometric coefficient of the direct ozonation is estimated in Table 4.3. At the beginning of ozonation, almost all ozone was absorbed by the reaction system and the effluent ozone concentration was very low. This stage was called the total absorption stage. As previously discussed, the VPO method measured the average molecular weight of the asphaltene about 860 amu. The reaction time of this stage was determined by measuring the effluent ozone concentration. It was found that the stoichiometric coefficient of this stage was 2.3. This reaction could be related with the molecular aggregation phenomenon of asphaltene in solvent. The stoichiometric coefficient indicated that the reactive sites in the outside surface of the cluster could be the most active sites to ozone. The linear increasing stage should be caused by the direct reaction (was determined by FIGS. 27, 28, and 29 (Table 4.3)).

TABLE 4.3

Stoichiometric coefficients of different reaction situations. Asphaltene contains 40% by weight of insoluble solids.

| Total absorption | | | | |
|---|---|---|---|---|
| Asphaltene loading | Total absorption (time) | Input ozone (mol/mol) | Reacted ozone (mol/mol) | Efficiency of ozone |
| 10 g | 0-15 | 2.296 | 2.296 | 100% |
| 20 g | 0-30 | 2.296 | 2.296 | 100% |
| 40 g | 0-60 | 2.30 | 2.30 | 100% |
| **Direct ozonation** | | | | |
| Asphaltene loading | Linear increase (min) | Input ozone | Reacted ozone | Efficiency of ozone |
| 10 g | 0-110 | 16.82 | 11.95 | 66.0% |
| 20 g | 0-210 | 16.05 | 12.22 | 72.7% |
| 40 g | 0-410 | 15.69 | 12.05 | 75.0% |
| **Free radical reaction** | | | | |
| Asphaltene loading | Reaction of the ozonation products | Input ozone | Decomposed and reacted ozone | Efficiency of ozone |
| 10 g | 110-200 | 15.10 | 5.16 | 34.4% |
| 20 g | 220-400 | 13.76 | 5.59 | 40.6% |
| 40 g | 410-700 | 14.92 | 6.99 | 46.9% |

Figure 25:
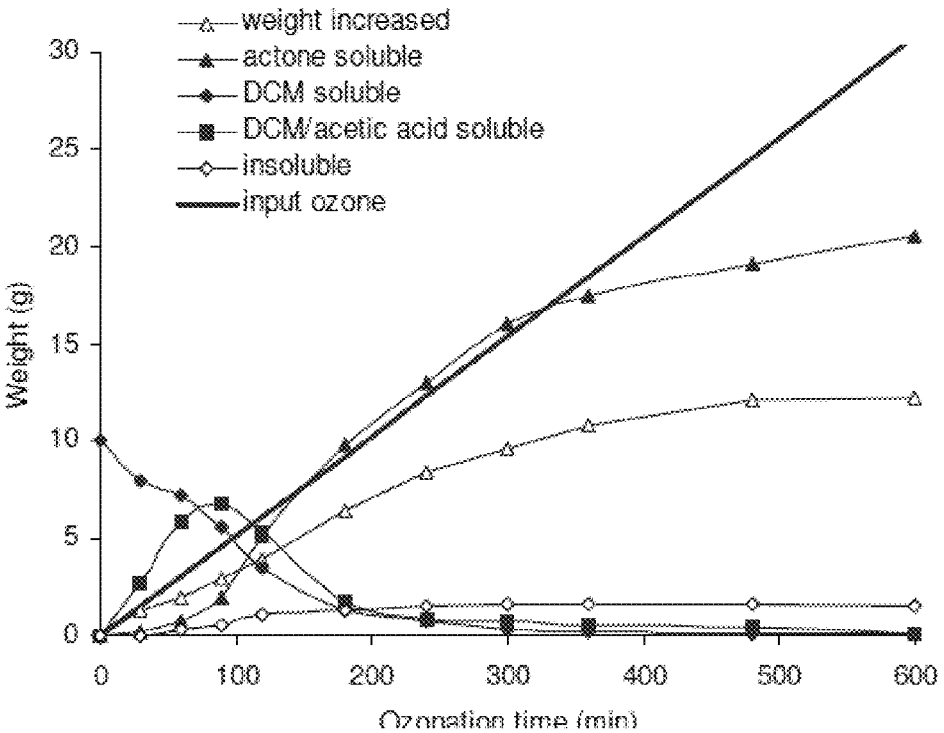
FIG. 25 is a plot of weight vs. ozonation time of various factions of ozonated asphaltene in accordance with an embodiment of the present invention.

The stoichiometric coefficient of the direct ozonation was about 12. Following the direct ozonation reaction, the reaction via the free radical mechanism was gradually responsible for the weight increase of the ozonation products. When each asphaltene molecule on average has reacted with 6 ozone molecules, the reaction system generated the highest concentration of the ozonation intermediates (FIG. 25). When about 12 ozone molecules on average reacted with one asphaltene molecule, this kind of ozonation intermediates totally disappeared. This procedure could be a critical procedure in the whole reaction, during which the asphaltene structures were decomposed to small acetone soluble molecules. This value could be used to estimate the number of reactive sites in each asphaltene molecule. During ozonation, cleavage of the substituents and breaking of the asphaltene molecules could be parallel reactions. It is obvious that cleavage of one substituent from asphaltene molecules at least needs two ozone molecules. Also, cutting one asphaltene molecule into two pieces needs at least two ozone molecules for asphaltene structure-like compounds. Before cleavage of substituents, it was highly possible that most ozone had reacted with all reactive aromatic sites. Putting FIG. 25 and Table 4.3 together, it was found that the acetone soluble products are generated after on average two ozone molecules are added into one asphaltene molecule. This means the asphaltene molecule has about two most reactive sites. Adding two ozone molecules could statistically generate some small pieces with hydroperoxides groups. After reaction of the most reactive site, the direct ozonation sites still consumed the most ozone, although the reaction rate was not as high as before. The structures of asphaltenes have determined adding more than two ozone molecules could not generate many small pieces. For substituents, only after all available direct ozonation sites were reacted with ozone, cleavage of the substituents would be more responsible for ozone consumption. GC/MS analysis of the ozonation products for 20 g asphaltene ozonated in DCM/methanol (sample in FIG. 25) showed that until after 3 hour ozonation, significant amount of esters were identified in acetone solution. At this point, all the reactive direct ozonation sites could have been reacted by ozone. Therefore, based on the stoichiometric coefficient calculated at this point, each asphaltene molecule on average could have 6-10 reactive sites, and 8-10 sites are more reasonable.

Figure 28:
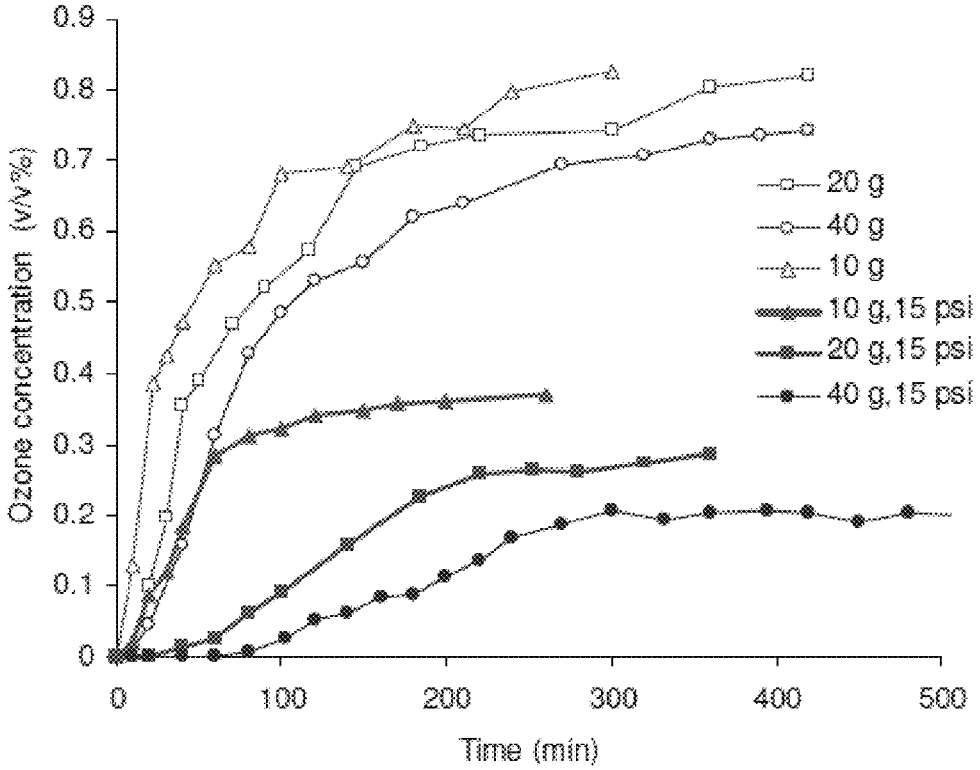
FIG. 28 is a plot of ozonation concentration vs. time of various loadings of asphaltene at differing pressures in accordance with an embodiment of the present invention.
Figure 29:
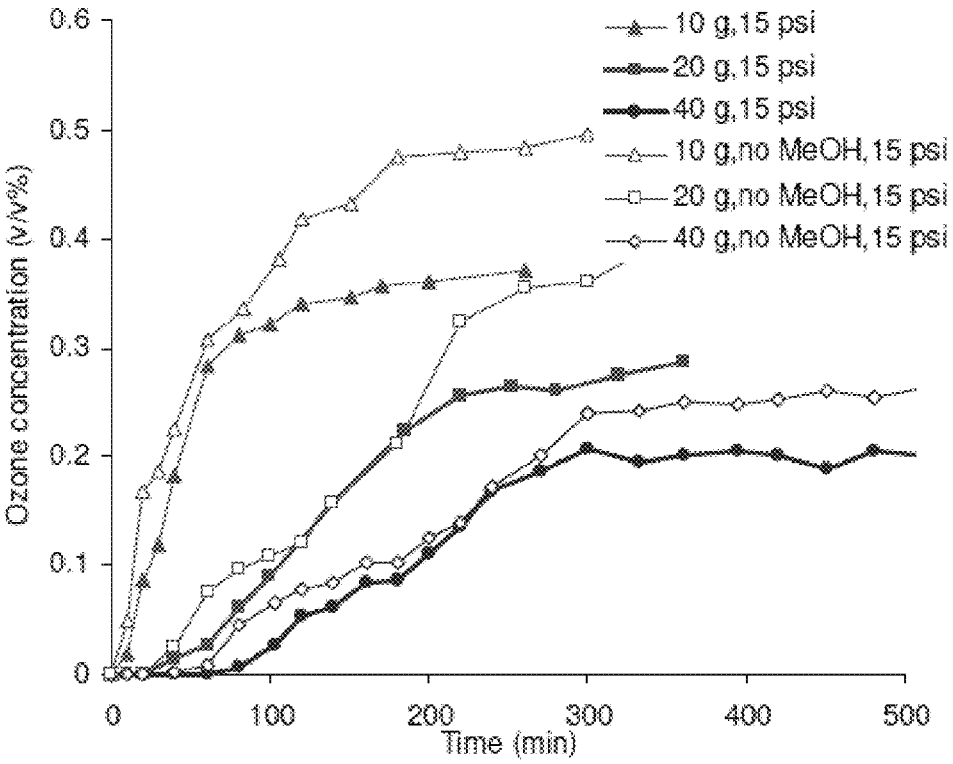
FIG. 29 is a plot of ozonation concentration vs. time of various loadings of asphaltene with and without methanol at differing pressures in accordance with an embodiment of the present invention.

The influences of reaction pressure, temperature, and solvent on reaction rate are compared in FIGS. 28 and 29. Adding methanol in the reaction did not significantly lower the reaction rate. At the initial stage of ozonation, the reaction rate of ozonation in pure DCM was a little lower than in the DCM/MeOH system. This difference could be caused by coprecipitation of the asphaltene with ozonation products. After the ozonation reaction was accomplished (direct ozonation), the ozone consumption rate of the DCM/MeOH system was faster than in DCM. It was observed that all ozonation products were precipitated in DCM after ozonation, but almost all ozonation products were dissolved in the DCM/MeOH system. This difference can explain why the effluent ozone concentration of the DCM/MeOH system was lower than the DCM system for a higher decomposition rate of ozone.

Figure 30:
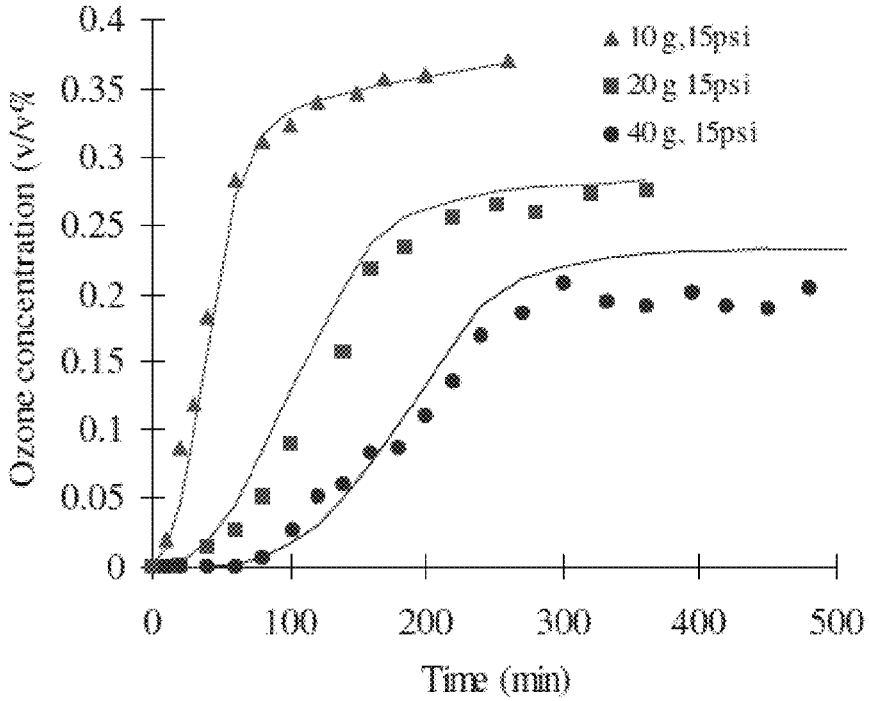
FIG. 30 is a plot of ozonation concentration vs. time of various loadings of asphaltene with regression curves in accordance with an embodiment of the present invention.
Figure 31:
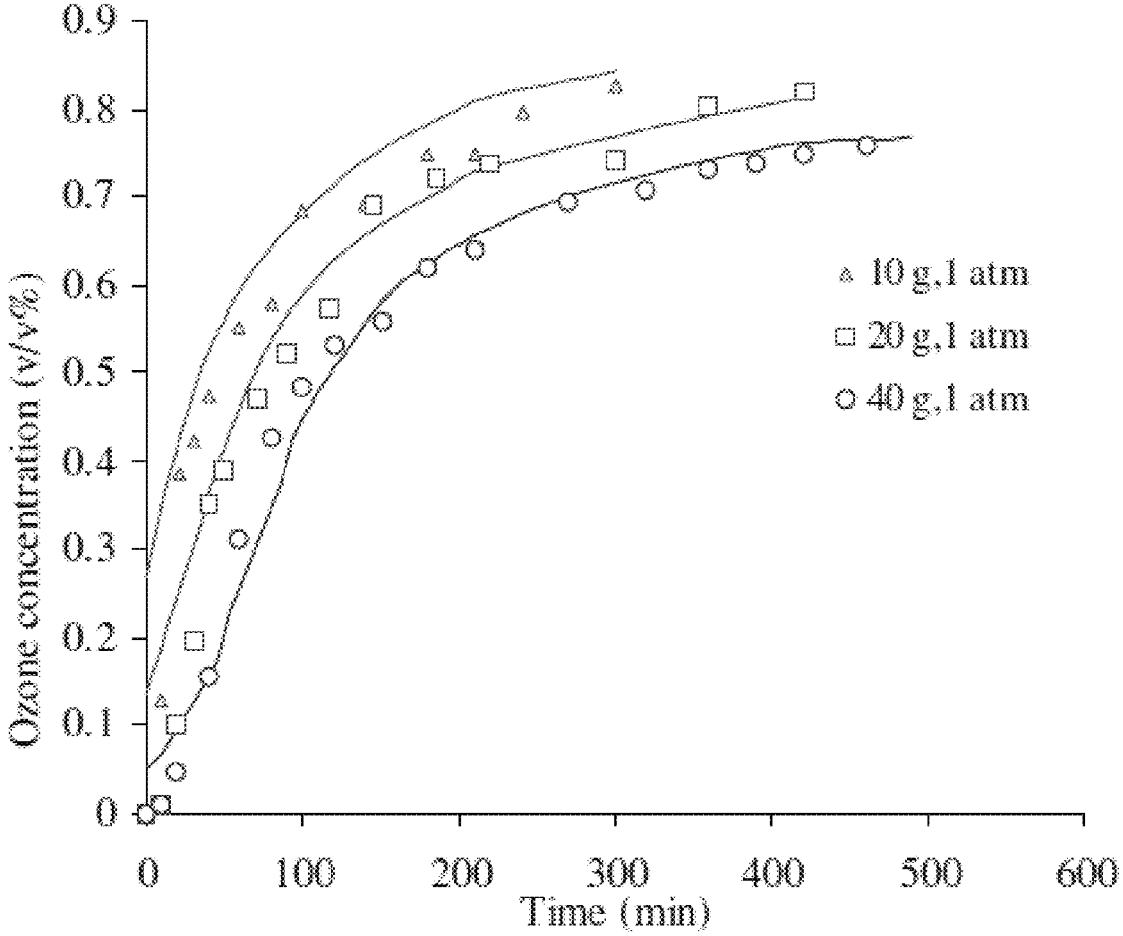
FIG. 31 is a plot of ozonation concentration vs. time of various loadings of asphaltene with regression curves in accordance with an embodiment of the present invention.
Figure 32A:
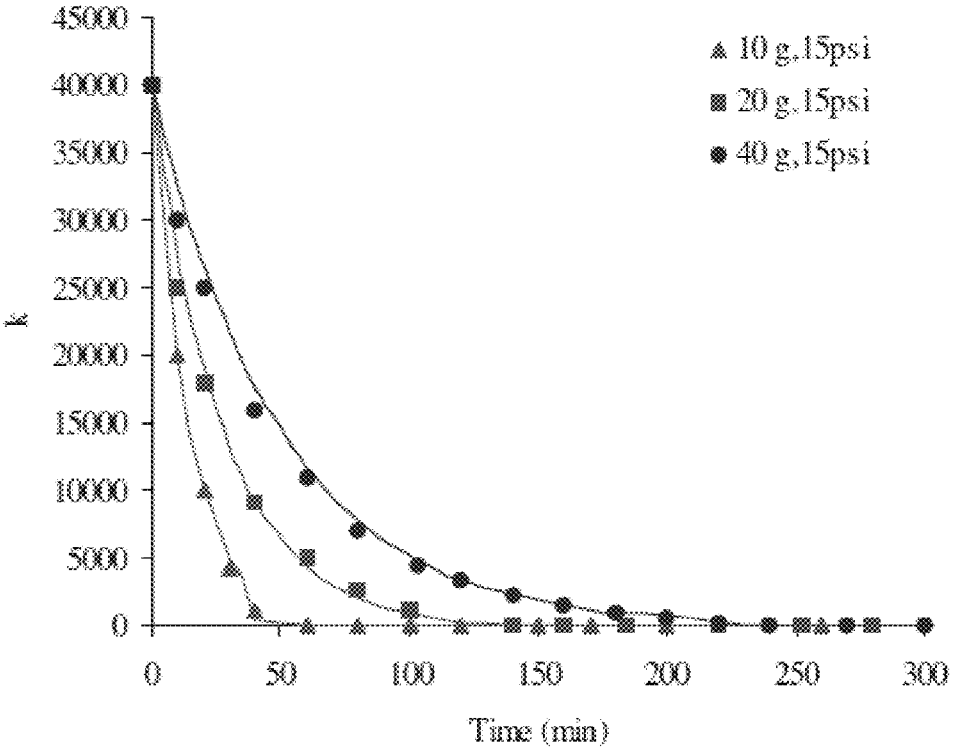
FIG. 32 is (A) fitted curves of differing asphaltene loadings on a plot of reaction constant (k) vs. time and (B) fitted curves of differing asphaltene loadings on a plot of ln (k) vs. time in accordance with embodiments of the present invention.
Figure 32B:
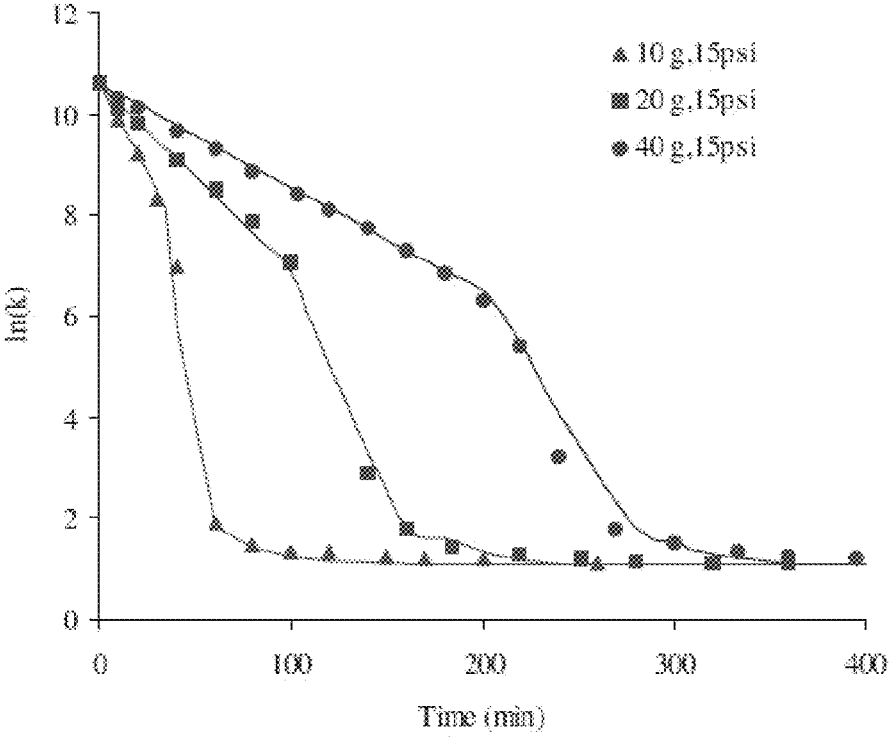
Figure 33A:
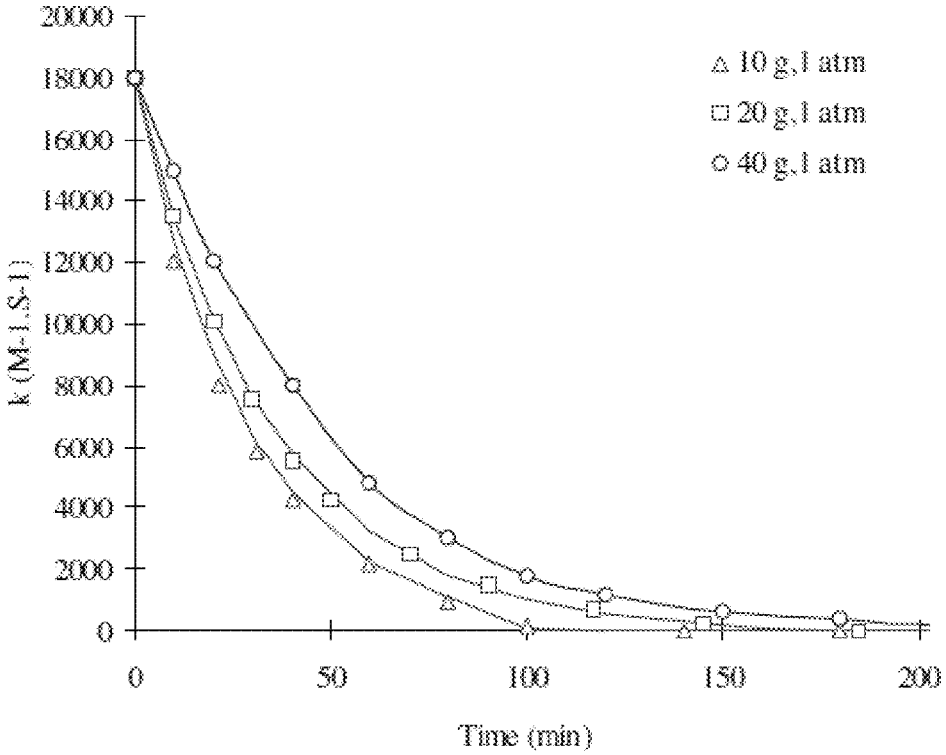
FIG. 33 is (A) fitted curves of differing asphaltene loadings on a plot of reaction constant (k) vs. time and (B) fitted curves of differing asphaltene loadings on a plot of ln (k) vs. time in accordance with embodiments of the present invention.
Figure 33B:
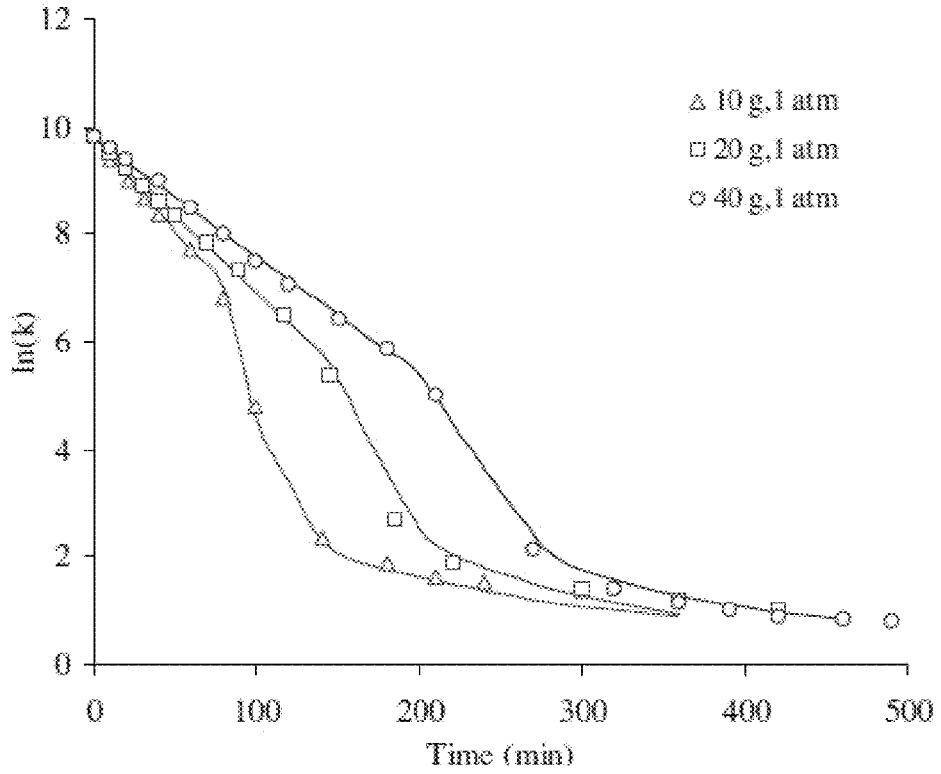

The global reaction constant k of the asphaltene ozonation in the DCM/MeOH system and the DCM system with reaction time was regressed using eq 7 and eq 13. FIG. 30 and FIG. 31 show the regression curves. The reaction constant profiles under different conditions are shown in FIG. 32 and FIG. 33. For more precise investigation of asphaltene's deactivating behavior, curves of ln(k) vs time are plotted in FIG. 32 and FIG. 33. It was observed that the reaction constant decreased exponentially with reaction time. Each curve in FIG. 32B and FIG. 33B has two turning points. The first point could be the turning point for direct ozonation to transient reactions. After this point, almost all reactive sites in the asphaltene are consumed. The asphaltene reactivity decreased dramatically between turning point 1 and turning point 2. After turning point 1, the reaction would gradually shift from direct ozonation to free radical reaction. Before point 2, the weight increase was almost linear (compare FIG. 30 and FIG. 32, and FIG. 31 and FIG. 33). The stoichiometric coefficients for point 1 and point 2 are estimated by comparing FIG. 30 and FIG. 32, and FIG. 31 and FIG. 33, under different ozonation pressures, respectively. The reaction constant is a function of time. In eq 20, $t_1$ and $t_2$ is the stating time and ending time of three stages, respectively. The exact values of $t_1$ and $t_2$ were determined by stoichiometric coefficient of each stage (Table 4.4). The starting time of stage 1 and 2 is calculated by eq 21 and eq 22, respectively.

$$k = k_{1o}\exp\left[-b\frac{\int_{t1}^{t2}(C_{o3in} - C_{O3eff})vg\,dt}{C_{as}\beta s h_c}\right] + k_{2o} \tag{20}$$

TABLE 4.4

Parameters in eq 20 of three stages under different ozonation conditions.

| | stage 1 | | stage 2 | | stage 3 | | |
|---|---|---|---|---|---|---|---|
| Reaction | $k_{1o}$ | b | $k_{1o}$ | b | $k_{1o}$ | b | $k_{2o}$ |
| 1 atm | | | | | | | |
| 10 g | 18000 | 1.37 | 250 | 3.52 | 8 | 0.768 | 3.5 |
| 20 g | 18000 | 2.27 | 250 | 6.26 | 8 | 2.06 | |
| 40 g | 18000 | 3.41 | 250 | 9.43 | 8 | 3.27 | |

TABLE 4.4-continued

Parameters in eq 20 of three stages under different ozonation conditions.

| | stage 1 | | stage 2 | | stage 3 | | |
|---|---|---|---|---|---|---|---|
| Reaction | $k_{1o}$ | b | $k_{1o}$ | b | $k_{1o}$ | b | $k_{2o}$ |
| 15 psi | | | | | | | |
| 10 g | 40000 | 2.24 | 1000 | 7.11 | 4 | 2.39 | 2.0 |
| 20 g | 40000 | 2.40 | 1000 | 8.07 | 4 | 4.18 | |
| 40 g | 40000 | 2.66 | 1000 | 9.93 | 4 | 7.35 | |

$$t_1 = 0 \tag{21a}$$

$$\frac{\int_{t1}^{t2} (C_{o3in} - C_{O3eff}) vg\, dt}{C_{as}\beta sh_c} = \frac{1}{z_1} \tag{21b}$$

For stage 2:

$$t_1 = t_2 \text{ of stage 1,} \tag{22a}$$

$$\frac{\int_{t1}^{t2} (C_{o3in} - C_{O3eff}) vg\, dt}{C_{as}\beta sh_c} = \frac{1}{z_1} \tag{22b}$$

For stage 3, $$t_1 = t_2 \text{ of stage 2,} \tag{23a}$$

$$t_2 > t_1 \tag{23b}$$

Figure 34:
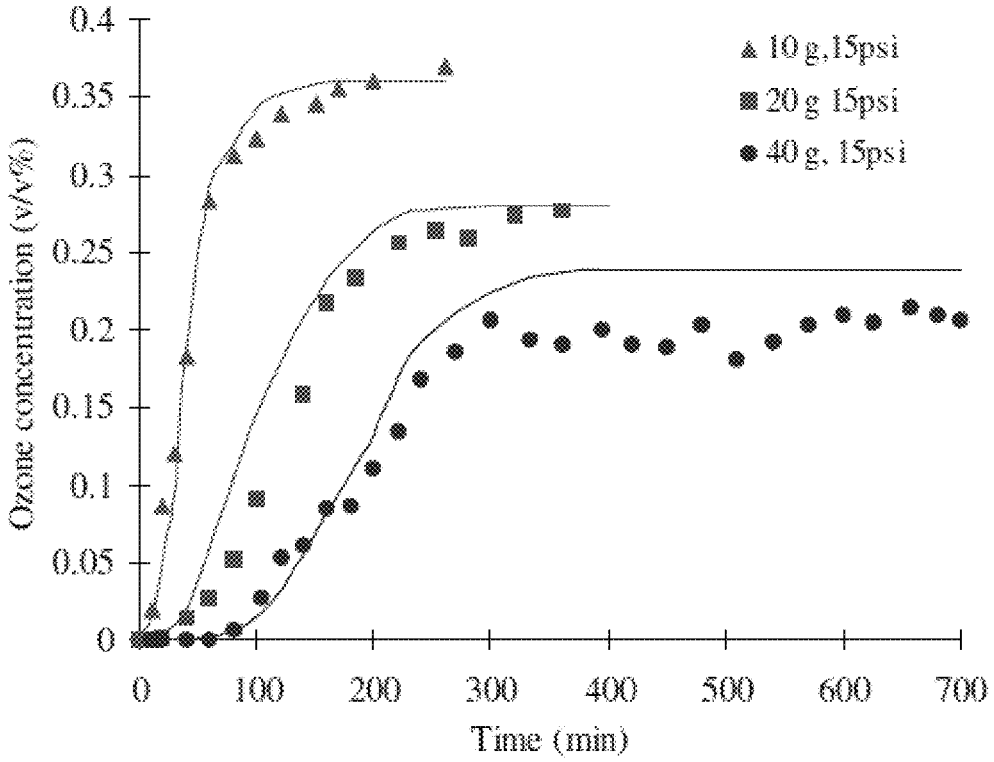
FIG. 34 is a plot of ozonation concentration vs. time of various loadings of asphaltene with regression curves in accordance with an embodiment of the present invention.
Figure 35:
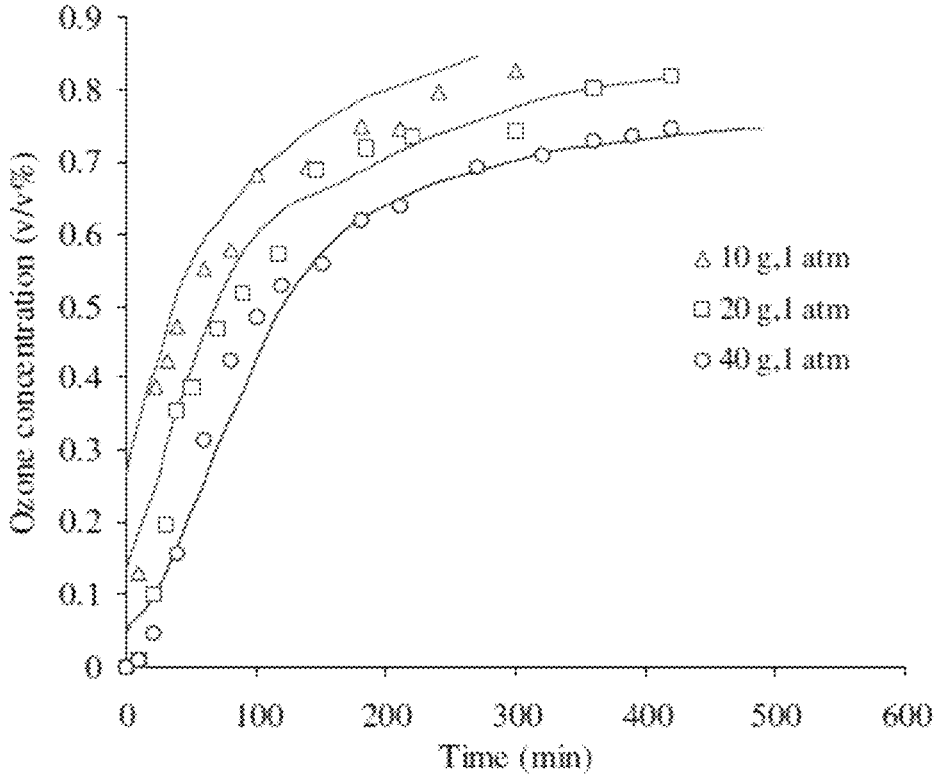
FIG. 35 is a plot of ozonation concentration vs. time of various loadings of asphaltene with regression curves in accordance with an embodiment of the present invention.
Figure 36:
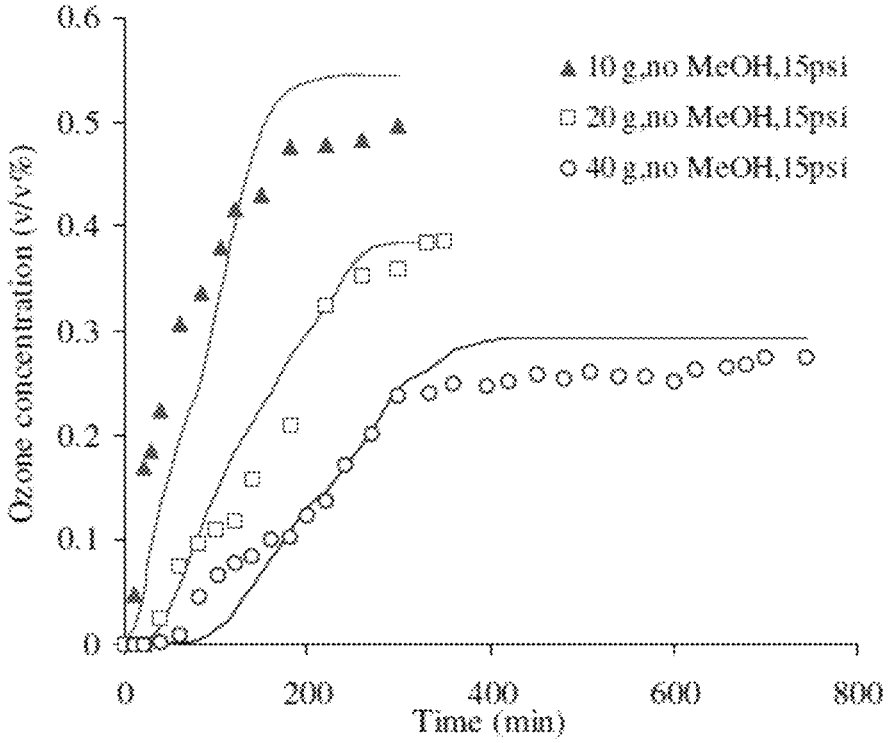
FIG. 36 is a plot of ozonation concentration vs. time of various loadings of asphaltene with regression curves in accordance with an embodiment of the present invention.

The effluent ozone concentration used in eq 21b and eq 22b was calculated by eq 7. When the asphaltene was ozonation under 15 psi and 1 atm, the stoichiometric coefficient was 8 (zl=0.125) for stage 1 and 4 (zl=0.25) for stage 2. In stage 1 and stage 2, it was assumed the decomposition of ozone always happened and the rate was proportional to asphaltene concentration. The $k_{2o}$ was much smaller than $k_{1o}$ in stage 1 and stage 2, so it would not affect the reaction rate, but in stage 3, $k_{2o}$ 1 finally determined the effluent ozone concentration. $k_{2o}$ could be increased due to higher concentration of soluble reactants in the liquid phase. FIG. 34, FIG. 35, and FIG. 36 matched actual value. The initial reaction constant and final reaction constant was a function of temperature. The equation to calculate the initial reaction constant is:

$$k = ko\exp\left(\frac{-Er}{RT}\right) \tag{24}$$

where Er=26.5 kJ/mol and ko=2.17*109 $M^{-1}*S^{-1}$. Under higher temperature and higher pressure, the a (specific area) values of different asphaltene concentrations would be much closer. This was because the reaction efficiency of ozone with the asphaltene was increased. Under higher pressure, the ratio of direct ozonation was much higher than under normal pressure due to high reaction rate and mass diffusion rate.

Differences Between Two Sets of Reaction Stages

Table 4.3 and Table 4.4 both divide ozonation of the asphaltene into three stages. The two different classification methods are decided by different concepts. The three stages defined in Table 4.3 are based on consumption rate of ozone by reactants, whereas the three stages defined in Table 4.4 are based on turning points during reaction kinetics. This difference could be explained by the asphaltene molecular structures and reaction pathways of asphaltenes with ozone. In Table 4.4, as discussed, the stoichiometric coefficient of the turning point between stage 1 and stage 2 is 8. The physical meaning of this value is that when one asphaltene molecule has reacted with 8 ozone molecules, the average reactivity of reactants decreases much faster. It could be caused by depleting of the direct ozonation sites. After this point, cleavage of substituents takes place and gradually contributes more and more in the whole reaction. Therefore, on average, one asphaltene molecule could have more than 8 high reactive sites. Most acids and esters are generated after this point. Kinetics study can more precisely reveal the reaction situation of asphaltenes with ozone.

For most ozone reactions, the kinetics regime shifts from quick regime to slow regime. Table 4.5 shows the Hatta number $H_{a1}$ and reaction factor E decrease with reaction time. The reaction rate before developing into the slow regime is affected by diffusion and reaction. Only for the very low kinetic regime, the reaction is determined by the reaction rate. In this pseudo first order reaction, $H_{a2}$ 2 is the ratio of the maximum chemical reaction rate through the film layer and maximum physical absorption rate in unit volume, so $H_{a2}$ should be employed to judge the importance of chemical reaction in the film and diffusion of ozone in the film. In this calculation, since $H_{a2}$ is not available, $H_{a1}$ has been employed to estimate the importance of reaction rate and mass diffusion rate in the reaction rate control mechanism. Actually, $H_{a1}>H_{a2}$ when the reaction factor E is larger than 1. Since E is not so large in the experiment, using $H_{a1}$ to estimate contributions of chemical reaction rate and diffusion rate in reaction rate control is still reasonable.

TABLE 4.5

Hatta number, reaction factor, and shifts of reaction kinetic regime. 10 g asphalthene (contains 40% by weigh of insoluble solids) ozonated in 300 ml DCM/MeOH under 15 psi in a column reactor.

| time (mm) | Effluent ozone concentration | $Ha_1$ | E | Regime |
|---|---|---|---|---|
| 0 | 0 | 3.025 | 3.039 | Fast |
| 10 | 0.0193 | 2.139 | 2.199 | Moderate |
| 20 | 0.0867 | 1.513 | 1.667 | |
| 30 | 0.12 | 0.980 | 1.301 | |
| 40 | 0.183 | 0.502 | 1.082 | |
| 60 | 0.283 | 0.0394 | 0.826 | |
| 80 | 0.312 | 0.0317 | 0.754 | |
| 100 | 0.323 | 0.0290 | 0.731 | Slow |
| 120 | 0.34 | 0.0290 | 0.719 | |
| 150 | 0.346 | 0.0283 | 0.709 | |
| 170 | 0.356 | 0.0279 | 0.703 | |
| 200 | 0.361 | 0.0275 | 0.697 | |
| 260 | 0.371 | 0.0266 | 0.683 | |

Reaction of the asphaltene in DCM/acetic acids has similar effluent ozone concentration profiles under various conditions. The effluent ozone concentration is controlled by reaction rate or diffusion rate, but diffusion is less important after fast regime. As shown in Table 4.5, the decrease of the Hatta number indicates the importance of ozone diffusion is decreasing with reaction time. In a different reaction system, such as in DCM/acetic acid and DCM/methanol, the solvent polarities could be different since most ozonation products are esters in DCM/methanol. This means once the ozonation intermediates are fully dissolved in the liquid phase, the reaction rate of ozone with the intermediates are not largely affected by solvent polarities. Direct ozonation is fast and less affected by solvent. The dissolving of reaction intermediates, most are hydroperoxides, could be a competition process for carbonyl oxides. Participating solvents can react with carbonyl oxides and prevent generation of intermolecular ozonides, polyozonides, peroxides, and polyperoxides, the predominant ozonation intermediates responsible for precipitation in nonparticipating solvent. High reaction temperature is favored for generation of hydroperoxides. The role of metals and insoluble solids in the reaction, especially in the free radical reaction and decomposition of hydroperoxides and ozonides, could be very important. These experimental results between the cleaned asphaltene and raw asphaltene show that the influence of the insoluble solids in raw asphaltene is not very significant. The final ozonation products and effluent ozone concentration profiles between two identical ozonation system using the extracted asphaltene and raw asphaltene as reactant are almost the same. The solids could have participated into reaction as catalysts or reacted with ozone, but their contributions to the whole reaction are not so significant. This could be due to the metals incorporated into asphaltene molecules, which are more important to free radical reaction. It is possible that after fast reaction regime, increasing temperature can increase reaction rate.

Ozonation of Athabasca asphaltene in DCM/participating solvents generates some volatile products by decomposition of large molecular weight ozonation intermediates through two reaction mechanisms. During ozonation of asphaltene in a DCM and participating solvent mixture, the total hydrocarbon mass concentration in the reaction medium is relative stable; thus, the reaction is modeled by introducing a global reaction constant k, which serves as a quantitative index to represent average reactivity of the hydrocarbon to ozone. Ozonation results of asphaltene in participating solvents using a bubble column reactor show that the reaction has three stages. The reaction proceeds from a fast reaction regime to a moderate regime and, finally, to a slow regime. In stage one, the reaction of ozone with asphaltene is totally contributed by direct incorporation of ozone into asphaltene molecules. In stage two, direct ozonation is still responsible for zone consumption; however, the ozone molecules incorporated into asphaltene molecules have greatly decreased the reactivity of the hydrocarbon mass. During this stage, the asphaltene-like reactants are gradually fragmented into smaller parts by cleavage of the substituents and breakage of the aromatic structures. At the end of the second stage, almost all reactive unsaturated bonds available to ozone are depleted and free radical reaction becomes important. As the reaction develops into the last stage, reactions of ozone with the reactants are primarily free radical reactions and it is reaction rate-controlled. The reaction rate is influenced by pressure, temperature, and bubbling dynamics of ozone through the liquid medium. Since the rate is diffusion-controlled and subject to reaction rate-control at different stages, ozone efficiency can be enhanced by increasing mass transfer speed under elevated pressure or increased agitation, as well as by increasing reaction rate at elevated temperature. The presence of participating solvents in the ozonation medium is crucial to maintain a homogenous liquid phase. Comparison of calculated results and experimental data show that the reaction kinetics model is capable of predicting the conversion rate of asphaltene to desirable products in a homogenous liquid phase, even under unfavorable conditions where the ozonation intermediates precipitate out. The kinetics model developed is potentially useful for determining reaction rate for design and scale-up implementation.

Example 3

Self-Sustaining Ozonation of Athabasca Asphaltene and Ozonation of Athabasca Asphaltene in Non-Halogenated Solvent As discussed herein, ozonation of Canadian Athabasca asphaltene in DCM/acetic acid or DCM/methanol showed that the participating solvent had prevented precipitation of the ozonation intermediates. When the asphaltene was ozonated in DCM or other halogenated solvents without adding any electron donors (participating solvents), precipitation of the ozonation intermediates was observed. Mass balance calculation showed that when two ozone molecules on average were added into one asphaltene molecule, almost all the asphaltene was precipitated out. The precipitation could be caused by generation of intermolecular secondary ozonides and polymeric ozonides or polymeric peroxides during ozonation. It is known that asphaltene molecules tend to form aggregations in solvent and aggregation situation could be caused by intermolecular hydrogen bond. Also, the increased stiffness or polarity of asphaltene molecules could be responsible for precipitation during ozonation. It was observed that ozonation of aromatic compounds generated insoluble solids. Generation of intermolecular ozonides and polymeric ozonides could be more responsible for precipitation for asphaltene molecules.

Although ozone still reacted with the precipitated intermediates for long-term ozonation of the asphaltene in nonparticipating solvent such as DCM and subsequent decomposition of the precipitated solids in methanol produced some desirable ozonation products, the precipitation problem still should be avoided in order to increase ozone efficiency and make industrial implementation of heavy hydrocarbon ozonation feasible. Asphaltenes are soluble in solvents with high surface tension above 25 dynes/cm, such as pyridine, carbon bisulfide, benzene, toluene, DCM, and carbon tetrachloride. Although solubility of asphaltenes in solvent mixture can be predicted, such as by Scatchard-Hildebrand solubility theory with a Flory-Huggins entropy mixing, prediction of asphaltenes solubility in cyclic solvent and linear solvent mixture or in polar solvent and nonpolar solvent are not reliable.

For most homogenous liquid phase ozonation reactions, reactants are ozonated in nonreactive solvents, such as DCM, chloroform, and tetrachlorocarbon, but large scale use of these solvents in industrial applications are not allowed or under restriction (EPA 40 CFR Part 63). It is necessary to study new nonhalogenated ozonation solvents. Biodiesel derived from vegetable oils could be an alternative solvent because asphaltenes are partially soluble in biodiesel. It has been reported by others that biodiesel can remove asphaltenes precipitated in the fuel tank. It was also reported by others that degradation of coal tar was accelerated due to dissolving and dispersion of asphaltenes in biodiesel. Esterification of Athabasca asphaltene ozonation products with methanol resulted in $C_4$-$C_{25}$ methyl eters and dimethyl esters. The structures of those esters were similar to the structures of esters in methanol transesterified vegetable oil. The present example provides a more environmental friendly solvent system for asphaltene ozonation. Ozonation of Canadian Athabasca asphaltene in DCM or DCM and participating solvent mixture showed that ozonation of the asphaltene resulted in abundant products of carboxylic acids. Based on the similarity in structures of Athabasca asphaltene ozonation products to biodiesels and the considerable solubility of asphaltenes in biodiesels, ozonation conversion of Athabasca asphaltene in biodiesel was conducted in this study. Feasibility of asphaltene ozonation in biodiesel also suggested that the self-sustaining ozonation of asphaltene in the ozonation mixture was possible.

In addition to biodiesel and self-sustaining ozonation system, a new ozonation solvent that does not contain halogen could be possible based on the ozonation reaction pathway discussion and stabilization mechanism for asphaltene ozonation system previously. Since from the beginning to the end of asphaltene ozonation, the molecular weight, polarity of ozonation products, and aggregation situation of the asphaltene experienced dramatic changed, single solvent was not always a good solvent during ozonation. The new ozonation solvent should at least have more than two components. One is major solvent or initial stage solvent to dissolve the asphaltene. The cosolvent is to dissolve the ozonation intermediates. Third solvent would be employed if the cosolvent is not a participating solvent. The selection criteria of a new major solvent are (a) high asphaltene solubility, (b) low reaction rate with ozone, and (c) easy separation from the ozonation products. Most good solvents for asphaltenes are reactive with ozone, such as toluene, benzene, THF, and pyridine, but the reaction of these solvents with ozone is much faster than asphaltenes, so the nonhalogen containing solvent must be selected from low molecular weight saturated compounds. In one embodiment, cyclohexane can be a suitable solvent. The major solvent employed in the new reaction system was cyclohexane since asphaltenes are soluble in cyclohexane. The reaction rate of ozone with cyclohexane is not high at room temperature. In many ozonation studies, cyclohexane is employed as cosolvent for reaction mechanism study. Cyclohexane normally acts as OH free radical scavenger. Study shows that ozonation of cyclohexane can generate cyclohexanone, cyclohexanol, and acids at room temperature via free radical reaction and the high reaction rate of cyclohexane with free radicals makes cyclohexane as free radical scavengers in ozonation of organics. The reaction starts from an in-cage addition of ozone. The in-cage addition of $O_3$ and initiation of the free radical reaction is similar to the reaction mechanism reported by others. For catalyzed ozonation of cyclohexane at high temperature, the highly-reactive active oxygen species from decomposition of ozone is more responsible for oxidation of cyclohexane. Since asphaltenes contain unsaturated aromatic structures, the eletrophilic addition reaction of ozone with asphaltene molecules could be more important to the whole reaction, and free radical reactions are not important at the beginning, cyclohexane as the initial major solvent is feasible. The free radical reaction initiated from decomposition of peroxides and isomerized carbonyl oxide could be more prominent when excessive ozone is introduced to the ozonation system. Therefore, at the later stage of ozonation, when all the reactive unsaturated sites in asphaltene molecules have been degraded, the cyclohexane concentration should be decreased as low as possible to increase free radical reactions.

EXPERIMENTAL

Ozone was produced from an ozone generator (Model T-816, Polymetrics Corp.) by passing dry and filtered air through it at an applied voltage of 100 V. The ozone/air flow rate was controlled at 0.8-1.8 L/min and the ozone concentration in the gas flow was 2.0%-1.6% by volume under room temperature. The output ozone concentration decreases when the gas flow rate is increased. Olive oil was purchased from a local Costco. The raw asphaltene used in this experiment was asphalt ne fraction of oil sands bitumen from Canada Athabasca, which contained about 40% by weight of insoluble part. Acetic acid (glacial) and sulphuric acid (AC grade) were from Mallinckrodt. All the solvents, methanol (from Fisher Scientific), cyclohexane (Omnisolv), acetone (from VWR), and dichloromethane (DCM, from Sigma-Aldrich), were analytical reagent grade. Indigo Blue solution was prepared by dissolving potassium indigo trisulfanate ($C_{16}H_7N_2O_{11}S_3K_3$) in distilled-DI water. To measure ozone concentration, a 100 ml round flask with 24/40 joint prefilled with 50 ml 1 mM/L indigo blue solution was filled with ozone containing gas in the headspace, then the flask was closed and vigorously shaken for 10 min. Absorbance of the solution was measured to calculate remaining potassium indigo trisulfanate concentration using a calibration curve. Since consumption of ozone was proportional to consumption of potassium indigo trisulfanate, ozone concentration was calculated.

The compounds in olive biodiesel, ozonated olive biodiesel, and the acetoneextractable fraction of the asphaltene ozonation products were identified by GC/MS method. For GC/MS analysis, a GC 6890N (Agilent Technologies) installed with a capillary column (HP-5 ms, nonpolar column, 30 m×0.25 mm×0.25 um, Agilent Technologies) was coupled with a MSD 5973 (Agilent Technologies) and controlled by the MSD Productivity ChemStation software (Agilent Technologies). 1 uL sample was injected into a splitless inlet at 250° C. The sample was carried by helium and the mass range from 50 to 550 m/z was scanned. The oven temperature was programmed from 50° C. (initially held for 1 min) to 100° C. at 25° C./min, followed by 100° C. to 350° C. at 5° C./min and, at the end, the temperature was maintained for 5 min.

Biodiesel was prepared by refluxing 200 ml olive oil with 100 ml methanol in a round flask using sulphuric acid as the acidic catalyst. Normally, biodiesel is prepared using basic catalysts due to the high reaction rate, but the reaction tends to generate emulsion if the feedstock and catalysts are not rigorously anhydrous. Another consideration of using sulphuric acid as the catalyst was that ozone tends to decompose much faster under basic condition. In this experiment, the obtained biodiesel was directly treated by ozone without extensive purification. In order to increase ozone efficiency and catalyze esterification of methanol with the carboxylic acids generated during ozonation, sulphuric acid was selected as the catalyst. The molar ratio of vegetable oil to methanol was about 1 to 10, in comparison with the stoichiometric value of 1:3. Excessive methanol was used to ensure a complete conversion of glycerides to esters. Methyl esters (biodiesel) were produced from olive oils via acid-catalyzed transesterification with methanol. After being refluxed for 1 hour, the product mixture separated into two layers of glycerol (bottom) and methyl esters (top). Methanol was boiled off from the top layer.

The present inventors have discovered that ozonation of the asphaltene in DCM and participating solvents generated lots of alkanoic acids or their esters that have similar molecular structures of biodiesel components, but the acids obtained from ozonation did not contain double bonds. Actually, the reaction rate of ozone biodiesel is very fast, so before using biodiesel as the ozonation solvent for heavy hydrocarbons, this solvent must be pro-ozonated to remove all double bonds. Ozonation of olive biodiesel was performed by bubbling ozone/air though 200 ml biodiesel and 50 ml methanol mixture in a three-neck flask at room temperature for more than 6 hours until the effluent ozone concentration was higher than 1% by volume. It was observed that the reaction temperature was automatically increased to 30±2° C. in the first two hours. During ozonation, methanol was continuously added into the liquid phase to keep constant reaction volume. After ozonation, the ozonation products were refluxed with methanol to make sure all the acids had reacted with methanol to form esters. After ozonation, the remaining methanol in the liquid was evaporated at elevated temperature.

Before ozonation of Athabasca asphaltene, the solubility of the asphaltene in biodiesel and in ozonated biodiesel was determined by measuring the weight loss of asphaltene samples in the olive oil biodiesel. As asphaltene molecules were aggregated in solid state, heating and mechanical mixing was required to accelerate the dissolution process. The asphaltene/biodiesel mixture or asphaltene/ozonated biodiesel mixture (50 g asphaltene in 200 ml liquid) was heated to 80° C.-90° C. and agitated by ultrasound for at least 30 min. After agitation, the mixture was separated by vacuum filtration. The remaining solid asphaltene was washed by acetone for 3 times (each time 200 ml acetone) and dried at 60° C. until weight does not change. The solubility of the asphaltene in biodiesel and pre-ozonated biodiesel was calculated by mass balance results. Solubility of the asphaltene in biodiesel was found to be 50±6 g/L biodiesel. However, solubility of the asphaltene in pre-ozonated biodiesel was 38±5 g/L, which was lower than in biodiesel. Since Athabasca asphaltene contains a hexane extractable part and this part could be co-precipitated resin or asphaltene extractable by nonpolar solvent, the soluble part of the asphaltene in biodiesel or the ozonated biodiesel could come from the hexane extractable part in asphaltene. In this experiment, biodiesel must be ozonated before ozonation of the asphaltene because the reaction rate of ozone with biodiesel molecules containing double bonds is much higher than with asphaltene molecules.

Ozonation of Athabasca asphaltene was conducted in the pre-ozonated biodiesel. Because this asphaltene was not very soluble in biodiesel and the reaction rate of ozone with the asphaltene in biodiesel was much lower than in DCM, the gas flow rate was reduced to 0.8-1.6 L/min and ozone concentration was 1.8±0.2% by volume. For the typical reaction, 25 g of raw asphaltene (containing 40% by weight clay and other constituents) was ozonated in 200 ml of ozonated biodiesel in a three-neck flask or a LC column for 16 hours. The reaction temperature was controlled between 10° C. to 120° C. For reaction at elevated temperature (50-55° C.), the reaction was carried out in a LC column reactor under 14-15 psi and the gas flow rate was 0.8 L/min (normal pressure). The ozone concentration in gas flow was measured by the indigo blue method. Higher reaction temperature, e.g., 120° C., was employed for ozonation under elevated pressure, such as at 80-90 psi.

Self-Sustaining Ozonation

One reason for employing pre-ozonated biodiesel as solvent was to show feasibility and laid the ground work of using the ozonation products from the asphaltene to act as solvent and sustain asphaltene conversion by ozone because the pre-ozonated biodiesel has similar chemical structures of the asphaltene ozonation products. To initiate asphaltene conversion, biodiesel was still used as seed solvent for solid asphaltene, but the resulting product mixture was recycled as reaction solvent to sustain the conversion. The self-sustaining solvent process will, out of environmental and regulatory concerns, replace the use of chlorinated solvent such as DCM.

Figure 37:
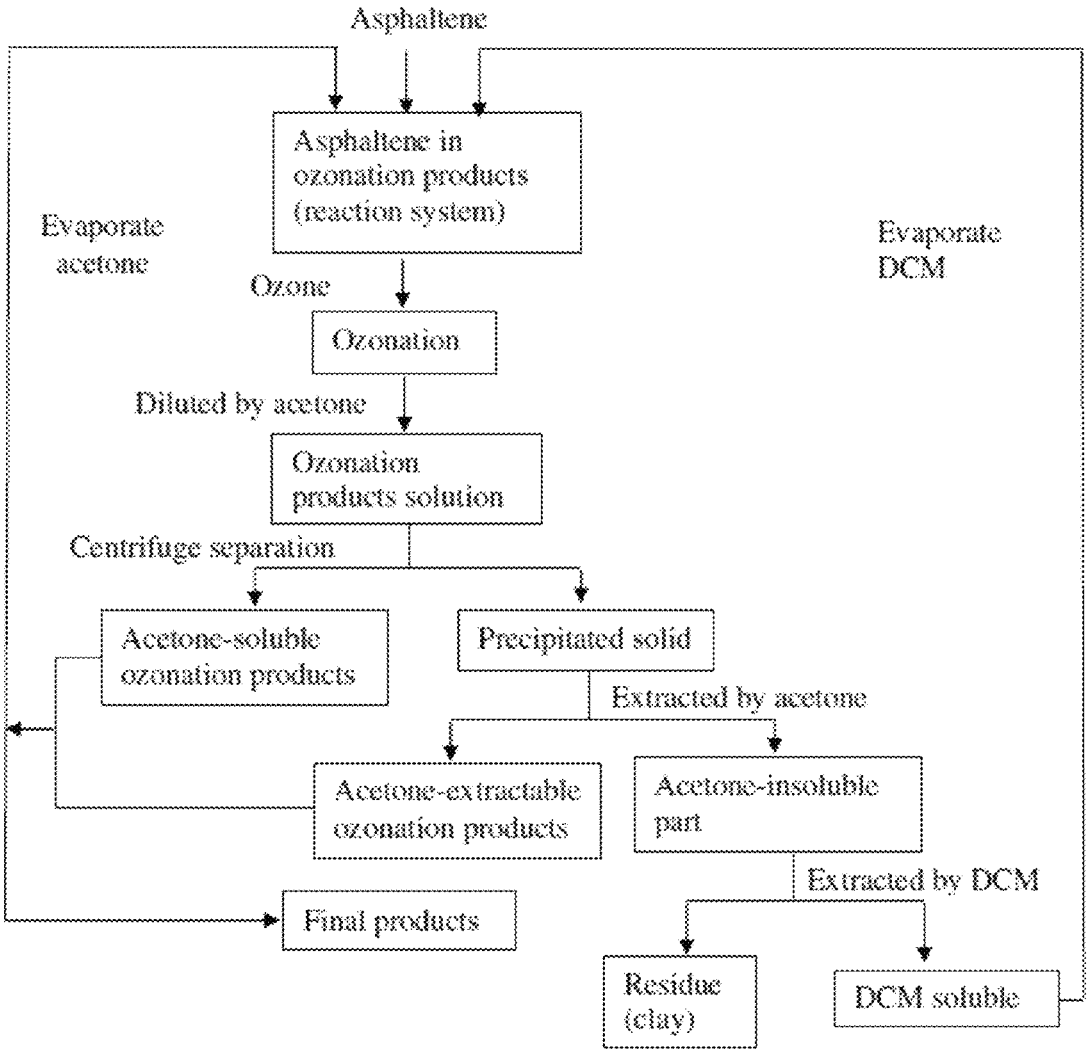
FIG. 37 is a flowchart of a self-sustaining ozonation process in accordance with an embodiment of the present invention.

The flowchart (FIG. 37) shows the reaction process and separation procedures for the ozonation products. To operate the self-sustaining conversion process, the ozonated mixture of the asphaltene in biodiesel was refluxed with methanol every time to make sure that all acids (ozonation products from asphaltene) were converted to esters. Raw asphaltene was added into the mixture and ozonated by bubbling ozone through the mixture under normal pressure. To lower viscosity of the reaction mixture and prevent generation of ozonides, methanol was continuously added into the reaction mixture. The concentration of methanol must be <5% by volume. Higher methanol concentrations would greatly alter the properties of the solvent, causing it to lose the ability to dissolve asphaltenes. The asphaltene concentration in the reaction system was controlled between 10 g/L to 300 g/L. The temperature was controlled between room temperature to 80° C. High asphaltene concentration was not desirable at low temperature due to increased viscosity of the mixture. For the typical reaction, 20-60 g of raw asphaltene was added into 200 ml of the ongoing mixture and subject to ozonation (up to 24 hours) under ambient pressure. The temperature was maintained at 50-55° C. and methanol was continuously added into the reaction system, while its concentration <5% by volume at all times. The gas flow rate was 0.8-1.6 L/min. After the reaction was completed, separation of the products was performed as shown in FIG. 37. The insoluble solid was precipitated in acetone and weighed. After the acetone insoluble part was dried, DCM was used to extract the solid. The DCM-soluble part in the solid was an indicator of the degree of conversion, which served as a practical way to evaluate the degree of asphaltene conversion by ozone, whereas the methanol esterified ozonation products were identical to the solvent compounds. The product liquid could be recycled as the self-sustaining solvent.

Samples were taken every 2 hours or 4 hours during reaction. The samples were diluted by acetone to precipitate the insoluble intermediates and inorganic constituents. The compounds in acetone solution were identified by GC/MS method. The ozone concentration at the reactor outlet was measured by the indigo blue method during ozonation to estimate the consumption rate of ozone in the reaction system.

Ozonation of Athabasca Asphaltene in Nonhalogenated Solvent

DCM/acetic acid and DCM/MeOH were identified as good solvent systems for asphaltene conversion. Pre-ozonated biodiesel and the ozonation products of the asphaltene (self-sustaining solvent) were also viable solvents for asphaltene conversion, albeit at reduced reaction rates, particularly during the initial stage of conversion. The lower kinetics was due to the relatively lower solubility of asphaltene and ozonation intermediates in the ester mixture and/or lower mass transfer rate of ozone in the ester mixture. The acetone-extractable part of the ozonation products showed that it would take much longer (up to 20 hours) to totally convert asphaltene.

It was possible to increase the conversion rate by increasing ozonation temperature or adding cosolvents. The cosolvent could be the light cut of the final ozonation products from the asphaltene or small compounds that do not contain halogens yet possessing good solvent capability for the asphaltene and ozonation intermediates. Ozonation of the asphaltene in a self-sustaining system has shown that the amount of esters with relatively low molecular weights in the solvent system had significant influence on the reaction rate of the intermediates. Solvent molecules of smaller molecular weights could allow ozone to permeate better, as well as promote ozonation intermediates with relatively loose aggregated structures. Thus, other nonhalogenated solvent systems were investigated.

A practical solvent for asphaltene conversion should be a good solvent for asphaltenes prior to ozonation, and be a good solvent for the intermediates and final products of ozonation, without the occurrence of precipitation throughout the reaction. However, the properties of the reaction medium such as polarities and molecular weights changed significantly from the beginning of the conversion to the end. Thus, formulation in the reaction medium should be adjusted accordingly to prevent precipitation and sustain the conversion. A desirable nonhalogenated reaction system should provide high initial reaction rate and stable conversion rate throughout. Commercialization of asphaltene conversion dictates an effective, speedy reaction system.

Most good solvents for asphaltenes either react with ozone or contain halogens, including toluene, pyridine, THF, DCM, and chloroform. In addition, the workable solvent is subject to other considerations, such as relatively low molecular weight for easy solvent separation and high diffusion rate of ozone in it, and economical viability for scale-up operation. In view of these challenges, cyclohexane could be an advantageous selection. The solubility of asphaltenes in cyclohexane is much higher than in other saturated hydrocarbons; however, the solubility of asphaltenes in cyclohexane mixed with other cosolvents will greatly depend on the properties of the cosolvents. Some suitable cosolvents include polar solvents such as water, acetic acid, MeOH, acetone, biodiesel, and ester products derived from asphaltene conversion. These mixed solvent systems were tested using the observed amount of precipitation of the asphaltene and the intermediates throughout the reaction as a guide.

The reaction rate of the asphaltene with ozone was estimated by measuring effluent ozone concentration when the influent ozone concentration was stable. Occurrences of precipitation due to the ozonation intermediates in different solvent systems were compared for the selection of good solvent systems. The degree of asphaltene conversion into final products was calculated by determining the acetone-soluble part of samples taken at different ozonation times. The ozonation time for total conversion in different solvent systems were also compared to estimate reaction rates.

Ozonation of 20 g of raw asphaltene in 250 ml of different solvent systems was conducted in a 500 ml three-neck flask. Ozone was introduced into the reaction system through a gas diffuser. The reaction temperature was controlled between 0° C. to 50° C. with a heater. The solvent was returned to the reactor by a condensing column installed on the reactor. During ozonation, the effluent ozone concentration was measured by the indigo blue method. Since some reaction media were not homogenous, the fully mixed reaction system was sampled every 30 min or 60 min. The dried sample was extracted by acetone to separate ozonation products from the asphaltene and the reaction intermediates. The amount of acetone-extractable products was a criterion to estimate the degree of conversion. Precipitation of the asphaltene intermediates was examined by the amount of solid attached on the gas diffuser and the amount of solids that settled to the reactor bottom.

Ozonation in the Optimized Solvent System

The cyclohexane/acetone solvent system was a good solvent system for asphaltene conversion by ozone. This system was capable of continuous changes in solvent system polarity in response to formation of the ozonation intermediates and the products throughout the conversion. The cyclohexane to acetone ratio could be readily adjusted to allow high reaction rate. In addition, a small amount of water along with other polar solvents (MeOH) could be added to aid the conversion of ozonation intermediates into the final esterified products.

In the typical reaction, 20 g of the asphaltene (with 40% insoluble solids) was added into 200 ml of cyclohexane and stirred at 50° C. for 30 min (stirring and heating accelerate asphaltene dissolution), and then 50 ml (20% by volume) of acetone was added into the solution. The reaction was conducted in a 1 L LC glass column. A small amount of water or MeOH was added into the reaction system to accelerate the decomposition of reaction intermediates. As low temperature was desirable for volatile solvents, the reaction temperature was not controlled at the beginning. The reaction temperature could be increased to 50° C. to increase the reaction rate during the first 2 hours; the reaction temperature should be much lower than the boiling point of solvent mixture. During ozonation, acetone was continuously added into the reaction system to keep a constant reaction volume. With evaporation of cyclohexane during ozonation and the continual addition of acetone into the reaction medium, the final solvent system contained more than 90% acetone, with a corresponding low ozonation temperature below 10° C. Samples were taken every 30 min or 60 min. The samples were dried and extracted by acetone to determine the reaction degree. Some samples were refluxed with methanol to make more esters. The acetone solution was analyzed by GC/MS to identify the ozonation products.

Figure 38:
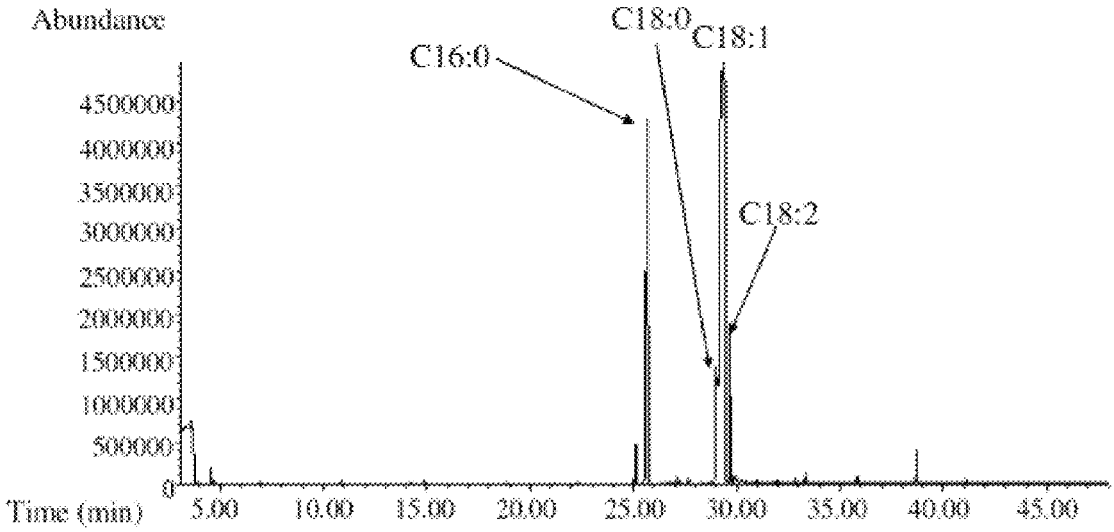
FIG. 38 is GC/MS chromatogram of olive-derived biodiesel of methyl esters via transesterification with methanol in accordance with an embodiment of the present invention.

The gas chromatogram of the biodiesel derived from olive oil is illustrated in FIG. 38. There are four major peaks that are palmitate $C_{16}$:0, which stands for the carbon number and hydrogen deficiency, stearate $C_{18}$:0, Oleate $C_{18}$:1, and linoleate $C_{18}$:2, all methyl esters, in addition to smaller fractions of $C_{20}$:0, $C_{16}$:1, $C_{20}$:1, and $C_{16}$:2.

Ozonation of biodiesel is a typical Criegee mechanism reaction. Methanol directly reacts with carbonyl oxide to generate methyl esters. When oxidants are present, carbonyl species are oxidized to various carboxylic acids, which are subsequently esterified by methanol. The evidence was that some acids were identified. The acids could be from oxidation of aldehydes since ozonation of alkenes in participating methanol are esters and aldehydes. This assumption was reasonable because the total concentration of carboxylic acids was much higher than the concentration of aldehydes. The gas chromatogram of ozonated biodiesel derived from an olive oil via ozonolysis is presented in FIG. 39 (the ozonated biodiesel was highly diluted by acetone). The major peaks later than 25 min are saturated methyl esters that are not reactive during ozonolysis, e.g., methyl palmitate and methyl stearate. The four major products of ozonolysis were identified to be $C_9$ methyl esters or aldehyde, i.e, azelate, pelargonaldehyde, methyl azelaaldehydate dimethyl, and methyl pelargonate. The two largest fractions, azelaaldehydate and dimethyl azelate, were the upgrading products from the first double bond of methyl oleate ($C_{18}$:1) and linoleate ($C_{18}$:2), and showed comparable abundances. Pelargonaldehyde and pelargonate had smaller abundances because they were formed from methyl oleate only. Further oxidation of aldehyde (yielding acetals or carboxylic acids) was reflected by the smaller pelargonaldehyde fraction and the emerging fractions of nonanal dimethyl acetal and pelargonic acid, the sum of which matches pelargonate, the pair-product of azelaaldehydate. Dominant $C_9$ methyl esters or aldehyde lead to the conclusion that methyl oleate ($C_{18}$:1) and linoleate ($C_{18}$:2) are mainly containing double bonds at 9-position.

Ozonation of Athabasca Asphaltene in Biodiesel and Self-Sustaining Ozonation

It was found that ozonation of the asphaltene required relatively high temperature. This was because the asphaltene was not totally dissolved in ozonated biodiesel and the viscosity of the sludge was much higher than in the asphaltene/DCM mixture. As discussed herein, low temperature was desirable in DCM/methanol system. Also, kinetics study shows that diffusion rate of ozone in DCM was very high because of the low molecular weight of DCM. If the reaction rate of asphaltene ozonation was mainly controlled by diffusion, low reaction temperature should be fine because of the high diffusion rate of ozone in DCM at low temperature. However, in this reaction system, higher temperature was employed to balance the reaction rate and the diffusion rate. In the new biodiesel reaction system, the boiling point of solvent was much higher than in DCM. The reaction temperature was increased to enhance reaction rate and diffusion rate. However, the temperature should be kept lower than the boiling point of the reaction system (<100° C.), otherwise ozone could not be absorbed into the reaction phase. Thus, the reaction temperature was controlled at 50-55° C. High solid concentration resulted in high viscosity of the mixture. The solid concentration in biodiesel was controlled between 100 g/L to 300 g/L. Methanol was continuously added into the reaction system during reaction. Since both methanol and biodiesel were not good solvents for asphaltenes, the methanol concentration in the reaction phase was controlled at lower than 5%. Reaction intermediates had different structures at different reaction stages. At the beginning, the ozonation intermediates in DCM solvent were not soluble in most solvents, such as DCM, toluene, and acetone. The initial intermediates could be asphaltene molecules with hydroperoxide groups, which were reaction products of methanol with carbonyl oxides. Because the polarity and stiffness of asphaltene molecule have been changed, the intermediates were not soluble in DCM or toluene again. Since the structure of intermediates still kept asphaltene frame, intermediates were also insoluble in acetone or hexane. During ozonation, the molecular size of the intermediates was decreasing and, finally, almost all the ozonation products were soluble in acetone, so high solubility of the initial intermediates was important for the whole reaction. If the solubility of the initial intermediates was not high in biodiesel, the total reaction time would be very long.

Figure 39:
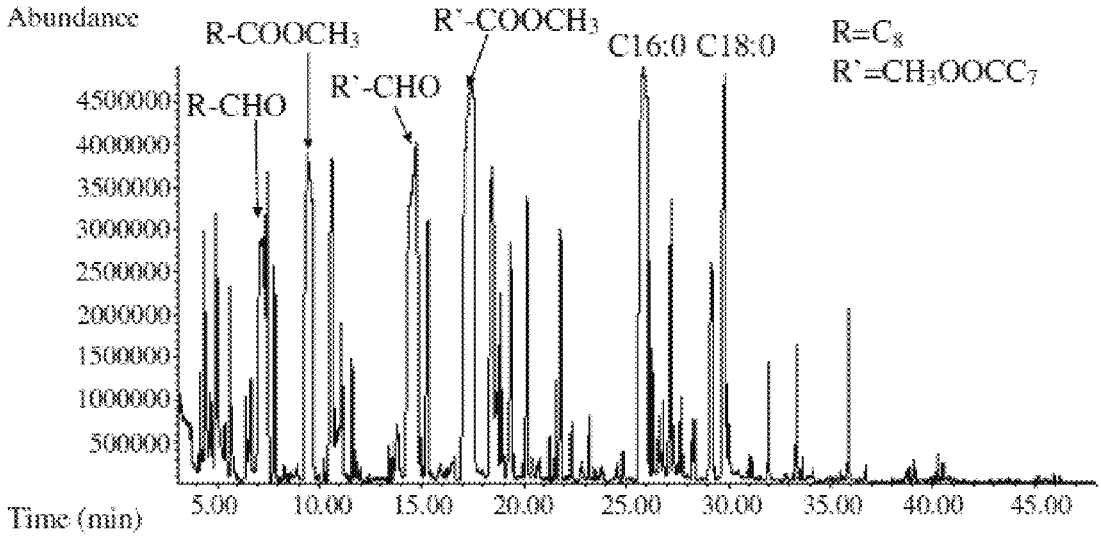
FIG. 39 is a GC/MS chromatogram of upgraded biodiesel via ozonation of methyl esters with methanol in accordance with an embodiment of the present invention.
Figure 40:
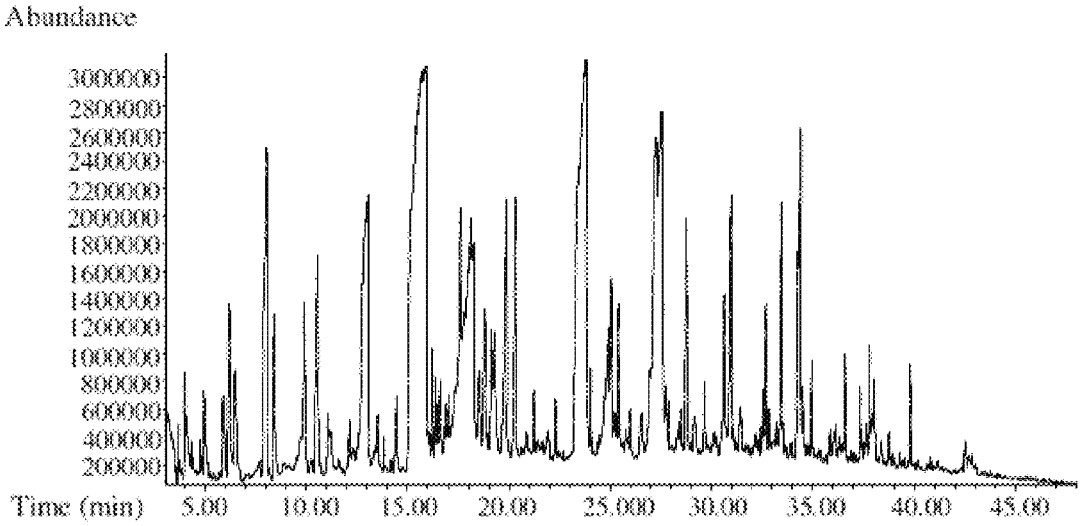
FIG. 40 is GC/MS chromatogram of ozonated asphaltene in olive-derived biodiesel after 16 hours in accordance with an embodiment of the present invention.

Differences between FIG. 39 and FIG. 40 show that some new products are generated after the asphaltene is ozonated in biodiesel. The differences have confirmed reaction of the asphaltene in biodiesel. GC/MS also has identified abundant methyl esters having more than 20 carbons. Since the biodiesel rarely contains esters longer than $C_{20}$, the presence of heavy esters was another evidence of asphaltene conversion by ozone in biodiesel.

The ozonated asphaltene-biodiesel mixture was diluted by acetone. After dilution, the mixture was centrifugally separated and the insoluble solid was extracted by acetone and dried. The weight of the insoluble part was about 50% of the raw asphaltene added in biodiesel. Because the raw asphaltene contained 40% by weight of insoluble materials (nonasphaltene materials), this result indicated that nearly all asphaltene was converted. Almost all asphaltene molecules were decomposed to acids after ozonation and dissolved in biodiesel. The previous results discussed herein of asphaltene conversion in DCM showed ozonation products that were double the weight of the asphaltene after ozonation with methanol and that almost all the ozonation products were soluble in acetone. In comparison, the present results with biodiesel indicated that almost all the asphaltene was reacted and dissolved. The remaining solids might contain inactive clay and other ozonation products, such as the remaining cores of the original asphaltene molecules with some carboxylic branches.

Analytical results show that the reaction of the asphaltene with ozone in the self-sustaining solvent system follows the same reaction pathways as in the DCM/methanol system. The intermediates are not soluble in acetone and DCM. The low molecular weight esters in the reaction phase are crucial for dissolving of the asphaltene and the ozonation intermediates, as the reaction of ozone with asphaltene will stop if asphaltene is totally insoluble in the mixture. Some low molecular weight ozonation products, such as low molecular weight esters, are generated during ozonation. If the effluent gas is not condensed to reflux solvent and volatile ozonation products, some low molecular weight ozonation products will be removed from the reaction system. It is possible that low molecular weight compounds can make ozone more penetrable in the solvent system and make the asphaltene also soluble in solvent.

Figure 41:
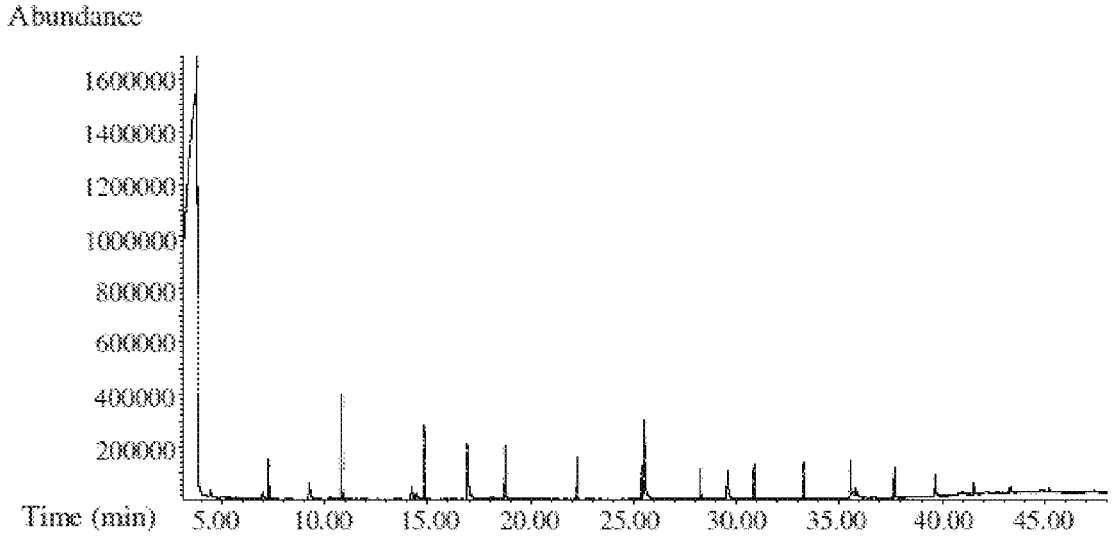
FIG. 41 is a GC/MS chromatogram of DCM-extracted ozonation intermediates of ozonated asphaltene in accordance with an embodiment of the present invention.

The GC/MS analysis of DCM extracted intermediates from the acetone precipitated part is shown in FIG. 41. As shown, the peaks were due to some residual esters. The DCM-soluble part contains molecules too large to be identified by GC/MS. This part could still contain major structural frames of the asphaltene molecules.

Figure 42:
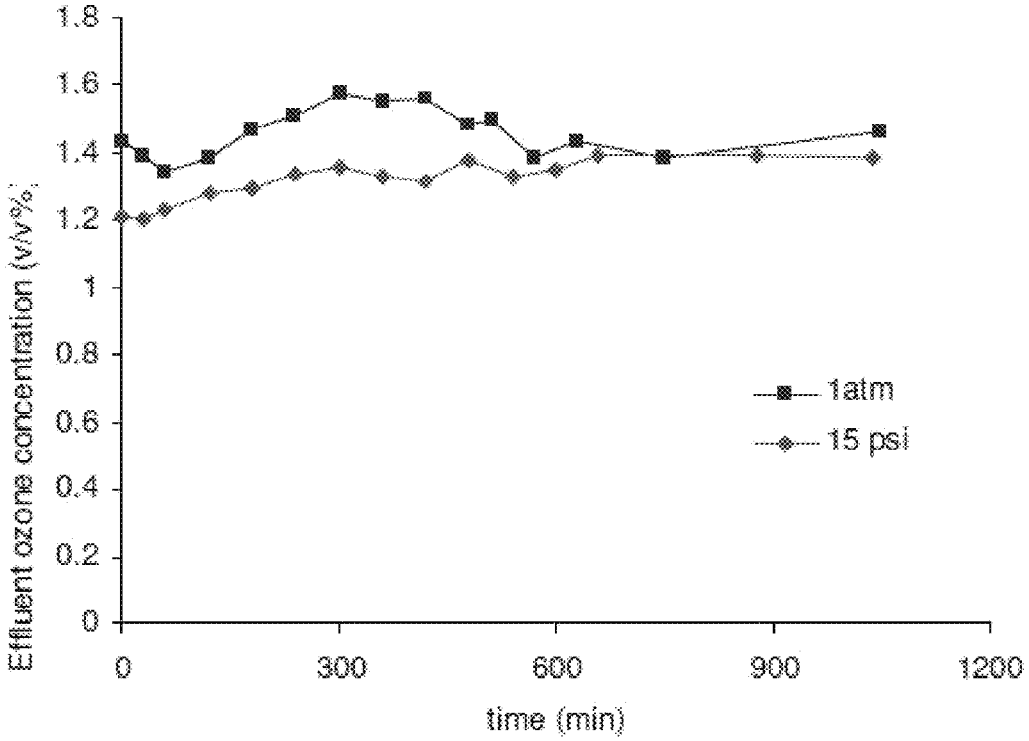
FIG. 42 is a plot of effluent ozone concentration vs. reaction time for ozonated asphaltene in accordance with an embodiment of the present invention.
Figure 43:
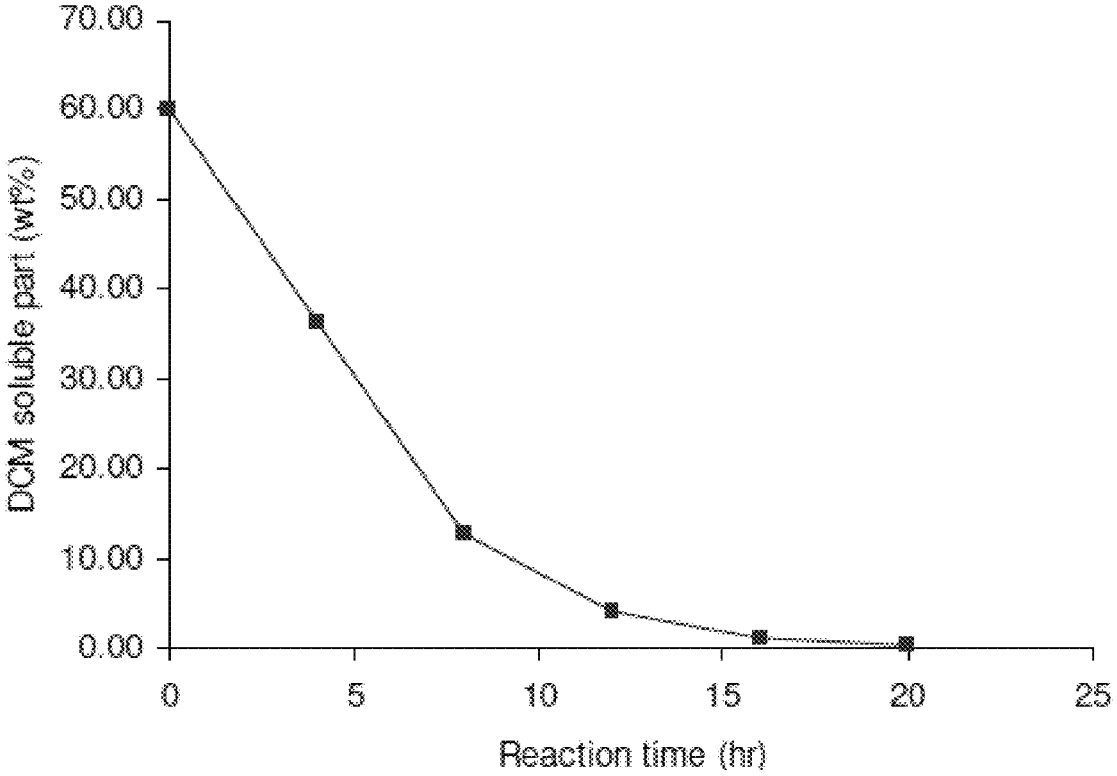
FIG. 43 is a plot of DCM soluble wt % vs. reaction time for ozonated asphaltene in accordance with an embodiment of the present invention.

The effluent ozone concentration profiles under different conditions are shown in FIG. 42. The influent ozone concentration was about 1.9% by volume at the flow rate of 1.2 L/min, and the reaction temperature was 50-60° C. The consumption rate of ozone was estimated by comparing influent and effluent ozone concentrations. The effluent ozone concentrations in FIG. 42 show that the reaction rate of ozone with the asphaltene in the ester mixture was much lower than in the DCM systems. This is due to lower solubility of the asphaltene and lower diffusion rate of ozone in the ester mixture. During ozonation, the asphaltene underwent similar reaction pathways in the ester or DCM/participating solvent. The reaction was in the slow kinetics regime. The DCM soluble weight percentages of the acetone-precipitated intermediates of samples taken at different times during ozonation of a typical run are shown in FIG. 43.

Unlike ozonation of the asphaltene in the DCM or DCM/methanol system in a column reactor, the self-sustaining ozonation of the asphaltene was performed in a three-neck flask at elevated temperature because this reaction required moderate agitation. The three-neck flask approximated more of a semi-batch stir tank reactor than a semi-batch bubble column reactor. However, when the self-sustaining ozonation of the asphaltene was conducted in a column reactor, the reactor was also treated as a semi-batch stir reactor due to stirring and mixing properties of the viscous liquid phase in the reactor. Therefore, the reaction kinetics would be best described by equations for the semi-batch stir tank.

Figure 44:
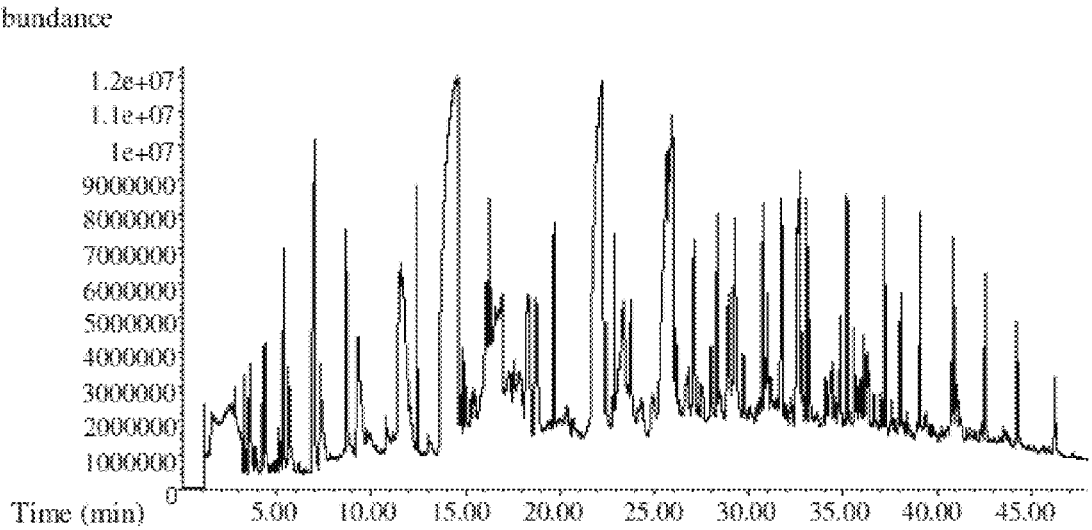
FIG. 44 is a GC/MS chromatogram of ozonated asphaltene in a self-sustaining ozonation system in accordance with an embodiment of the present invention.

The effluent ozone concentration in the self-sustaining system was higher than in the case of the DCM or DCM/methanol system, suggesting the reaction kinetics in the ester solvent to be slower. The reaction rate was likely controlled by mass transfer as well as reactions at the interfacial film. GC/MS chromatogram in FIG. 44 shows some ozonation products of one self-sustaining run. Before this run, the self-sustaining ozonation has been repeated 15 times. Each time, 20 g raw asphaltene was mixed with 200 ml acetone extracted liquid from previous batch. Since in each run the total volume of reaction mixture was increased after ozonation and esterification, after 15 cycles, the liquid contains more esters originated from the asphaltene than from biodiesel.

Evaluation of the New Solvents

Normally, less than 20% (by volume) of a polar solvent was added into the asphaltene cyclohexane solution before ozonation. However, for the systems with cyclohexane/biodiesel and cyclohexane/ester products, cyclohexane could be reduced to 50% (by volume) because the purpose of these solvent systems was to reduce the required external solvent amount. The asphaltene sample was still soluble in cyclohexane/acetone, cyclohexane/acetic acid, cyclohexane/biodiesel, and cyclohexane/ester products systems, as shown by homogeneous spreading of these solutions on glass wall after centrifugal separation. A part of the asphaltene could precipitate out in cyclohexane/acetic acid mixture if the acetone or acetic acid volume was more than 20%. Precipitation of the asphaltene was observed in the cyclohexane/biodiesel and cyclohexane/ester products system when the cyclohexane amount was lower than 70%. Unlike other systems, addition of a small amount (<5%) of methanol into the asphaltene solution could greatly change the surface tension because this solution did not spread on the glass surface after adding methanol. It was hard to judge solubility of the asphaltene in the cyclohexane/methanol system since the asphaltene did not precipitate out. The asphaltene could be emulsified in this solvent system or form large clusters. Since water was not soluble in cyclohexane, addition of water would not change the asphaltene solubility in cyclohexane. The purpose of adding water to the asphaltene solution was to prevent formation of ozonides or peroxides. During ozonation of the asphaltene in the cyclohexane/water system, the water volume ratio could be increased to 50%. Addition of a very small amount of a third polar solvent into the above solvents systems would not significantly change the asphaltene solubility, such as adding a very small amount of methanol into cyclohexane/acetone, cyclohexane/acetic acid, cyclohexane/biodiesel, and cyclohexane/final products systems. It was mentioned before that the initial intermediates were asphaltene molecules with several oxygen atoms added inside. Because the asphaltene molecular polarity and stiffness had been changed, the intermediates were not soluble in DCM or toluene again. Since the structure of intermediates was still asphaltene frame, intermediates were also insoluble in acetone or hexane. High solubility of the initial intermediates was crucial for the whole reaction. If the initial intermediates precipitated out, the total reaction time would be as long as in pure DCM. The most difficult thing was how to make the initial intermediates soluble in the new reaction system. The objective of new solvent systems were 1) before ozonation, asphaltene should be soluble in the solvent; 2) during ozonation, all intermediates should be soluble in solvent, especially for the initial intermediates; and 3) final ozonation products should be soluble in solvent.

Ozonation of the asphaltene in typical different cyclohexane solvent systems is shown in Table 5.1. The initial volume percentages of polar solvents were 20% acetone, 10% acetic acid, 5% methanol, 1% water, 50% biodiesel, and 50% esterified ozonation products. Results of ozonation of the asphaltene in different solvent systems suggested that the cyclohexane/acetone system could be a good solvent system. The initial conversion rate was fast and the amount of precipitated intermediates was much less than in other solvent systems. For all other solvent systems except for the cyclohexane/MeOH system, the initial effluent ozone concentrations were very low.

TABLE 5.1

Ozonation of asphaltene in different solvent systems.

| Reaction system | Reaction temperature (° C.) | Initial effluent ozone concentration | Increasing rate of effluent ozone concentration | Subsequent effluent ozone concentration | Precipitation of intermediates | Time for total conversion |
|---|---|---|---|---|---|---|
| Cyclohexane/acetone | 5-20 | Low | Slow | Low | Some | 5-6 h |
| Cyclohexane/MeOH | 10-50 | Medium | Fast | High | Serious | N/A |
| Cyclohexane/water | 10-50 | Low | Fast | High | Serious | N/A |
| Cyclohexane/acetic acid | 10-50 | Low | Fast | High | Serious | 20-30 h |
| Cyclohexane/biodiesel | 20-50 | Low | Fast | Medium | Medium | 15-20 h |
| Cyclohexane/ozonation products | 20-50 | Low | Fast | Medium | Medium | 15-20 h |
| cyclohexane | 10-50 | Low | Fast | High | Serious | N/A |

High consumption rates of ozone indicated that the asphaltene was soluble in these systems and the initial ozonation rates were in fast reaction regime. The effluent ozone concentrations of all other systems increased fast because the cosolvents had not effectively prevented precipitation of ozonation intermediates. The effluent ozone concentration of the cyclohexane/MeOH system was always high. This indicated the cyclohexane/methanol system was not a good reaction medium when methanol concentration was too high. In comparison to other solvent systems, the rates of increasing effluent ozone concentrations in cyclohexane/biodiesel and cyclohexane/esterified products systems were much faster. This was because lower cyclohexane concentration made the asphaltene less soluble. However, the subsequent effluent ozonation concentrations of these two systems were relatively low, which indicated the ozonation intermediates were partially soluble in these systems.

Pure cyclohexane, however, was not a good solvent for asphaltene conversion because cyclohexane could not change with increasing polarity of the reaction medium due to the formation of intermediates and final esterified products. Also, cyclohexane did not help decompose ozonation intermediates into smaller compounds. The cosolvent in the cyclohexane mixture should be a polar solvent suited for ozonation intermediates as well as a competitor for carbonyl oxides and a good initiator for decomposition of ozonation intermediates. Refluxing with methanol was one method to decompose the ozonation intermediates. Adding water or acid also accelerated decomposition of ozonation intermediates to acids. Since the ozonation intermediates were not soluble in most solvent, detailed analysis was very difficult.

For the cyclohexane/methanol system, a small amount of methanol greatly altered the aggregation of the asphaltene in cyclohexane. This resulted in relatively high effluent ozone concentration. Precipitation of reaction intermediates was also serious. Former ozonation of the asphaltene in DCM/methanol system has shown DCM/methanol was a good solvent for ozonation intermediate. Since methanol was a participating solvent and the intermolecular ozonides or peroxides were not likely to generate, the precipitated ozonation intermediates could have different structures from the precipitated intermediates in DCM. If the cyclohexane/methanol system was not a good solvent for the large compounds initially present, then the reactions would cease after precipitation. In such a case, acetone did not extract any significant amount of ozonation products even after 24 hours ozonation.

Ozonation of the asphaltene in the cyclohexane/acetic acid system was much better than in the cyclohexane/methanol system. Different amounts of acetic acids (5%, 10%, 15%, and 20% by volume) have been experimented with. It was found that high initial acetic concentration had lower asphaltene solubility although precipitation of intermediates was less problematic compared to low initial acetic acid concentration. It required long ozonation (>24 hours) to enable complete extraction of ozonation products by acetone. The low efficiency of ozonation showed that this reaction system would not be practical for asphaltene conversion.

Experiments showed that a small amount of water in cyclohexane generated more precipitation. The initial ozonation intermediates contained stiff ozonides structures, followed by decomposition of the ozonides with water. Since polarity and hydrogen bonds force of acids were much higher, precipitation of the ozonation intermediates decomposed by water could be more serious. Addition of more water resulted in emulsification of the whole reaction system during ozonation.

Ozonation of cyclohexane/biodiesel and cyclohexane/ozonation products showed that more cyclohexane had higher ozone efficiency. In this experiment, different solvent systems with 10% to 50% of esters were experimented. It was found that the cyclohexane/esters mixture was not a good solvent for initial ozonation intermediates because precipitation of the ozonation intermediates still occurred. Another problem was that in this reaction, a third polar solvent (e.g., methanol) was needed instead of water in the cyclohexane/acetone system. Since methanol concentration was not easy to control in the cyclohexane reaction system and it was to be controlled at a low concentration, operation of this reaction system would be complicated.

Reaction in Cyclohexane System

Figure 45:
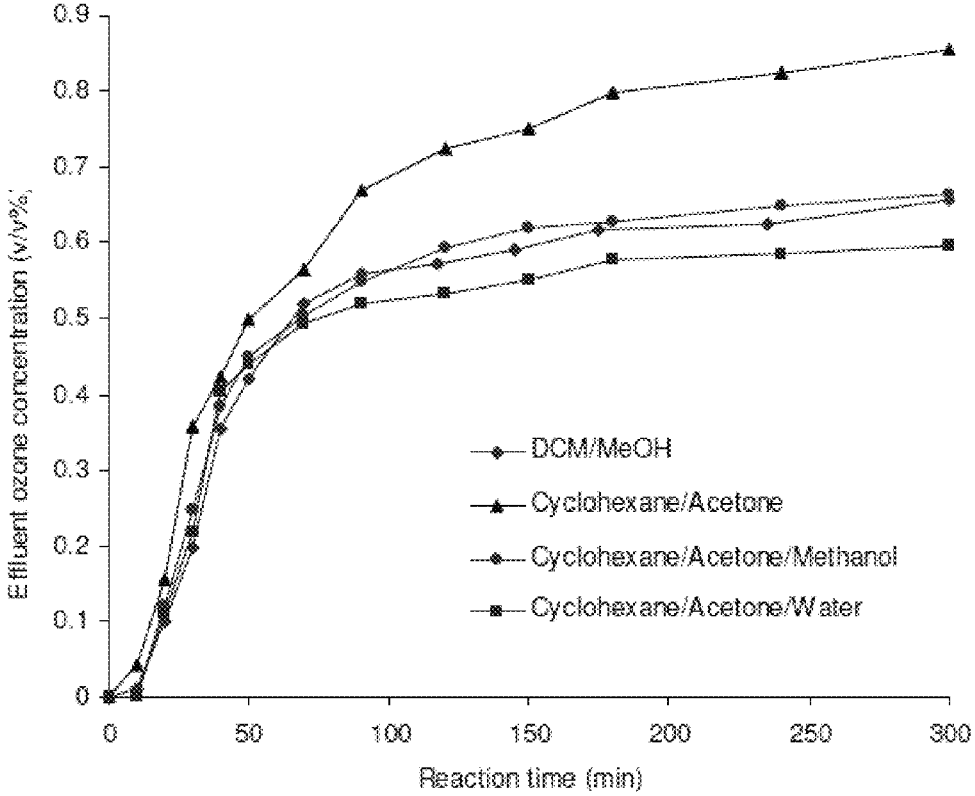
FIG. 45 is a plot of effluent ozone concentrations vs. reaction time for ozonated asphaltene in various systems in accordance with an embodiment of the present invention.

Precipitation of the reaction intermediates is negligible if a small amount of water was added into the reaction system as the third solvent. When methanol was continuously added into reaction systems, precipitation of ozonation intermediates would occur and the precipitate would disappear later if the initial methanol concentration was too high. Therefore, the subsequent effluent ozone concentration was higher than other ozonation conditions, indicating low efficient use of ozone. After 5 hours ozonation, all ozonation products were soluble in acetone. This new ozonation system was more efficient than the DCM/MeOH system because of its higher reaction rate. Results of the asphaltene under different conditions are shown in Table 5.2. High initial ozonation temperature shortened the total reaction time. The initial reaction was more important for asphaltene ozonation. Decomposition of large ozonation intermediates to smaller intermediates even happened in the first hour. Fast reaction of ozone with the asphaltene and fast reaction of the soluble ozonation intermediate in solvent systems have minimized the total ozonation time. Mass balance calculation showed that ozone efficiency could be operated at >80% efficiency under good operation conditions. FIG. 45 compares effluent ozone concentrations of different systems. The reaction rate of ozone with the intermediates in the cyclohexane/acetone/water system or the cyclohexane/acetone/MeOH system was a little higher than in the DCM/methanol system, but the initial reaction rate of the former is lower due to lower initial solubility of the asphaltene in cyclohexane. Higher initial ozonation temperature or higher reaction pressure could alleviate this shortcoming. The reaction rate in cyclohexane/acetone was relatively lower than in other systems. FIG. 45 shows that the reaction kinetics in the cyclohexane system also shifts from a regime of very rapid kinetics to a regime of very slow kinetics.

TABLE 5.2

Ozonation of 20 g raw asphaltene in optimized cyclohexane/acetone mixture.

| No. | Reaction system | Reaction temperature (° C.) | Ozonation products weight | Precipitation of intermediates | Time for total conversion |
|---|---|---|---|---|---|
| 1 | Cyclohexane/acetone/water | 5-10 | 31 g | no | 6 h |
| 2 | Cyclohexane/acetone/water | 50 ± 5 | 33 | no | 5 h |
| 3 | Cyclohexane/acetone/MeOH (2% MeOH) | 5-10 | 33 g | no | 5 h |
| 4 | Cyclohexane/acetone/MeOH (4% MeOH) | 5-10 | 32 g | some | 7-8 h |
| 5 | Cyclohexane/acetone | 5-10 | 29 g | no | 6 h |

When the asphaltene was ozonated in cyclohexane systems, at the beginning, the acetone was 20% in the solvent. During ozonation, 50:50 acetone/cyclohexane was added into the reaction phase to keep the constant reaction volume. The cyclohexane concentration was decreasing due to evaporation during the reaction. There was a turning point during ozonation. For reactions in FIG. 45, after asphaltene molecules were ozonated for 120 min in pure cyclohexane, only acetone was added into the reaction phase. The ozonation intermediates would precipitate out if cyclohexane was added into the mixture at this time. Previous results showed that for ozonation of the asphaltene in DCM/Methanol, all the DCM soluble intermediates disappeared at this time. This indicated that the structures of the ozonation intermediates had dramatically changed and cyclohexane was not a good solvent for these intermediates.

Figure 46A:
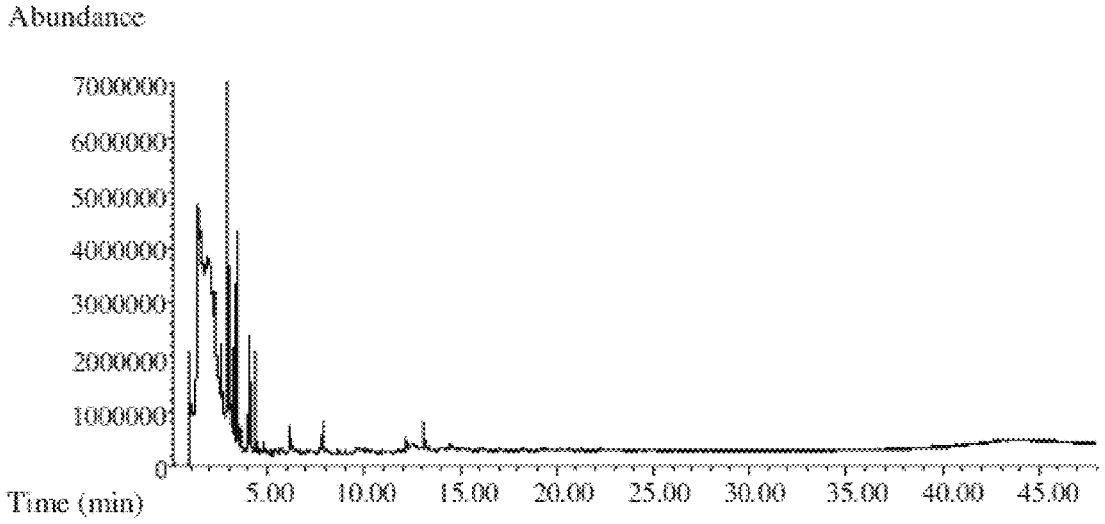
FIG. 46 is a GC/MS chromatogram of ozonated asphaltene in cyclohexane/acetone (A) before esterification and (B) after esterification in accordance with an embodiment of the present invention.
Figure 46B:
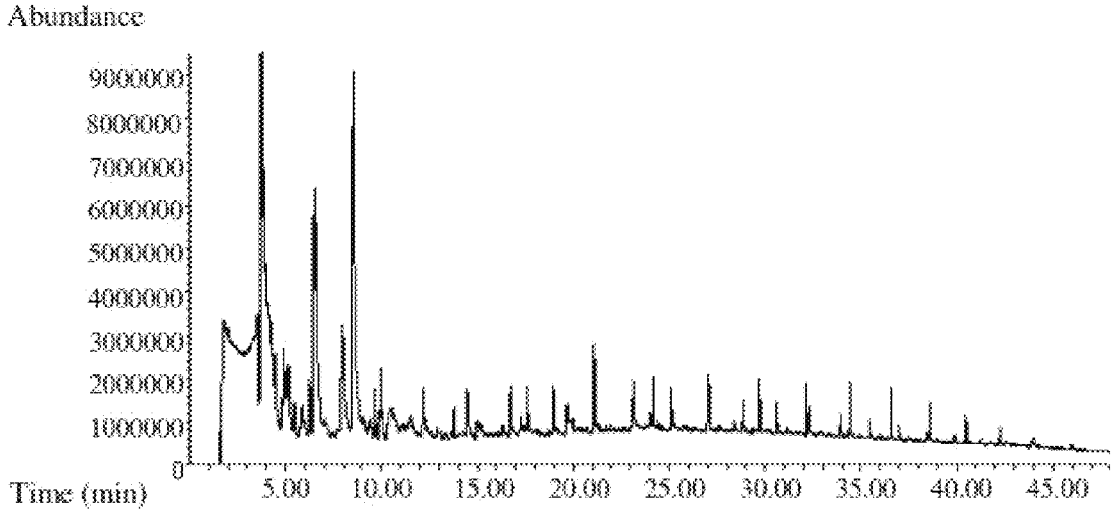

The reaction pathways of asphaltene ozonation in cyclohexane/acetone, cyclohexane/acetone/water, and cyclohexane/acetone/methanol could be different from the reaction pathways in DCM/Methanol or DCM/acetic acid. The reason was that acetone could have participated into ozonation. If the asphaltene was only ozonated in cyclohexane or DCM, at the end of ozonation, all the reactants were precipitated. The precipitated solids were not soluble in acetone and toluene anymore. However, if acetone was continuously added into cyclohexane, at the end of ozonation, almost all the ozonation products were soluble in acetone. This difference showed that acetone had participated into ozonation. In pure DCM and cyclohexane, the precipitation of the ozonation intermediates could be caused by intermolecular reaction of carbonyl oxides with carbonyls since intramolecular reaction was not favored. Precipitation was caused by the intermolecular ozonides and polymeric ozonides. Also, the polyperoxides could be responsible for precipitation. If acetone was added into the reaction phase, reaction of acetone with carbonyls could have generated ozonides and prevented intermolecular reaction. This explained why the ozonation intermediates were not precipitated. Unlike other participating solvents, such as methanol and water, the participating acetone generated stable secondary ozonides. Therefore, GC/MS analysis did not identify any evaporative compounds after ozonation. Also, no acids were identified. Decompositions of the secondary ozonides obtained from the asphaltene in DCM and the asphaltene in cyclohexane/acetone in methanol were similar. FIG. 46 shows the ozonation products of the asphaltene in cyclohexane/acetone before and after being refluxed with methanol. In FIG. 46A, most peaks are the ozonation products from cyclohexane. Refluxing the ozonation products with methanol generated esters (FIG. 46B). This means the ozonation products were decomposed by methanol to form esters. Although the reaction rate of ozone with cyclohexane was very low and cyclohexane itself has been used as cosolvent to study the ozonation mechanism and the reaction rate of organics with ozone, some ozonation products originated from cyclohexane were abundant in GC/MS chromatograph.

Figure 47:
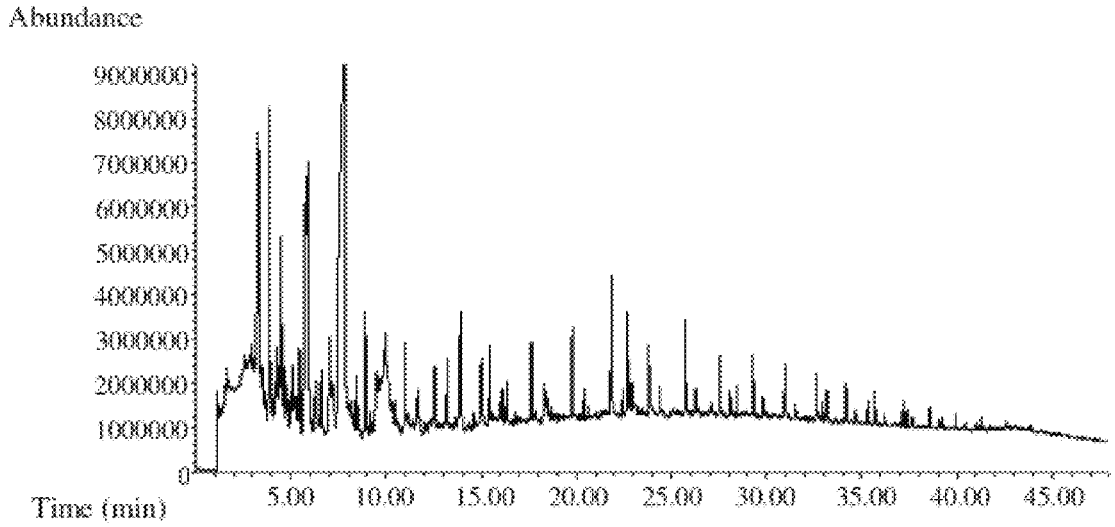
FIG. 47 is a GC/MS chromatogram of ozonated asphaltene in cyclohexane/acetone/water in accordance with an embodiment of the present invention.
Figure 48:
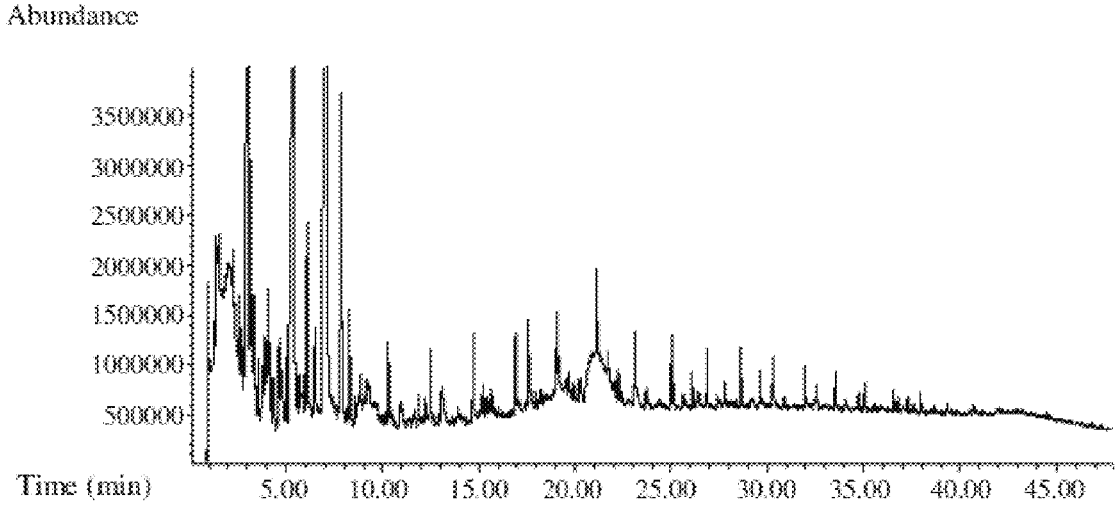
FIG. 48 is a GC/MS chromatogram of ozonated asphaltene in cyclohexane/acetone/methanol in accordance with an embodiment of the present invention.

When water or methanol was added into the ozonation reaction phase, no secondary ozonides were generated since the reactivity of methanol or water to carbonyl oxides is much higher than with acetone. GC/MS analysis had identified a lot of ozonation products (FIG. 47, FIG. 48), among which most were acids or esters. The role of cyclohexane to asphaltene ozonation is not clear. In ozonation of organics, cyclohexane was added into the reaction as a free radical scavenger. Generally, direct asphaltene ozonation is more important when reactive sites in the asphaltene molecules are still available. Presence of cyclohexane will not affect this reaction. Once the direct ozonation began to switch to free radical ozonation, acetone was added into the reaction phase to compensate for evaporation of solvent. The cyclohexane concentration finally decreases to a very low level. Compared to the ozonation products in DCM/Methanol, the methanol esterified ozonation products from cyclohexane/acetone/water and cyclohexane/acetone/methanol were more complicated and the yield of esters was lower. It was possible that some acids were generated from free radical oxidation of carbonyl fragments. The carbonyl fragments could be generated from decomposition of ozonides and decomposition of hydroperoxides. The existence of cyclohexane in reaction phase had greatly quenched these reactions because most free radicals had been captured by cyclohexane. Some major short retention time peaks in the GC/MS chromatographs (FIG. 48) are cyclohexanol; cyclohexanone; and hexanedioic acid, dimethyl ester.

Ozonation of Athabasca asphaltene in DCM/participating solvents, such as methanol, water, and acetic acids, can generate lots of carboxylic acids and their corresponding esters. Asphaltene is partially soluble in biodiesel and its volatile ozonation products are structurally similar to biodiesel components; ozonation of the asphaltene in a mixture of esters is possible. Biodiesel derived from olive oil should be pretreated by ozone in the presence of methanol to remove double bonds in biodiesel molecules to enhance its effectives as a reaction medium for asphaltene upgrading. Athabasca asphaltene can be decomposed in pre-ozonated biodiesel while methanol is added to the reaction medium as a participating solvent during ozonation. Due to the high viscosity of biodiesel and asphaltene mixture at room temperature, the reaction temperature should be increased to >50° C., but it still takes much longer reaction time for a total conversion. This could be caused by low solubility of asphaltene in the reaction medium. The return of low-boiling ozonation products returned to the reaction system by a condensation column is desirable. This enables a self-sustaining medium for ozonation of asphaltenes and it would make it practical if the ozone efficiency is enhanced by elevated temperature or inclusion of a third cosolvent. Nevertheless, the ozone efficiency is lower than other homogenous systems.

Another useful ozonation solvent system is the cyclohexane system. The cyclohexane/acetone/water and cyclohexane/acetone/methanol solvent systems are the most effective reaction systems. Dynamic control of the solvent composition enables asphaltene and the ozonation intermediates to be homogenously dispersed. Initially, acetone and participating solvent concentrations must be controlled at low levels to avoid precipitation of the asphaltene, but at the end, cyclohexane must be totally evaporated or replaced by other solvents. A point during ozonation exists at which the ozonation intermediates are more acetone-soluble and the eletrophilic addition mechanism is switched to free-radical chain reactions. It is necessary to remove cyclohexane as much as possible to ensure continual reaction of ozone with the intermediates.

The ozonation products in cyclohexane/acetone/water and cyclohexane/acetone/methanol systems are similar to the products obtained in DCM/participating solvents. The effluent ozone concentration profiles also indicate that the reaction rates of the asphaltene with ozone in the nonhalogenated solvents approximate that in the halogenated solvents.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of upgrading heavy hydrocarbons, comprising:

adding heavy hydrocarbons to a solvent system to form a reaction medium, said solvent system including in a first solvent that solubilizes at least a portion of the heavy hydrocarbons and a reactive solvent which reacts with ozonation intermediates, wherein the solvent system includes a mixture of cyclohexane, acetone, and water; a mixture of cyclohexane, acetone, and methanol; or combinations thereof; and ozonating the reaction medium with an ozone containing gas to provide ozonation products, and adding supplemental reactive solvent during ozonation sufficient to react with ozonation intermediates.

2. The method of claim 1, wherein the heavy hydrocarbon includes at least one of asphaltene, bitumen, vacuum residue, asphalt, and heavy oil.

3. The method of claim 1, wherein the heavy hydrocarbon is added to 0.5 to 20 volume percent of the solvent system.

4. The method of claim 1, wherein the solvent system has an initial reactive solvent to first solvent ratio of about 0.1:1 (V/V) to about 1:1 (V/V).

5. The method of claim 1, wherein the ozonating takes place at a temperature from −5° C. to 100° C.

6. The method of claim 1, wherein the ozonating occurs at a pressure of 0.01 psi to 100 psi.

7. The method of claim 1, wherein the ozonating occurs at a pressure of about 50 psi to about 100 psi.

8. The method of claim 1, wherein the ozonating occurs at a pressure of about 60 psi to about 80 psi.

9. The method of claim 1, wherein the ozonating is accomplished by flowing the ozone containing gas into the reaction medium at a rate of about 0.1 L/min to 10 L/min per liter of reaction medium and an ozone concentration of 0.1% to 15% by volume.

10. The method of claim 1, wherein the ozonating is accomplished in a bubble column reactor.

11. The method of claim 1, wherein the ozonation products remain substantially solubilized in the solvent system by continuously adding supplemental reactive solvent into the reaction medium during ozonation.

12. The method of claim 1, wherein a mole ratio of the ozone absorbed into the solvent system to the heavy hydrocarbon present in the solvent system is at least 2:1.

13. The method of claim 1, wherein the molecular weight of the heavy hydrocarbons are reduced by at least 50% after ozonating.

14. The method of claim 1, wherein the solvent system has a final reactive solvent to first solvent ratio of about 1:1 (V/V) to about 10:1 (V/V) after the ozonation.

15. The method of claim 1, wherein adding supplemental reactive solvent during ozonation comprises adding a mixture of supplemental reactive solvent and supplemental first solvent.

16. The method of claim 1, wherein adding supplemental reactive solvent during ozonation comprises adding reactive solvent only while allowing the first solvent to be reduced by evaporation.

17. The method of claim 1, wherein the first solvent is present in a greater volume than the reactive solvent before the ozonation, and wherein the first solvent is present in a lesser volume than the reactive solvent after the ozonation.

* * * * *